US011168928B2

(12) United States Patent
Matsumoto et al.

(10) Patent No.: US 11,168,928 B2
(45) Date of Patent: Nov. 9, 2021

(54) HEAT EXCHANGER OR REFRIGERATION APPARATUS

(71) Applicant: DAIKIN INDUSTRIES, LTD., Osaka (JP)

(72) Inventors: Yoshiyuki Matsumoto, Osaka (JP); Shun Yoshioka, Osaka (JP); Shouta Agou, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 13 days.

(21) Appl. No.: 16/498,776

(22) PCT Filed: Mar. 22, 2018

(86) PCT No.: PCT/JP2018/011532
§ 371 (c)(1),
(2) Date: Sep. 27, 2019

(87) PCT Pub. No.: WO2018/180932
PCT Pub. Date: Oct. 4, 2018

(65) Prior Publication Data

US 2020/0386453 A1 Dec. 10, 2020

(30) Foreign Application Priority Data

Mar. 27, 2017 (JP) ..... JP2017-061234

(51) Int. Cl.
*F25B 39/02* (2006.01)
*F24F 1/0018* (2019.01)
(Continued)

(52) U.S. Cl.
CPC ..... *F25B 39/028* (2013.01); *F24F 1/0018* (2013.01); *F25B 39/04* (2013.01);
(Continued)

(58) Field of Classification Search
CPC ..... F25B 39/028; F25B 39/04; F25B 40/00; F25B 40/02; F24F 1/0018; F24F 1/32;
(Continued)

(56) References Cited

U.S. PATENT DOCUMENTS 2,252,064 A * 8/1941 Cornell, Jr. ..... F28D 1/024 237/49
2,820,617 A * 1/1958 Tadewald ..... F28D 1/047 165/153

(Continued)

FOREIGN PATENT DOCUMENTS

EP 3015808 A1 5/2016
GN 103256757 A 8/2013

(Continued)

OTHER PUBLICATIONS

Written Opinion and International Preliminary Report on Patentability issued in corresponding International Application No. PCT/JP2018/011532 dated Oct. 1, 2019 (9 pages).

(Continued)

*Primary Examiner* — Tho V Duong
*Assistant Examiner* — Raheena R Malik
(74) *Attorney, Agent, or Firm* — Osha Bergman Watanabe & Burton LLP

(57) ABSTRACT

A heat exchanger in which a refrigerant that flows in from a first inlet and a second inlet exchanges heat with air flow and flows out from an outlet includes: an upwind heat-exchanging unit; a downwind heat-exchanging unit that includes the second inlet and is disposed beside the upwind heat-exchanging unit on a downwind side of the upwind heat-exchanging unit; and a flow path formation portion that includes a refrigerant flow path between the upwind heat-exchanging unit and the downwind heat-exchanging unit.

8 Claims, 30 Drawing Sheets

(51) Int. Cl.

| | |
|---|---|
| ***F25B 39/04*** | (2006.01) |
| ***F28D 1/04*** | (2006.01) |
| ***F28D 1/047*** | (2006.01) |
| ***F28D 1/053*** | (2006.01) |
| ***F28F 1/32*** | (2006.01) |
| ***F28F 9/02*** | (2006.01) |
| ***F28F 9/26*** | (2006.01) |
| *F28D 21/00* | (2006.01) |

(52) U.S. Cl.
CPC ..... *F28D 1/0435* (2013.01); *F28D 1/0471* (2013.01); *F28D 1/05391* (2013.01); *F28F 1/32* (2013.01); *F28F 9/0209* (2013.01); *F28F 9/262* (2013.01); *F28D 2021/007* (2013.01); *F28D 2021/0071* (2013.01)

(58) Field of Classification Search
CPC .. F28D 1/0435; F28D 1/0471; F28D 1/05391; F28D 2021/007; F28D 2021/0071; F28F 1/32; F28F 9/0209; F28F 9/262
USPC ..... 62/426
See application file for complete search history.

(56) References Cited

U.S. PATENT DOCUMENTS 4,173,998 A * 11/1979 Jahoda ..... B21D 53/085 165/150
5,076,353 A * 12/1991 Haussmann ..... F28D 1/05325 165/110
5,267,610 A * 12/1993 Culbert ..... B21D 53/085 165/151
5,509,272 A * 4/1996 Hyde ..... F24F 3/153 62/176.5
5,529,116 A * 6/1996 Sasaki ..... F28D 1/0417 123/41.51
5,988,267 A * 11/1999 Park ..... F25B 39/04 165/110
6,170,565 B1 * 1/2001 Nishishita ..... F28D 1/0435 165/135
6,273,182 B1 * 8/2001 Pautler ..... F28D 1/0435 165/140
6,672,375 B1 * 1/2004 Shippy ..... F24F 1/0059 165/122
8,006,512 B2 * 8/2011 Sanagi ..... F24F 1/0011 62/426
8,205,470 B2 * 6/2012 Yoshioka ..... F28D 1/0475 62/524
9,377,225 B2 * 6/2016 Song ..... F24F 1/14
9,618,229 B2 * 4/2017 Shiborino ..... F24F 13/30
2008/0173434 A1 * 7/2008 Matter ..... F28F 1/022 165/150
2009/0084131 A1 * 4/2009 Reifel ..... F24F 13/30 62/515
2012/0145364 A1 * 6/2012 Oritani ..... F25B 39/00 165/121
2013/0240176 A1 * 9/2013 Lee ..... F28F 1/24 165/59
2013/0306285 A1 11/2013 Jindou et al.
2016/0054010 A1 * 2/2016 Suhara ..... F25B 39/02 62/426
2016/0169586 A1 * 6/2016 Ito ..... F28D 1/05391 165/104.21
2016/0245560 A1 * 8/2016 Higashiiue ..... F25B 39/02
2016/0290730 A1 * 10/2016 Taras ..... F28D 1/05391
2016/0327343 A1 * 11/2016 Hwang ..... F28F 9/0204
2017/0336145 A1 * 11/2017 Nakamura ..... F28D 1/047
2018/0058736 A1 * 3/2018 Jin ..... F25B 39/00
2018/0135900 A1 * 5/2018 Jindou ..... F25B 39/00

FOREIGN PATENT DOCUMENTS

JP 2000329486 A 11/2000
JP 2001336896 A 12/2001
JP 2002-372383 A 12/2002
JP 2002350002 A 12/2002
JP 2006329511 A 12/2006
JP 2010-107102 A 5/2010
JP 2012-163319 A 8/2012
JP 2012-193872 A 10/2012
JP 2014-215011 A 11/2014
JP 2015-017738 A 1/2015
JP 2016-038192 A 3/2016
JP 2016-217565 A 12/2016

OTHER PUBLICATIONS

International Search Report issued in corresponding International Application No. PCT/JP2018/011532 dated Jun. 5, 2018 (4 pages).

* cited by examiner

HEAT EXCHANGER OR REFRIGERATION APPARATUS

TECHNICAL FIELD

The present invention relates to a heat exchanger or a refrigeration apparatus.

BACKGROUND

Hitherto, a flat-tube heat exchanger in which flat tubes through which a refrigerant flows are laminated is known. For example, Patent Literature 1 (Japanese Unexamined Patent Application Publication No. 2016-38192) discloses, in view of the fact that, in a flat-tube heat exchanger, pressure loss of a refrigerant easily occurs as the tube length increases, a two-row flat-tube heat exchanger that suppresses pressure loss by arranging heat-exchanging units including flat tube groups side by side on an upwind side and on a downwind side.

In addition, for example, Patent Literature 2 (Japanese Unexamined Patent Application Publication No. 2012-163319) discloses an air-conditioner flat-tube heat exchanger in which a plurality of flat tubes that extend in a horizontal direction are laminated in a vertical direction and in which a plurality of heat transfer fins that extend in the vertical direction and that contact the corresponding flat tubes are arranged side by side in the horizontal direction.

However, when the two-row flat-tube heat exchanger of Patent Literature 1 is used as a condenser of a refrigerant, a superheating area (flat-tube group where a gas refrigerant in a superheated state is assumed to flow) in the heat-exchanging unit on the upwind side and a subcooling area (flat-tube group where a liquid refrigerant in a subcooled state is assumed to flow) in the heat-exchanging unit on the downwind side partly overlap each other or are close to each other when viewed in an air flow direction. Therefore, the air flow that has passed the superheating area passes the subcooling area in the heat-exchanging unit on the downwind side. Consequently, in the subcooling area in the heat-exchanging unit on the downwind side, temperature differences between the refrigerant and the air flow are less likely to be properly ensured and there may be cases in which heat exchange is not properly performed. That is, there may be cases in which the degree of subcooling of the refrigerant that flows through the heat-exchanging unit on the downwind side is less likely to be properly ensured, and, in relation to this, the performance of the heat exchanger may be reduced (or the performance of a refrigeration apparatus including the heat exchanger may be reduced).

When the flat-tube heat exchanger of Patent Literature 2 is used as a condenser of a refrigerant, the superheating area and the subcooling area are adjacent to each other one above another. Therefore, depending upon the situation, heat is exchanged between the refrigerant that passes through the superheating area and the refrigerant that passes through the subcooling area via the heat-transfer fins. In relation to this, there may be cases in which the degree of subcooling of the refrigerant is not properly ensured.

PATENT LITERATURE

Patent Literature 1: Japanese Unexamined Patent Application Publication No. 2016-38192

Patent Literature 2: Japanese Unexamined Patent Application Publication No. 2012-163319

SUMMARY

Accordingly, one or more embodiments of the present invention provide a flat-tube heat exchanger that suppresses a reduction in performance (or a refrigeration apparatus that suppresses a reduction in performance).

A heat exchanger according to one or more embodiments of the present invention is a heat exchanger in which a refrigerant that flows in from a first inlet and a second inlet exchanges heat with an air flow and flows out from an outlet, and that includes an upwind heat-exchanging unit, a downwind heat-exchanging unit, and a flow path formation portion. The downwind heat-exchanging unit in an installed state is disposed beside the upwind heat-exchanging unit on a downwind side of the upwind heat-exchanging unit. The downwind heat-exchanging unit has the second inlet. The flow path formation portion forms a refrigerant flow path at a location between the upwind heat-exchanging unit and the downwind heat-exchanging unit. The upwind heat-exchanging unit and the downwind heat-exchanging unit each include a first header, a second header, and a plurality of flat tubes. The first header has a first header space formed in the first header. The second header has a second header space formed in the second header. The plurality of flat tubes is connected to the first header and the second header. The plurality of flat tubes is arranged side by side in a longitudinal direction of the first header and the second header. The flat tubes allow the first header space and the second header space to communicate with each other. When the refrigerant that has flown in from the first inlet and the second inlet exchanges the heat with the air flow and flows out from the outlet as a liquid refrigerant in a subcooled state, in the upwind heat-exchanging unit, a subcooling area is formed, and an upwind outlet-side space and an upwind upstream-side space are formed. The subcooling area is an area in which the liquid refrigerant in the subcooled state flows. The upwind outlet-side space is the first header space or the second header space that communicates with the outlet. The upwind upstream-side space is the first header space or the second header space that is disposed on an upstream side of a flow of a refrigerant at the upwind outlet-side space. When the refrigerant that has flown in from the first inlet and the second inlet exchanges the heat with the air flow and flows out from the outlet as the liquid refrigerant in the subcooled state, the refrigerant flow path allows a downwind downstream-side space and the upwind upstream-side space to communicate with each other. The downwind downstream-side space is the second header space that is disposed on a most downstream side of a flow of a refrigerant in the downwind heat-exchanging unit.

In the heat exchanger according to one or more embodiments of the present invention, when the refrigerant that has flown in from the first inlet and the second inlet exchanges heat with the air flow and flows out from the outlet as a liquid refrigerant in the subcooled state, in the upwind heat-exchanging unit, the subcooling area that is an area in which the liquid refrigerant in the subcooled state flows is formed, the upwind outlet-side space (the first-header space or the second-header space that communicates with the outlet) and the upwind upstream-side space (the first-header space or the second-header space that is disposed on the upstream side of the flow of the refrigerant at the upwind outlet-side space) are formed, and the refrigerant flow path that is formed between the upwind heat-exchanging unit and the downwind heat-exchanging unit allows the downwind downstream-side space (the second-header space that is disposed on the most downstream side of the flow of the refrigerant in the downwind heat-exchanging unit) to communicate with the upwind upstream-side space.

Therefore, when the heat exchanger is used as a condenser of refrigerant, the refrigerant that has passed through the downwind heat-exchanging unit is discharged from the outlet after being sent to the upwind heat-exchanging unit. As a result, the subcooling area can be disposed mainly at the upwind heat-exchanging unit on the upwind side. Consequently, the superheating area on the upwind side (the area in which the gas refrigerant in the superheated state is assumed to flow) and the subcooling area on the downwind side (the area in which the liquid refrigerant in the subcooled state is assumed to flow) are suppressed from partly overlapping each other or being close to each other when viewed in the air flow direction. Thus, the air flow that has passed the superheating area is suppressed from passing through the subcooling area. Therefore, in the subcooling area, temperature differences between the refrigerant and the air flow are easily properly ensured and cases in which heat exchange is not properly performed are reduced. That is, regarding the refrigerant that flows through the downwind heat-exchanging unit, the degree of subcooling is easily properly ensured.

When the heat exchanger is used as a condenser of a refrigerant, the downwind heat-exchanging unit can be formed so that the superheating area and the subcooling area are not adjacent to each other one above another. As a result, heat exchange between the refrigerant that passes through the superheating area and the refrigerant that passes through the subcooling area is reduced. In relation to this, this helps the degree of subcooling of the refrigerant in the subcooling area to be properly ensured.

Therefore, a reduction in performance is suppressed.

Here, "first inlet" and "second inlet" refer to openings that function as inlets for a refrigerant (primarily, a gas refrigerant in a superheated state) when the heat exchanger is used as a condenser. "Outlet" refers to an opening that functions as an outlet for a refrigerant (primarily, a liquid refrigerant in a subcooled state) when the heat exchanger is used as a condenser. "Flow path formation portion" refers to a portion that forms a refrigerant flow path between the upwind heat-exchanging unit and the downwind heat-exchanging unit, and is, for example, a space formation member in the refrigerant pipe or the header collecting pipe.

According to one or more embodiments, in the upwind heat-exchanging unit, the first header space is partitioned into an upwind first space, an upwind second space, and an upwind third space. In the upwind heat-exchanging unit, the second header space is partitioned into an upwind fourth space, an upwind fifth space, and an upwind sixth space. The upwind fourth space communicates with the upwind first space via the flat tubes. The upwind fifth space communicates with the upwind second space via the flat tubes. The upwind sixth space communicates with the upwind third space via the flat tubes. The upwind heat-exchanging unit further includes a communication path formation portion. The communication path formation portion forms a communication path. The communication path is a flow path that allows the upwind fourth space and the upwind fifth space to communicate with each other. The first inlet communicates with the upwind first space. The second inlet communicates with the first header space that is disposed on a most upstream side of a flow of a refrigerant in the downwind heat-exchanging unit. The outlet includes a first outlet and a second outlet. The first outlet communicates with the upwind second space. The second outlet communicates with the upwind outlet-side space. One of the upwind third space and the upwind sixth space corresponds to the upwind outlet-side space. Another of the upwind third space and the upwind sixth space corresponds to the upwind upstream-side space.

In the heat exchanger according to one or more embodiments of the present invention, a plurality of paths are formed in the upwind heat-exchanging unit. That is, in the upwind heat-exchanging unit, a path that is formed by the upwind first space, the flat tubes, the upwind fourth space, the communication path, the upwind fifth space, the flat tubes, and the upwind second space and a path that is formed by the upwind third space, the flat tubes, and the upwind sixth space are formed. In addition to this, a path that is formed by the upwind third space, the flat tubes, and the upwind sixth space communicates with the downwind downstream-side space via the refrigerant flow path that is formed by the flow path formation portion. Therefore, when the heat exchanger is used as a condenser of a refrigerant, in the path of the upwind heat-exchanging unit formed by the upwind third space, the flat tubes, and the upwind sixth space, formation of the subcooling area is facilitated regarding a refrigerant that flows through the downwind heat-exchanging unit. Thus, regarding the refrigerant that flows through the downwind heat-exchanging unit, the degree of subcooling is easily properly ensured.

At the heat exchanger according to one or more embodiments of the present invention, in the path that is formed by the upwind first space, the flat tubes, the upwind fourth space, the communication path, the upwind fifth space, the flat tubes, and the upwind second space, the upwind fourth space and the upwind fifth space in the second header communicate with each other at the communication path. Therefore, a refrigerant that flows through such a path is turned back at a location between the upwind fourth space and the upwind fifth space. As a result, when the heat exchanger is used as a condenser of a refrigerant, construction of the heat exchanger so that the superheating area and the subcooling area are not adjacent to each other one above another is facilitated. Therefore, heat exchange between the refrigerant that passes through the superheating area and the refrigerant that passes through the subcooling area is further reduced. In relation to this, this further helps the degree of subcooling of the refrigerant in the subcooling area to be properly ensured.

Therefore, a reduction in performance is further suppressed.

"Communication path formation portion" here refers to a portion that forms a communication path that allows the upwind fourth space and the upwind fifth space to communicate with each other, and is, for example, a space formation member in the refrigerant pipe or the header collecting pipe.

"Path" refers to a refrigerant flow path that is formed by allowing an internal space of an element that is included in the heat exchanger to communicate with an internal space of another element.

According to one or more embodiments, in the upwind heat-exchanging unit, the first header space is partitioned into an upwind first space, an upwind second space, and an upwind third space. In the upwind heat-exchanging unit, the second header space is partitioned into an upwind fourth space, an upwind fifth space, and an upwind sixth space. The upwind fourth space communicates with the upwind first space via the flat tubes. The upwind fifth space communicates with the upwind second space via the flat tubes. The upwind sixth space communicates with the upwind third space via the flat tubes. The upwind heat-exchanging unit further includes a second communication path formation portion. The second communication path formation portion forms a second communication path. The second communication path allows the upwind second space and the upwind fourth space to communicate with each other. The first inlet communicates with the upwind first space. The second inlet communicates with the first header space that is disposed on a most upstream side of a flow of a refrigerant in the downwind heat-exchanging unit. The outlet includes a first outlet and a second outlet. The first outlet communicates with the upwind fifth space. The second outlet communicates with the upwind outlet-side space. One of the upwind third space and the upwind sixth space corresponds to the upwind outlet-side space. Another of the upwind third space and the upwind sixth space corresponds to the upwind upstream-side space.

In the heat exchanger according to one or more embodiments of the present invention, a plurality of paths are formed in the upwind heat-exchanging unit. That is, in the upwind heat-exchanging unit, a path that is formed by the upwind first space, the flat tubes, the upwind fourth space, the second communication path, the upwind second space, the flat tubes, and the upwind fifth space and a path that is formed by the upwind third space, the flat tubes, and the upwind sixth space are formed. In addition to this, the path that is formed by the upwind third space, the flat tubes, and the upwind sixth space communicates with the downwind downstream-side space via the refrigerant flow path that is formed by the flow path formation portion. Therefore, when the heat exchanger is used as a condenser of a refrigerant, in the path of the upwind heat-exchanging unit formed by the upwind third space, the flat tubes, and the upwind sixth space, formation of the subcooling area is facilitated regarding a refrigerant that flows through the downwind heat-exchanging unit. Thus, regarding the refrigerant that flows through the downwind heat-exchanging unit, the degree of subcooling is easily properly ensured.

At the heat exchanger according to one or more embodiments of the present invention, in the path that is formed by the upwind first space, the flat tubes, the upwind fourth space, the second communication path, the upwind second space, the flat tubes, and the upwind fifth space, the upwind fourth space in the second header and the upwind second space in the first header communicate with each other at the communication path. Therefore, a refrigerant that flows through such a path is turned back at a location between the upwind fourth space and the upwind second space. As a result, when the heat exchanger is used as a condenser of a refrigerant, formation of the heat exchanger so that the superheating area and the subcooling area are not adjacent to each other one above another is facilitated. Therefore, heat exchange between the refrigerant that passes through the superheating area and the refrigerant that passes through the subcooling area is further reduced. In relation to this, this further helps the degree of subcooling of the refrigerant in the subcooling area to be properly ensured.

Therefore, a reduction in performance is further suppressed.

"Second communication path formation portion" here refers to a portion that forms a second communication path that allows the upwind second space and the upwind fourth space to communicate with each other, and is, for example, a space formation member in the refrigerant pipe or the header collecting pipe.

According to one or more embodiments, a plurality of the downwind heat-exchanging units is provided. In the upwind heat-exchanging unit, the first header space is partitioned into an upwind seventh space and an upwind eighth space. In the upwind heat-exchanging unit, the second header space is partitioned into an upwind ninth space and an upwind tenth space. The upwind ninth space communicates with the upwind seventh space via the flat tubes. The upwind tenth space communicates with the upwind eighth space via the flat tubes. The second inlet communicates with a downwind first upstream-side space. The downwind first upstream-side space is the first header space or the second header space that is disposed on a most upstream side of the downwind heat-exchanging unit that is disposed on an upwind side. The first inlet communicates with a downwind second upstream-side space. The downwind second upstream-side space is the first header space or the second header space that is disposed on a most upstream side of the downwind heat-exchanging unit that is disposed on a downwind side. The outlet includes a first outlet and a second outlet. The first outlet communicates with any one of the upwind seventh space, the upwind eighth space, the upwind ninth space, and the upwind tenth space. The second outlet communicates with any other of the upwind seventh space, the upwind eighth space, the upwind ninth space, and the upwind tenth space. Of the upwind seventh space, the upwind eighth space, the upwind ninth space, and the upwind tenth space, each space that communicates with the first outlet or the second outlet corresponds to the upwind outlet-side space. Of the upwind seventh space, the upwind eighth space, the upwind ninth space, and the upwind tenth space, each other space corresponds to the upwind upstream-side space. The refrigerant flow path includes a first refrigerant flow path and a second refrigerant flow path. The first refrigerant flow path allows the downwind downstream-side space of the downwind heat-exchanging unit that is disposed on the upwind side and any one of the upwind upstream-side spaces to communicate with each other. The second refrigerant flow path allows the downwind downstream-side space of the downwind heat-exchanging unit that is disposed on the downwind side and another of the upwind upstream-side spaces to communicate with each other.

In the heat exchanger according to one or more embodiments of the present invention, a plurality of paths (refrigerant flow paths) are formed in the upwind heat-exchanging unit. That is, in the upwind heat-exchanging unit, a path that is formed by the upwind seventh space, the flat tubes, and the upwind ninth space and a path that is formed by the upwind eighth space, the flat tubes, and the upwind tenth space are formed. Therefore, when a flat-tube heat exchanger having three or more rows and including a plurality of downwind heat-exchanging units is used as condenser of a refrigerant, formation of a subcooling area of a refrigerant that flows through each downwind heat-exchanging unit in a corresponding path of the upwind heat-exchanging unit is facilitated. That is, disposition of the subcooling area mainly in the upwind heat-exchanging unit on the upwind side is facilitated. Therefore, in particular, in the flat-tube heat exchanger having three or more rows and including a plurality of downwind heat-exchanging units, regarding the refrigerant that flows through the downwind heat-exchanging units, the degree of subcooling is easily properly ensured.

By individually forming the refrigerant inlets (the first inlet and the second inlet) in each downwind heat-exchanging unit, when the heat exchanger is used as a condenser of a refrigerant, formation of the heat exchanger so that the superheating area and the subcooling area are not adjacent to each other one above another is facilitated. As a result, heat exchange between the refrigerant that passes through the superheating area and the refrigerant that passes through the subcooling area is further reduced. In relation to this, this further helps the degree of subcooling of the refrigerant in the subcooling area to be properly ensured. Therefore, a reduction in performance is further suppressed.

According to one or more embodiments, in each of the upwind heat-exchanging unit and the downwind heat-exchanging unit, when a gas refrigerant in a superheated state that has flown in from the first inlet or the second inlet exchanges heat with the air flow and flows out from the outlet as the liquid refrigerant in the subcooled state, a superheating area is formed. The superheating area is an area in which the gas refrigerant in the superheated state flows. A direction of flow of a refrigerant that flows through the superheating area of the upwind heat-exchanging unit is opposite to a direction of flow of a refrigerant that flows through the superheating area of the downwind heat-exchanging unit.

Therefore, the refrigerant in the superheating area of the upwind heat-exchanging unit and the refrigerant in the superheating area of the downwind heat-exchanging unit flow opposite to each other. As a result, in the air flow that has passed the upwind heat-exchanging unit and in the air flow that has passed the downwind heat-exchanging unit, the ratio of air that has sufficiently exchanged heat with the refrigerant to air that has not sufficiently exchanged heat with the refrigerant is maintained not to become significantly unbalanced regardless of portions where the air passes through. Therefore, temperature unevenness of air that has passed the heat exchanger is suppressed.

According to one or more embodiments, the subcooling area is positioned in a portion of the upwind heat-exchanging unit where a wind speed of the air flow that passes therethrough is lower than a wind speed of the air flow that passes another portion. Therefore, in an installed state, when the air flow passing through the heat exchanger that has passed has wind speed distribution, in a flat-tube heat exchanger in which the flow path through which the liquid refrigerant flows is formed at a portion where the wind speed is low, the air flow that has passed the superheating area is prevented from passing through the subcooling area, and a reduction in performance is suppressed.

According to one or more embodiments, in an installed state, the upwind heat-exchanging unit and the downwind heat-exchanging unit each include a first portion and a second portion. In the first portion, the flat tube extends in a first direction. In the second portion, the flat tube extends in a second direction. The second direction intersects the first direction. In the installed state, the first portion of the downwind heat-exchanging unit is disposed beside a downwind side of the first portion of the upwind heat-exchanging unit. In the installed state, the second portion of the downwind heat-exchanging unit is disposed beside a downwind side of the second portion of the upwind heat-exchanging unit.

Therefore, in a flat-tube heat exchanger in which a plurality of heat-exchanging units each including the first portion and the second portion extending in different directions is arranged side by side on the upwind side and on the downwind side, the air flow that has passed the superheating area is prevented from passing through the subcooling area, and a reduction in performance is suppressed.

A refrigeration apparatus according to one or more embodiments of the present invention includes the heat exchanger and a casing. The casing accommodates the heat exchanger. A connection pipe insertion port is formed in the casing. The connection pipe insertion port is an opening to which a refrigerant connection pipe is inserted. In the heat exchanger, the upwind heat-exchanging unit and the downwind heat-exchanging unit each include a third portion and a fourth portion. In the third portion, the flat tube extends in a third direction. In the fourth portion, the flat tube extends in a fourth direction. The fourth direction differs from the third direction. In the upwind heat-exchanging unit, one of the first header and the second header is positioned at a terminating end of the third portion. In the upwind heat-exchanging unit, another of the first header and the second header is positioned at a leading end of the fourth portion that is disposed apart from the terminating end of the third portion. In the downwind heat-exchanging unit, one of the first header and the second header is positioned at a terminating end of the third portion. In the downwind heat-exchanging unit, another of the first header and the second header is positioned at a leading end of the fourth portion that is disposed apart from the terminating end of the third portion. In each of the upwind heat-exchanging unit and the downwind heat-exchanging unit, the terminating end of the third portion is disposed closer than a leading end of the third portion to the connection pipe insertion port. In each of the upwind heat-exchanging unit and the downwind heat-exchanging unit, the leading end of the fourth portion is disposed closer than a terminating end of the fourth portion to the connection pipe insertion port.

Therefore, in the refrigeration apparatus including a flat-tube heat exchanger in which a plurality of heat-exchanging units each including the third portion and the fourth portion extending in different directions are arranged side by side on the upwind side and on the downwind side, a pipe inside the casing (for example, the refrigerant connection pipe that is connected to the inlet or the outlet of the heat exchanger, or the flow path formation portion) can be made short in length. As a result, the pipe inside the casing is easily routed. In relation to this, the refrigeration apparatus has improved workability, is assembled more easily, and is more compact.

When the heat exchanger according to one or more embodiments of the present invention is used as a condenser of a refrigerant, the air flow that has passed the superheating area is prevented from passing through the subcooling area. Therefore, in the subcooling area, temperature differences between the refrigerant and the air flow are easily properly ensured and cases in which heat exchange is not properly performed are decreased. That is, regarding the refrigerant that flows through the downwind heat-exchanging unit, the degree of subcooling is easily properly ensured. When the heat exchanger is used as a condenser of a refrigerant, the downwind heat-exchanging unit can be formed so that the superheating area and the subcooling area are not adjacent to each other one above another. As a result, heat exchange between the refrigerant that passes through the superheating area and the refrigerant that passes through the subcooling area is reduced. In relation to this, this helps the degree of subcooling of the refrigerant in the subcooling area to be properly ensured. Therefore, a reduction in performance is suppressed.

When the heat exchanger according to one or more embodiments of the present invention is used as a condenser of a refrigerant, in the path of the upwind heat-exchanging unit that is formed by the upwind third space, the flat tubes, and the upwind sixth space, formation of the subcooling area is facilitated regarding the refrigerant that flows through the downwind heat-exchanging unit. Thus, regarding the refrigerant that flows through the downwind heat-exchanging unit, the degree of subcooling is easily properly ensured. In addition, this further helps the degree of subcooling of the refrigerant in the subcooling area to be properly ensured. Therefore, a reduction in performance is further suppressed.

With regard to the heat exchanger according to one or more embodiments of the present invention, in particular, in the flat-tube heat exchanger having three or more rows and including the plurality of downwind heat-exchanging units, regarding the refrigerant that flows through the downwind heat-exchanging units, the degree of subcooling is easily properly ensured. In addition, this further helps the degree of subcooling of the refrigerant in the subcooling area to be properly ensured. Therefore, a reduction in performance is further suppressed.

The heat exchanger according to one or more embodiments of the present invention suppresses temperature unevenness of air that has passed the heat exchanger.

In the heat exchanger according to one or more embodiments of the present invention, in an installed state, when the air flow passing through the heat exchanger has wind speed distribution, in the flat-tube heat exchanger in which the flow path through which the liquid refrigerant flows is formed at a portion where the wind speed is low, a reduction in performance is suppressed.

With regard to the heat exchanger according to one or more embodiments of the present invention, in the flat-tube heat exchanger in which a plurality of heat-exchanging units each including the first portion and the second portion extending in different directions are arranged side by side on the upwind side and on the downwind side, a reduction in performance is suppressed.

The refrigeration apparatus according to one or more embodiments of the present invention has improved workability, is assembled more easily, and is more compact.

DETAILED DESCRIPTION

An indoor heat exchanger 25 (heat exchanger) and an air conditioner 100 (refrigeration apparatus) according to one or more embodiments of the present invention are described below with reference to the drawings. The embodiments below are specific examples of the present invention, do not limit the technical scope of the present invention, and can be modified as appropriate within a scope that does not depart from the spirit of the invention. In the embodiments below, directions, such as up, down, left, right, front, or rear, mean directions shown in FIGS. 2 to 6.

In the description below, unless otherwise noted, the term "gas refrigerant" encompasses not only a gas refrigerant in a saturated state or a superheated state, but also a refrigerant in a gas-liquid two-phase state, and the term "liquid refrigerant" encompasses not only a liquid refrigerant in a saturated state or a subcooled state, but also a refrigerant in a gas-liquid two-phase state.

(1) Air Conditioner 100

Figure 1:
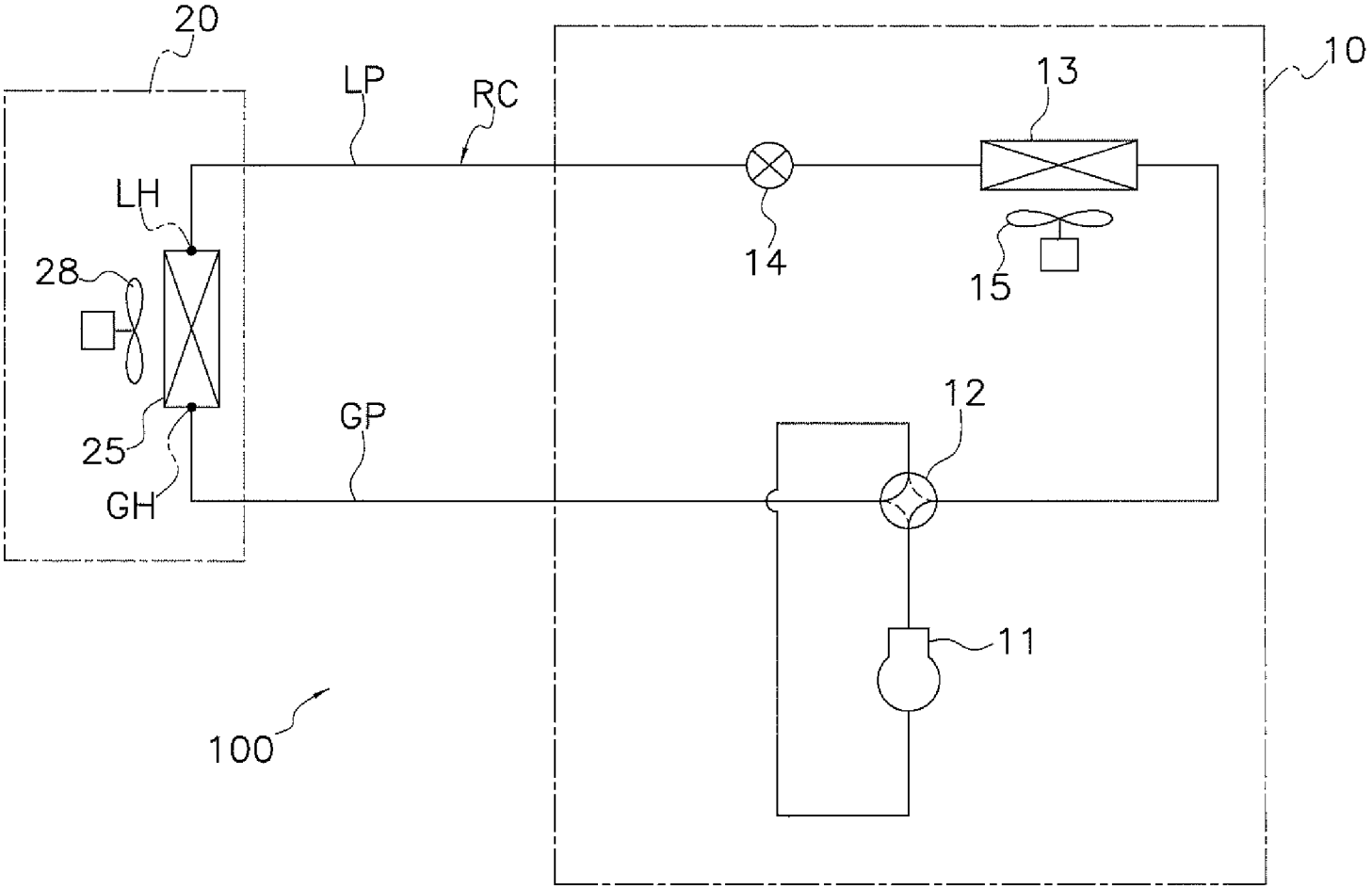
FIG. 1 is a schematic view of a configuration of an air conditioner according to one or more embodiments of the present invention.

FIG. 1 is a schematic view of a configuration of the air conditioner 100 including the indoor heat exchanger 25 according to one or more embodiments of the present invention.

The air conditioner 100 is a device that performs a cooling operation or a heating operation and that air-conditions a target space. Specifically, the air conditioner 100 includes a refrigerant circuit RC, and performs a vapor-compression-type refrigeration cycle. The air conditioner 100 primarily includes an outdoor unit 10 that serves as a heat source unit, and an indoor unit 20 that serves as a usage unit. In the air conditioner 100, the refrigerant circuit RC is formed by connecting the outdoor unit 10 and the indoor unit 20 by a gas-side connection pipe GP and a liquid-side connection pipe LP. A refrigerant that is sealed in the refrigerant circuit RC is not limited and, for example, a HFC refrigerant, such as R32 and R410A, is sealed in the refrigerant circuit RC.

(1-1) Outdoor Unit 10

The outdoor unit 10 is installed outdoors. The outdoor unit 10 primarily includes a compressor 11, a four-way switching valve 12, an outdoor heat exchanger 13, an expansion valve 14, and an outdoor fan 15.

The compressor 11 is a mechanism that sucks in a low-pressure gas refrigerant, compresses the gas refrigerant, and discharges the compressed gas refrigerant. During operation, the compressor 11 is controlled by an inverter to adjust the number of rotations in accordance with the situation.

The four-way switching valve 12 is a switching valve for switching the direction of flow of a refrigerant when switching between a cooling operation (normal cycle operation) and a heating operation (reverse cycle operation). The four-way switching valve 12 switches a state (refrigerant flow path) in accordance with an operating mode.

The outdoor heat exchanger 13 is a heat exchanger that functions as a condenser of a refrigerant when a cooling operation is performed and that functions as an evaporator of a refrigerant when a heating operation is performed. The outdoor heat exchanger 13 includes a plurality of heat transfer tubes and a plurality of heat transfer fins (not shown).

The expansion valve 14 is an electrically operated valve that decompresses a high-pressure refrigerant that flows therein. The expansion valve 14 adjusts as appropriate an opening degree thereof in accordance with an operation state.

The outdoor fan 15 is a fan that generates an outdoor air flow that flows out of the outdoor unit 10 after flowing into the outdoor unit 10 from the outside and passing the outdoor heat exchanger 13.

(1-2) Indoor Unit 20

The indoor unit 20 is installed indoors (more specifically, the target space where air-conditioning is performed). The indoor unit 20 primarily includes the indoor heat exchanger 25 and an indoor fan 28.

The indoor heat exchanger 25 (corresponding to "heat exchanger" in the claims) functions as an evaporator of a refrigerant when a cooling operation is performed and functions as a condenser of a refrigerant when a heating operation is performed. In the indoor heat exchanger 25, the gas-side connection pipe GP is connected to inlets/outlets of a gas refrigerant (gas-side inlets/outlets GH), and the liquid-side connection pipe LP is connected to inlets/outlets of a liquid refrigerant (liquid-side inlets/outlets LH). The indoor heat exchanger 25 is described in detail below.

The indoor fan 28 is a fan that generates air flow (indoor air flow AF; see, for example, FIGS. 3 to 5 and FIGS. 7 and 8) that flows out of the indoor unit 20 after flowing into the indoor unit 20 from the outside and passing the indoor heat exchanger 25. During operation, driving of the indoor fan 28 is controlled by a control unit (not shown) to adjust as appropriate the number of rotations.

(1-3) Gas-Side Connection Pipe GP, Liquid-Side Connection Pipe LP

The gas-side connection pipe GP and the liquid-side connection pipe LP are pipes that are installed at a construction site. The pipe diameter and the pipe length of each of the gas-side connection pipe GP and the liquid-side connection pipe LP are individually selected in accordance with design specifications and installation environments.

The gas-side connection pipe GP (corresponding to "refrigerant connection pipe" in the claims) is a pipe primarily for allowing passage of a gas refrigerant between the outdoor unit 10 and the indoor unit 20. The gas-side connection pipe GP branches into a first gas-side connection pipe GP1 and a second gas-side connection pipe GP2 on a side of the indoor unit 20 (see, for example, FIGS. 6 and 9).

The liquid-side connection pipe LP (corresponding to "refrigerant connection pipe" in the claims) is a pipe primarily for allowing passage of a liquid refrigerant between the outdoor unit 10 and the indoor unit 20. The liquid-side connection pipe LP branches into a first liquid-side connection pipe LP1 and a second liquid-side connection pipe LP2 on the side of the indoor unit 20 (see, for example, FIGS. 5 and 6).

(2) Flow of Refrigerant in Air Conditioner 100

In the air conditioner 100, when a cooling operation (normal cycle operation) is performed or a heating operation (reverse cycle operation) is performed, a refrigerant circulates in the refrigerant circuit RC so as to flow as indicated below.

(2-1) When Cooling Operation is Performed

When a cooling operation is performed, the state of the four-way switching valve 12 becomes a state indicated by a solid line in FIG. 1, a discharge side of the compressor 11 communicates with a gas side of the outdoor heat exchanger 13, and an intake side of the compressor 11 communicates with a gas side of the indoor heat exchanger 25.

When the compressor 11 is driven in such a state, a low-pressure gas refrigerant is compressed by the compressor 11 and becomes a high-pressure gas refrigerant. The high-pressure gas refrigerant is sent to the outdoor heat exchanger 13 via the four-way switching valve 12. Then, at the outdoor heat exchanger 13, the high-pressure gas refrigerant exchanges heat with an outdoor air flow and is thereby condensed to become a high-pressure liquid refrigerant (liquid refrigerant in a subcooled state). The high-pressure liquid refrigerant that has flown out from the outdoor heat exchanger 13 is sent to the expansion valve 14. A low-pressure refrigerant obtained by decompressing the high-pressure liquid refrigerant at the expansion valve 14 flows through the liquid-side connection pipe LP and flows into the indoor heat exchanger 25 from the liquid-side inlet/outlet LH. The refrigerant that has flown into the indoor heat exchanger 25 exchanges heat with the indoor air flow AF and thereby evaporates and becomes a low-pressure gas refrigerant (gas refrigerant in a superheated state). The low-pressure gas refrigerant flows out from the indoor heat exchanger 25 via the gas-side inlet/outlet GH. The refrigerant that has flown out from the indoor heat exchanger 25 flows through the gas-side connection pipe GP and is sucked into the compressor 11.

(2-2) When Heating Operation is Performed

When a heating operation is performed, the state of the four-way switching valve 12 becomes a state indicated by a broken line in FIG. 1, the discharge side of the compressor 11 communicates with the gas side of the indoor heat exchanger 25, and the intake side of the compressor 11 communicates with the gas side of the outdoor heat exchanger 13.

When the compressor 11 is driven in such a state, a low-pressure gas refrigerant is compressed by the compressor 11 and becomes a high-pressure gas refrigerant. The high-pressure gas refrigerant is sent to the indoor heat exchanger 25 via the four-way switching valve 12 and the gas-side connection pipe GP. The high-pressure gas refrigerant that has been sent to the indoor heat exchanger 25 flows into the indoor heat exchanger 25 via the gas-side inlet/outlet GH and exchanges heat with the indoor air flow AF and is thereby condensed to become a high-pressure liquid refrigerant (liquid refrigerant in a subcooled state). Then, the high-pressure liquid refrigerant flows out from the indoor heat exchanger 25 via the liquid-side inlet/outlet LH (corresponding to "outlet" in the claims). The refrigerant that has flown out from the indoor heat exchanger 25 is sent to the expansion valve 14 via the liquid-side connection pipe LP. The high-pressure gas refrigerant that has been sent to the expansion valve 14 is decompressed in accordance with the valve opening degree of the expansion valve 14 when the gas refrigerant passes through the expansion valve 14. A low-pressure refrigerant obtained by the passage of the high-pressure gas refrigerant through the expansion valve 14 flows into the outdoor heat exchanger 13. The low-pressure refrigerant that has flown into the outdoor heat exchanger 13 exchanges heat with an outdoor air flow, evaporates, becomes a low-pressure gas refrigerant, and is sucked into the compressor 11 via the four-way switching valve 12.

(3) Details of Indoor Unit 20

Figure 2:
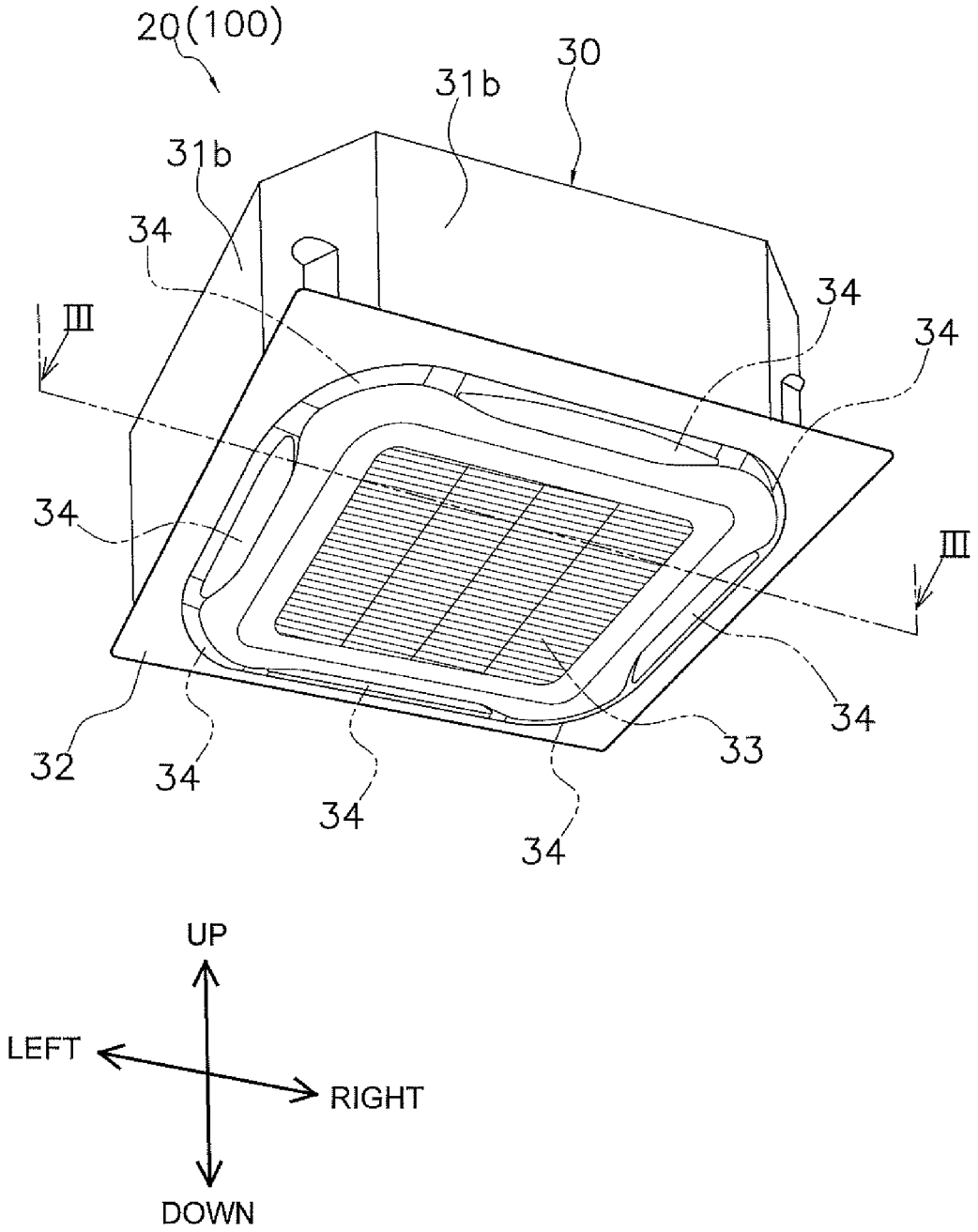
FIG. 2 is a perspective view of an indoor unit.
Figure 3:
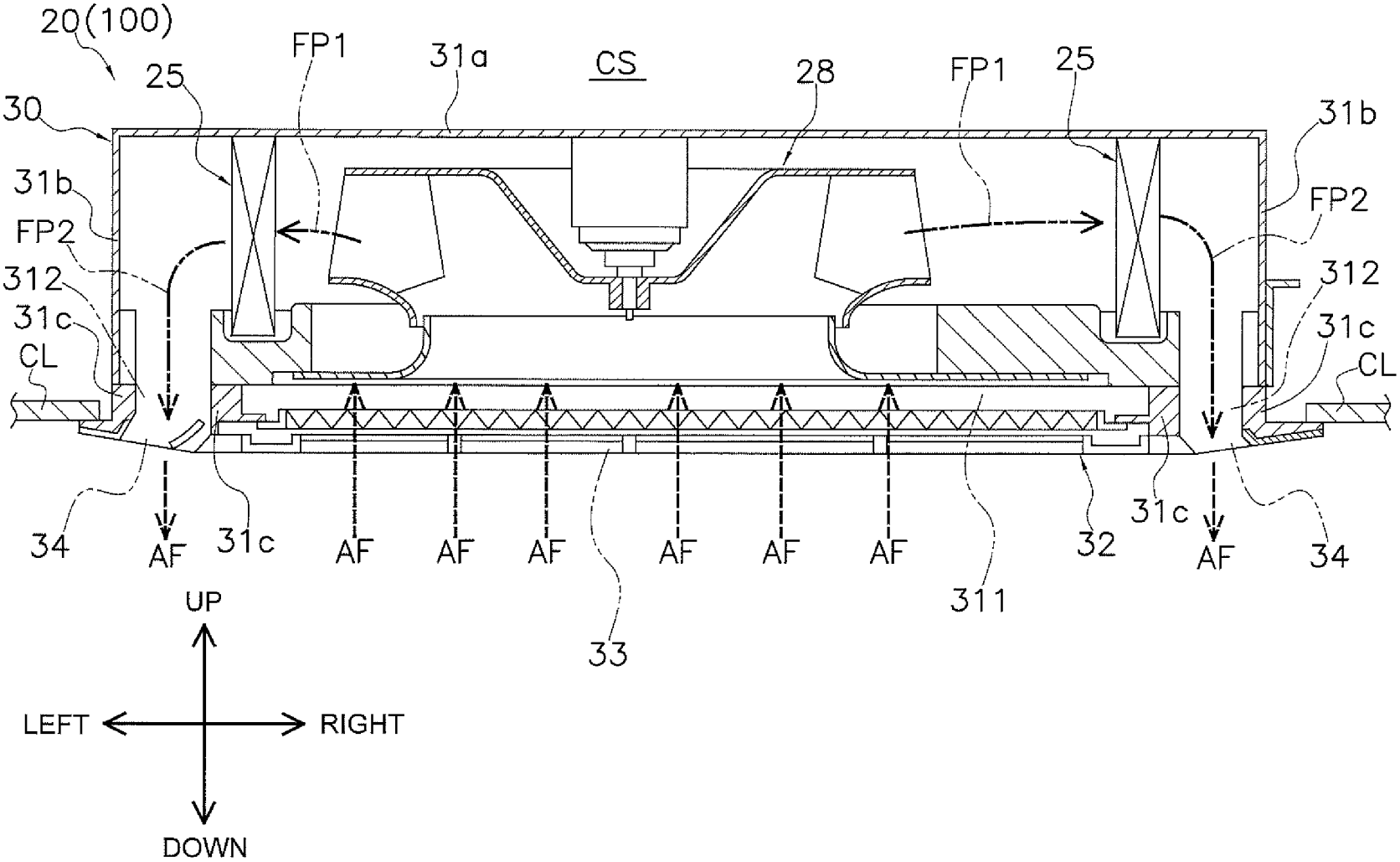
FIG. 3 is a schematic view of a section along line III-III in FIG. 2.
Figure 4:
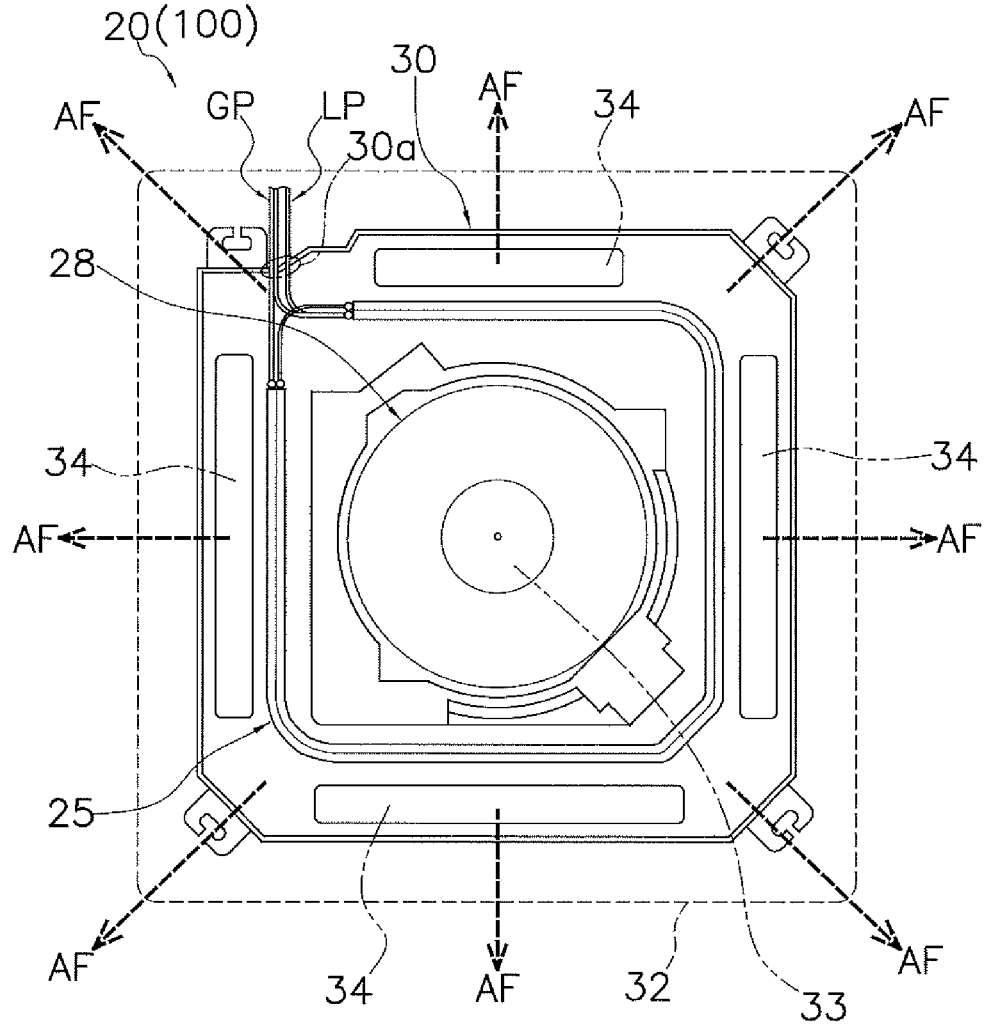
FIG. 4 is a schematic view schematically showing a configuration of the indoor unit when viewed from a lower surface.
Figure 4:
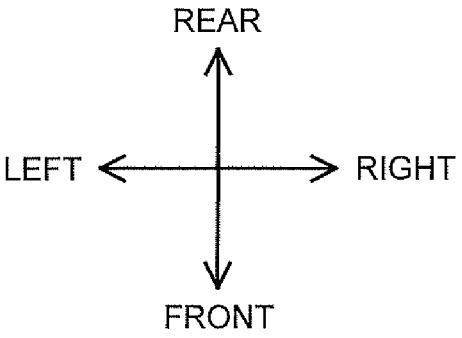

FIG. 2 is a perspective view of the indoor unit 20. FIG. 3 is a schematic view of a section along line III-III in FIG. 2. FIG. 4 is a schematic view schematically showing a configuration of the indoor unit 20 when viewed from a lower surface.

The indoor unit 20 is a so-called ceiling-embedded-type air-conditioning indoor unit, and is installed on a ceiling of the target space. The indoor unit 20 includes a casing 30 that forms the outer contour.

The casing 30 accommodates devices, such as the indoor heat exchanger 25 and the indoor fan 28. As shown in FIG. 3, the casing 30 is installed in a ceiling rear space CS via an opening formed in a ceiling surface CL of the target space, the ceiling rear space CS being formed between the ceiling surface CL and an upper-floor floor surface or a roof. The casing 30 includes a top panel 31*a*, side plates 31*b*, and a bottom plate 31*c*, and a decorative panel 32.

The top panel 31*a* is a member that constitutes a top-surface portion of the casing 30, and has a substantially octagonal shape in which long sides and short sides are alternately and continuously formed.

The side plates 31*b* are members that constitute side-surface portions of the casing 30, and include surface portions that correspond in a one-to-one ratio with the long sides and the short sides of the top panel 31*a*. An opening (connection pipe insertion port) 30*a* for inserting (bringing) the gas-side connection pipe GP and the liquid-side connection pipe LP into the casing is formed in the side plate 31*b* (see alternate long and short dashed line of FIG. 4).

The bottom plate 31*c* is a member that constitutes a bottom-surface portion of the casing 30. A large substantially square opening 311 is formed in the center of the bottom plate 31*c*, and a plurality of openings 312 are formed around the large opening 311. A lower surface side (target space side) of the bottom plate 31*c* is attached to the decorative panel 32.

The decorative panel 32 is a plate-shaped member that is exposed at the target space, and has a substantially square shape in plan view. The decorative panel 32 is fitted into and installed in the opening of the ceiling surface CL. An intake port 33 and blow-out ports 34 for the indoor air flow AF are formed in the decorative panel 32. The intake port 33 that is large and that has a substantially square shape is formed in a central portion of the decorative panel 32 and at a position where the intake port 33 overlaps the large opening 311 of the bottom plate 31*c* in plan view. The blow-out ports 34 are formed in the vicinity of the intake port 33 so as to surround the intake port 33.

An intake flow path FP1 for guiding the indoor air flow AF that has flown into the casing 30 via the intake port 33 to the indoor heat exchanger 25 and a blow-out flow path FP2 for sending the indoor air flow AF that has passed the indoor heat exchanger 25 to the blow-out ports 34 are formed in a space inside the casing 30. The blow-out flow path FP2 is disposed so as to surround the intake flow path FP1 on an outer side of the intake flow path FP1.

Inside the casing 30, the indoor fan 28 is disposed at a central portion thereof, and the indoor heat exchanger 25 is disposed so as to surround the indoor fan 28. In plan view, the indoor fan 28 overlaps the intake port 33. In plan view, the indoor heat exchanger 25 has a substantially square shape, and is disposed so as to surround the intake port 33 and so as to be surrounded by the blow-out ports 34.

In the indoor unit 20, in the above-described mode, the intake port 33, the blow-out ports 34, the intake flow path FP1, and the blow-out flow path FP2 are formed, and the indoor heat exchanger 25 and the indoor fan 28 are arranged. Therefore, during operation, the indoor air flow AF generated by the indoor fan 28 flows into the casing 30 via the intake port 33, is guided to the indoor heat exchanger 25 via the intake flow path FP1, and exchanges heat with a refrigerant inside the indoor heat exchanger 25, after which the indoor air flow AF is sent to the blow-out ports 34 via the blow-out flow path FP2, and is blown out to the target space from the blow-out ports 34.

In the description below, the direction in which the indoor air flow AF flows when the indoor air flow AF passes the indoor heat exchanger 25 is called "air flow direction dr3". In one or more embodiments, the air flow direction dr3 corresponds to a horizontal direction.

(4) Details of Indoor Heat Exchanger 25

(4-1) Configuration of Indoor Heat Exchanger 25

Figure 5:
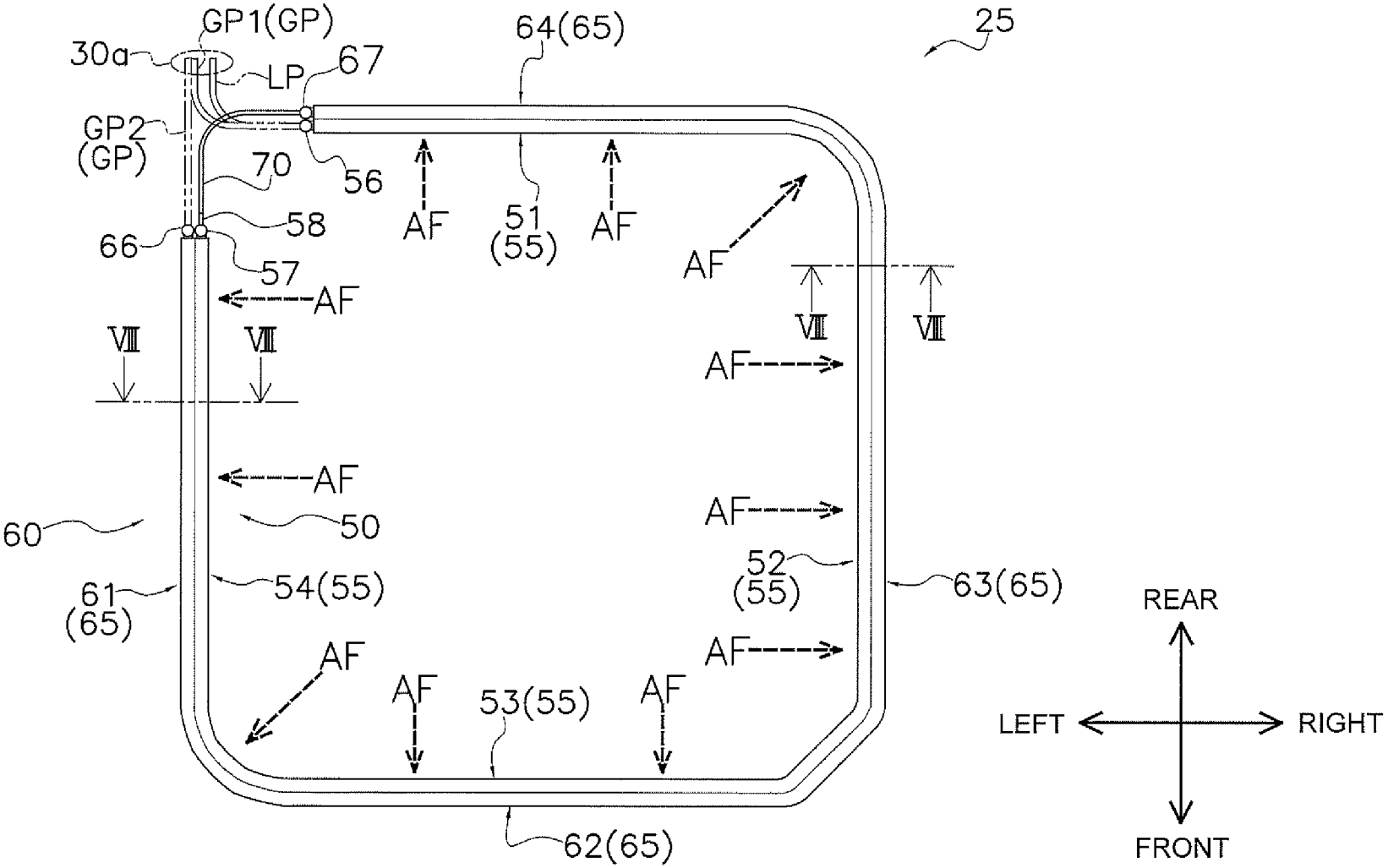
FIG. 5 is a schematic view schematically showing an indoor heat exchanger according to one or more embodiments of the present invention when viewed in a heat-transfer-tube lamination direction.
Figure 6:
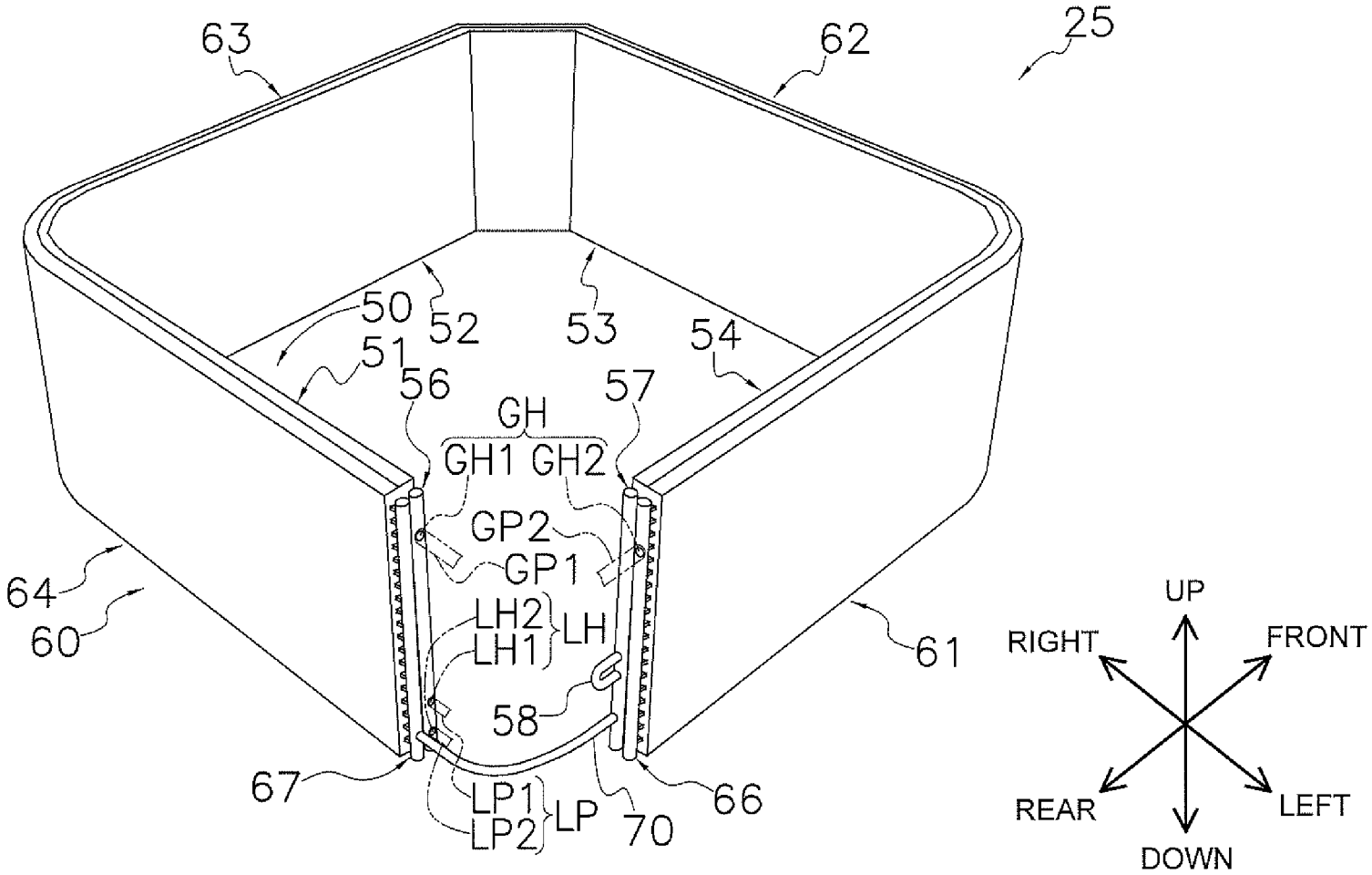
FIG. 6 is a perspective view of the indoor heat exchanger.
Figure 7:
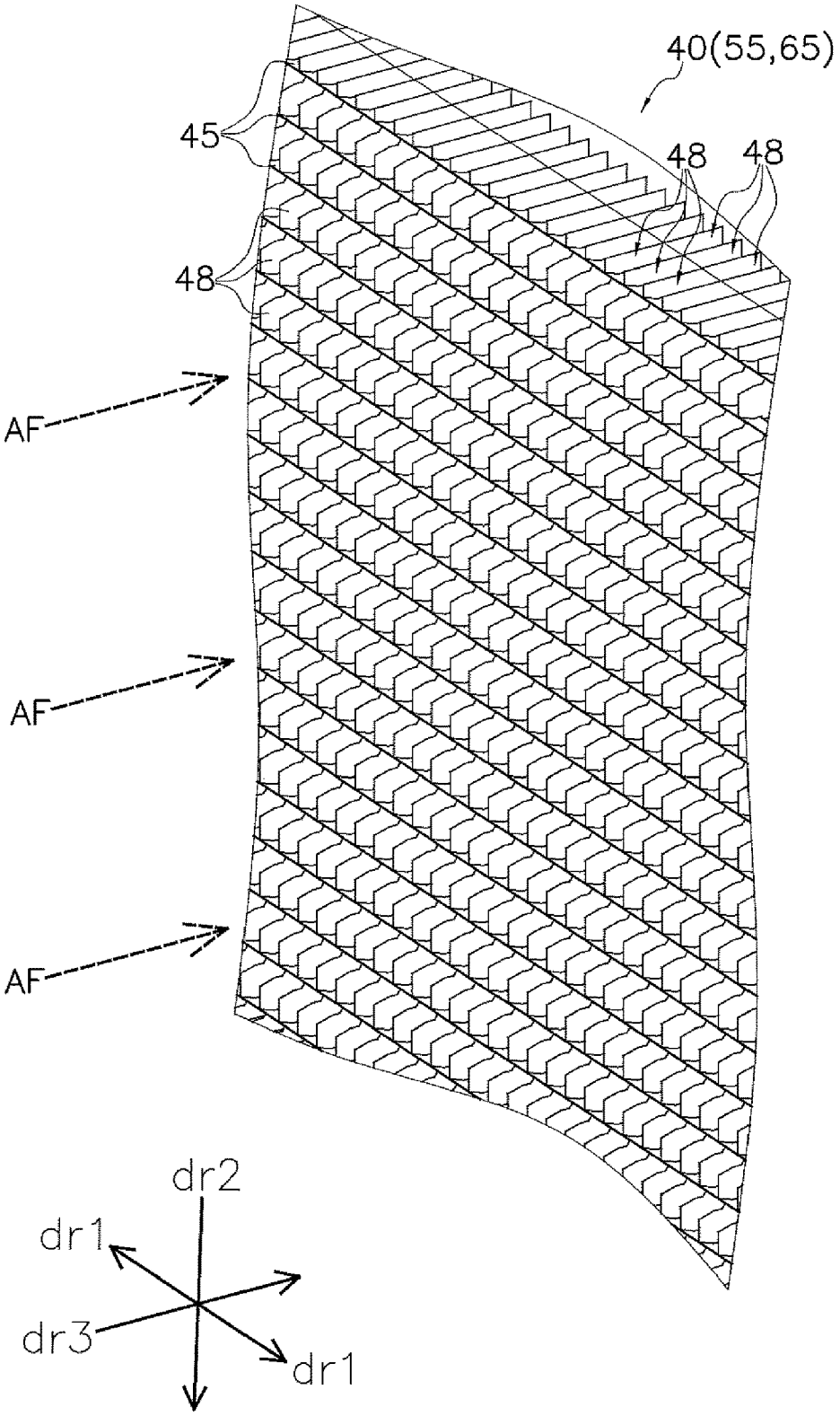
FIG. 7 is a perspective view showing a part of a heat-exchanging unit.
Figure 8:
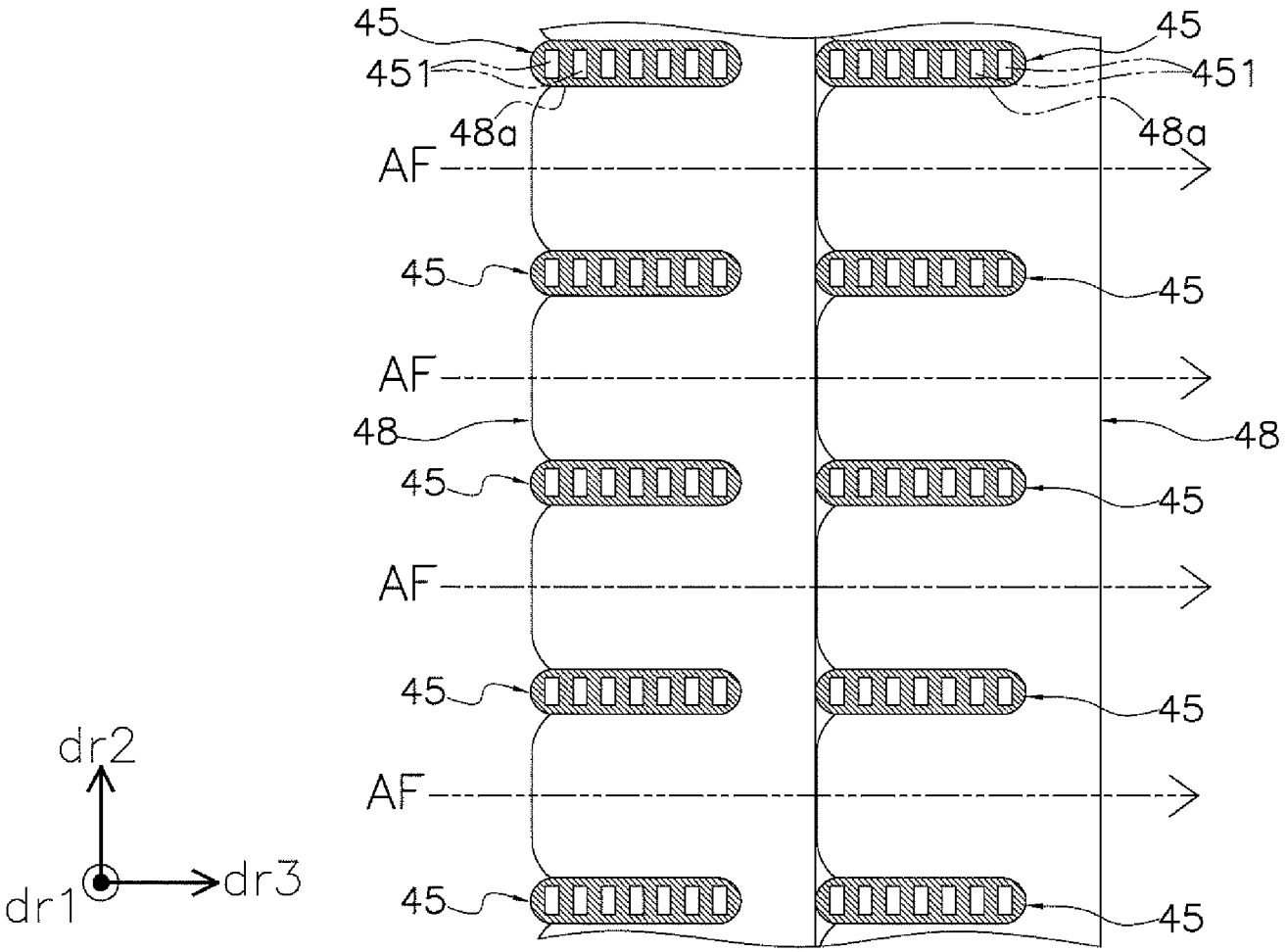
FIG. 8 is a schematic view of a section along line VIII-VIII in FIG. 5.

FIG. 5 is a schematic view schematically showing the indoor heat exchanger 25 when viewed in a heat-transfer-tube lamination direction dr2. FIG. 6 is a perspective view of the indoor heat exchanger 25. FIG. 7 is a perspective view showing a part of a heat-exchange surface 40. FIG. 8 is a schematic view of a section along line VIII-VIII in FIG. 5.

As described above, the indoor heat exchanger 25 allows a refrigerant to flow in or flow out via the gas-side inlets/outlets GH and the liquid-side inlets/outlets LH. When a heating operation is performed (that is, when the indoor heat exchanger 25 is used as a condenser), the gas-side inlets/outlets GH functions as inlets of a refrigerant (primarily, a gas refrigerant in a superheated state), and the liquid-side inlets/outlets LH functions as outlets of a refrigerant (primarily, a liquid refrigerant in a subcooled state).

In the indoor heat exchanger 25, when a heating operation is performed, superheating areas (SH3 and SH4 shown in FIGS. 15 and 16) that are areas where a refrigerant in a superheated state flows and subcooling areas (SC1 and SC2 shown in FIGS. 15 and 16) that are areas where a refrigerant in a subcooled state flows are formed.

A plurality of gas-side inlets/outlets GH (here, two gas-side inlets/outlets GH) and a plurality of liquid-side inlets/outlets LH (here, two liquid-side inlets/outlets LH) are formed in the indoor heat exchanger 25. Specifically, in the indoor heat exchanger 25, a first gas-side inlet/outlet GH1 (corresponding to "first inlet" in the claims) and a second gas-side inlet/outlet GH2 (corresponding to "second inlet" in the claims) are formed as the gas-side inlets/outlets GH. In addition, in the indoor heat exchanger 25, a first liquid-side inlet/outlet LH1 (corresponding to "first outlet" in the claims) and a second liquid-side inlet/outlet LH2 (corresponding to "second outlet" in the claims) are formed as the liquid-side inlets/outlets LH. The first gas-side inlet/outlet GH1 and the second gas-side inlet/outlet GH2 are positioned above the first liquid-side inlet/outlet LH1 and the second liquid-side inlet/outlet LH2.

The indoor heat exchanger 25 includes heat-exchange surface 40, which is provided for exchanging heat with the indoor air flow AF, each on an upwind side and on a downwind side of the indoor air flow AF. The indoor heat exchanger 25 is such that each heat-exchange surface 40 includes a plurality of heat transfer tubes 45 (here, 19 heat transfer tubes 45) (see, for example, FIGS. 7 and 8), where a refrigerant flows, and a plurality of heat transfer fins 48 (see, for example, FIGS. 7 and 8) that facilitate heat exchange between the refrigerant and the indoor air flow AF.

Each heat transfer tube 45 is arranged so as to extend in a predetermined heat-transfer-tube extension direction dr1 (here, a horizontal direction), and is laminated so as to be disposed apart from each other in the predetermined heat-transfer-tube lamination direction dr2 (here, a vertical direction). The heat-transfer-tube extension direction dr1 is a direction intersecting the heat-transfer-tube lamination direction dr2 and the air flow direction dr3, and, in plan view, corresponds to a direction in which the heat-exchange surface 40 including the heat transfer tubes 45 extend. The heat-transfer-tube lamination direction dr2 is a direction intersecting the heat-transfer-tube extension direction dr1 and the air flow direction dr3. In one or more embodiments, since the indoor heat exchanger 25 includes the heat-exchange surface 40 each on the upwind side and on the downwind side, in the indoor heat exchanger 25, the heat transfer tubes 45 that are arranged side by side in two rows in the air flow direction dr3 are laminated in a plurality of layers in the heat-transfer-tube lamination direction dr2. The number, the number of rows, and the number of layers of the heat transfer tubes 45 that are included at the heat-exchange surface 40 can be changed as appropriate in accordance with design specifications.

Each heat transfer tube 45 is a flat tube whose section has a flat shape and that is made of aluminum or an aluminum alloy (that is, the heat transfer tubes 45 correspond to "flat tubes" in the claims). More specifically, each heat transfer tube 45 is a flat perforated tube (see FIG. 8) in which a plurality of refrigerant flow paths (heat-transfer-tube flow paths 451) extending in the heat-transfer-tube extension direction dr1 are formed therein. The plurality of heat-transfer-tube flow paths 451 are arranged side by side in the air flow direction dr3 in each heat transfer tube 45.

The heat transfer fins 48 are plate-shaped members that increase the heat transfer area between the heat transfer tubes 45 and the indoor air flow AF. Each heat transfer fin 48 is made of aluminum or an aluminum alloy. A longitudinal direction of the heat transfer fins 48 extends in the heat-transfer-tube lamination direction dr2 so as to intersect the heat transfer tubes 45. A plurality of slits 48*a* are formed side by side and apart from each other in the heat-transfer-tube lamination direction dr2 in the heat transfer fins 48, and the heat transfer tubes 45 are inserted into the respective slits 48*a* (see FIG. 8).

At the heat-exchange surface 40, each heat transfer fin 48 is arranged side by side and apart from each other in the heat-transfer-tube extension direction dr1 along with other heat transfer fins 48. In one or more embodiments, since the indoor heat exchanger 25 includes the heat-exchange surface 40 each on the upwind side and on the downwind side, in the indoor heat exchanger 25, the heat transfer fins 48 extending in the heat-transfer-tube lamination direction dr2 are arranged in two rows in the air flow direction dr3 and side by side in the heat-transfer-tube extension direction dr1. The number of heat transfer fins 48 that are included at the heat-exchange surface 40 is selected in accordance with the length of each heat transfer tube 45 in the heat-transfer-tube extension direction dr1, and can be selected and changed as appropriate in accordance with design specifications.

Figure 9:
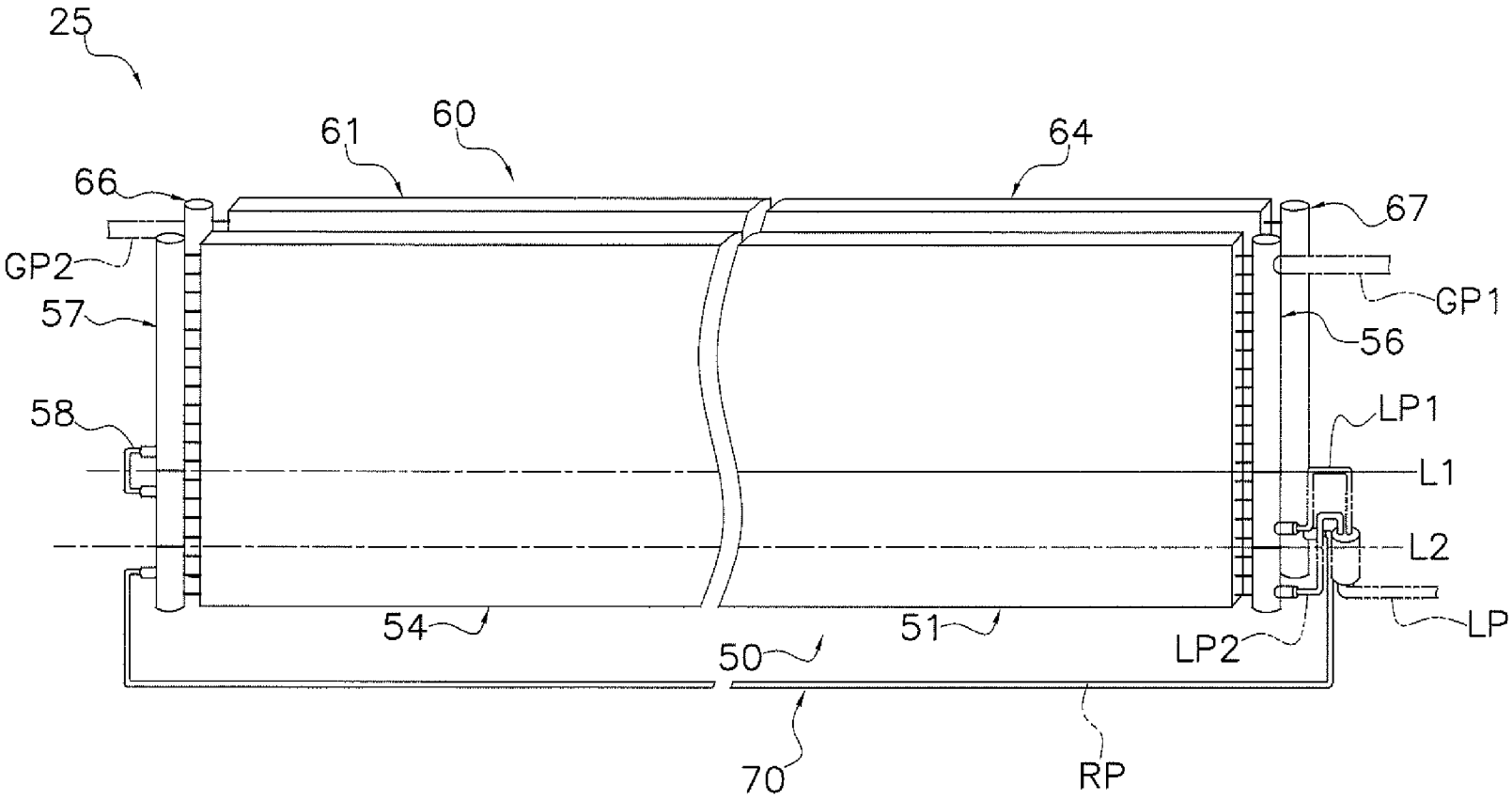
FIG. 9 is a schematic view schematically showing a mode of construction of the indoor heat exchanger.

FIG. 9 is a schematic view schematically showing a mode of construction of the indoor heat exchanger 25. The indoor heat exchanger 25 primarily includes an upwind heat-exchanging unit 50 including the heat-exchange surface 40 that is disposed on the upwind side, a downwind heat-exchanging unit 60 including the heat-exchange surface 40 that is disposed on the downwind side, and a connection pipe 70 that connects the upwind heat-exchanging unit 50 and the downwind heat-exchanging unit 60 to each other. When viewed in the air flow direction dr3, the upwind heat-exchanging unit 50 is disposed on the upwind side of the downwind heat-exchanging unit 60 (that is, the downwind heat-exchanging unit 60 is disposed on the downwind side of the upwind heat-exchanging unit 50).

(4-1-1) Upwind Heat-Exchanging Unit 50

Figure 10:
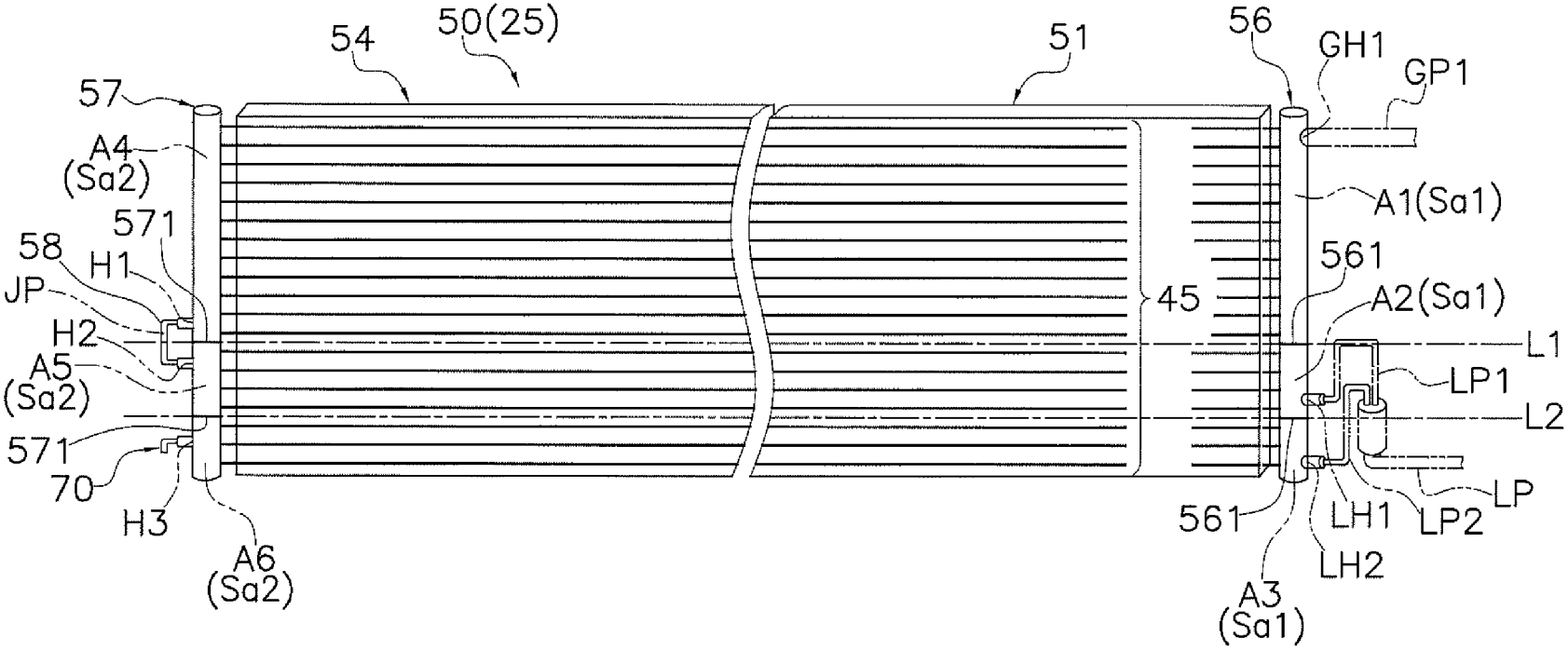
FIG. 10 is a schematic view schematically showing a mode of construction of an upwind heat-exchanging unit.

FIG. 10 is a schematic view schematically showing a mode of construction of the upwind heat-exchanging unit 50. The upwind heat-exchanging unit 50 primarily includes, as the heat-exchange surface 40, an upwind first heat-exchange surface 51, an upwind second heat-exchange surface 52, an upwind third heat-exchange surface 53, and an upwind fourth heat-exchange surface 54 (these are collectively referred to as "upwind heat-exchange surface 55" below); an upwind first header 56; an upwind second header 57; and a turn-around pipe 58. With regard to a wind speed distribution of the indoor air flow AF that passes the upwind heat-exchanging unit 50 in an installed state, the wind speed on a lower layer side is less than the wind speed on an upper layer side. Specifically, the wind speed of the indoor air flow AF that passes a portion of the upwind heat-exchanging unit 50 that is below an alternate long and short dashed line L1 (see FIG. 10) is less than the wind speed of the indoor air flow AF that passes a portion above the alternate long and short dashed line L1.

(4-1-1-1) Upwind Heat-Exchange Surface 55

In the upwind heat-exchange surface 55, the upwind first heat-exchange surface 51 (corresponding to "first portion" or "third portion" in the claims) is positioned on a most downstream side of a flow of a refrigerant when a cooling operation is performed, and is positioned on a most upstream side of a flow of a refrigerant when a heating operation is performed. In the upwind heat-exchange surface 55, when viewed in the heat-transfer-tube lamination direction dr2 (here, in plan view), the upwind first heat-exchange surface 51 has its terminating end connected to the upwind first header 56, and primarily extends from the left towards the right. The upwind first heat-exchange surface 51 is positioned closer than the upwind second heat-exchange surface 52 and the upwind third heat-exchange surface 53 to the connection pipe insertion port 30*a*. More specifically, the terminating end of the upwind first heat-exchange surface 51 is positioned closer than a leading end of the upwind first heat-exchange surface 51 to the connection pipe insertion port 30*a*.

In the upwind heat-exchange surface 55, the upwind second heat-exchange surface 52 (corresponding to "second portion" in the claims) is positioned on an upstream side of a flow of a refrigerant at the upwind first heat-exchange surface 51 when a cooling operation is performed, and is positioned on a downstream side of a flow of a refrigerant at the upwind first heat-exchange surface 51 when a heating operation is performed. When viewed in the heat-transfer-tube lamination direction dr2, the upwind second heat-exchange surface 52 is connected to the leading end of the upwind first heat-exchange surface 51 while a terminating end of the upwind second heat-exchange surface 52 is curved, and primarily extends from the rear towards the front.

In the upwind heat-exchange surface 55, the upwind third heat-exchange surface 53 is positioned on an upstream side of a flow of a refrigerant at the upwind second heat-exchange surface 52 when a cooling operation is performed, and is positioned on a downstream side of a flow of a refrigerant at the upwind second heat-exchange surface 52 when a heating operation is performed. When viewed in the heat-transfer-tube lamination direction dr2, the upwind third heat-exchange surface 53 is connected to a leading end of the upwind second heat-exchange surface 52 while a terminating end of the upwind third heat-exchange surface 53 is curved, and primarily extends from the right towards the left.

In the upwind heat-exchange surface 55, the upwind fourth heat-exchange surface 54 (corresponding to "fourth portion" in the claims) is positioned on an upstream side of a flow of a refrigerant at the upwind third heat-exchange surface 53 when a cooling operation is performed, and is positioned on a downstream side of a flow of a refrigerant at the upwind third heat-exchange surface 53 when a heating operation is performed. When viewed in the heat-transfer-tube lamination direction dr2, the upwind fourth heat-exchange surface 54 is connected to a leading end of the upwind third heat-exchange surface 53 while a terminating end of the upwind fourth heat-exchange surface 54 is curved, and primarily extends from the front towards the rear. A leading end of the upwind fourth heat-exchange surface 54 is connected to the upwind second header 57. The upwind fourth heat-exchange surface 54 is positioned closer than the upwind second heat-exchange surface 52 and the upwind third heat-exchange surface 53 to the connection pipe insertion port 30*a*. More specifically, the leading end of the upwind fourth heat-exchange surface 54 is positioned closer than the terminating end of the upwind fourth heat-exchange surface 54 to the connection pipe insertion port 30*a*.

By including such an upwind first heat-exchange surface 51, upwind second heat-exchange surface 52, upwind third heat-exchange surface 53, and upwind fourth heat-exchange surface 54, when viewed in the heat-transfer-tube lamination direction dr2, the upwind heat-exchange surface 55 of the upwind heat-exchanging unit 50 is bent or curved at three or more locations and form a substantially square shape. That is, the upwind heat-exchanging unit 50 includes the upwind heat-exchange surface 55 having four faces.

(4-1-1-2) Upwind First Header 56

The upwind first header 56 (corresponding to "first header" in the claims) is a header collecting pipe that functions as, for example, a dividing header that divides a refrigerant to pass through each heat transfer tube 45, a merging header that merges the refrigerants that flow out from the respective heat transfer tubes 45, or a turn-around header for allowing the refrigerants that flow out from the respective heat transfer tubes 45 to turn around to other heat transfer tubes 45. In an installed state, a longitudinal direction of the upwind first header 56 is a vertical direction (up-down direction).

The upwind first header 56 is formed in a cylindrical shape, and space is formed in the upwind first header 56 (hereunder called "upwind first-header space Sa1" corresponding to "first-header space" in the claims). The upwind first header 56 is connected to the terminating end of the upwind first heat-exchange surface 51. The upwind first header 56 is connected to one end of each heat transfer tube 45 that is included at the upwind first heat-exchange surface 51, and allows the heat transfer tubes 45 and the upwind first-header space Sa1 to communicate with each other.

A plurality of horizontal partition plates 561 (here, two horizontal partition plates 561) are arranged inside the upwind first header 56, and partition the upwind first-header space Sa1 (here, the upwind first-header space Sa1 is partitioned into three spaces of; specifically, an upwind first space A1, an upwind second space A2, and an upwind third space A3) in the heat-transfer-tube lamination direction dr2. In other words, the upwind first space A1, the upwind second space A2, and the upwind third space A3 are formed side by side in the up-down direction in the upwind first header 56.

The upwind first space A1 is disposed at an uppermost layer of the upwind first-header space Sa1. The upwind second space A2 is disposed at an intermediate layer (a layer that is lower than the upwind first space A1 and that is higher than the upwind third space A3) of the upwind first-header space Sa1. The upwind third space A3 is disposed at a lowermost layer of the upwind first-header space Sa1.

The first gas-side inlet/outlet GH1 is formed in the upwind first header 56. The first gas-side inlet/outlet GH1 communicates with the upwind first space A1. The first gas-side connection pipe GP1 is connected to the first gas-side inlet/outlet GH1.

The first liquid-side inlet/outlet LH1 and the second liquid-side inlet/outlet LH2 are formed in the upwind first header 56. The first liquid-side inlet/outlet LH1 communicates with the upwind second space A2. The first liquid-side connection pipe LP1 is connected to the first liquid-side inlet/outlet LH1. The second liquid-side inlet/outlet LH2 communicates with the upwind third space A3. The second liquid-side connection pipe LP2 is connected to the second liquid-side inlet/outlet LH2. The upwind third space A3 that communicates with the liquid-side inlet/outlet LH corresponds to "upwind outlet-side space" in the claims.

(4-1-1-3) Upwind Second Header 57

The upwind second header 57 (corresponding to "second header" in the claims) is a header collecting pipe that functions as, for example, a dividing header that divides a refrigerant to pass through each heat transfer tube 45, a merging header that merges the refrigerants that flow out from the respective heat transfer tubes 45, or a turn-around header for allowing the refrigerants that flow out from the respective heat transfer tubes 45 to turn around to other heat transfer tubes 45. In an installed state, a longitudinal direction of the upwind second header 57 is a vertical direction (up-down direction).

The upwind second header 57 is formed in a cylindrical shape, and space is formed in the upwind second header 57 (hereunder called "upwind second-header space Sa2" corresponding to "second-header space" in the claims). The upwind second header 57 is connected to the leading end of the upwind fourth heat-exchange surface 54. The upwind second header 57 is connected to one end of each heat transfer tube 45 that is included at the upwind fourth heat-exchange surface 54, and allows the heat transfer tubes 45 and the upwind second-header space Sa2 to communicate with each other.

A plurality of horizontal partition plates 571 (here, two horizontal partition plates 571) are arranged inside the upwind second header 57, and partition the upwind second-header space Sa2 (here, the upwind second-header space Sa2 is partitioned into three spaces of; specifically, an upwind fourth space A4, an upwind fifth space A5, and an upwind sixth space A6) in the heat-transfer-tube lamination direction dr2. In other words, the upwind fourth space A4, the upwind fifth space A5, and the upwind sixth space A6 are formed side by side in the up-down direction in the upwind second header 57.

The upwind fourth space A4 is disposed at an uppermost layer of the upwind second-header space Sa2. The upwind fourth space A4 communicates with the upwind first space A1 via the heat transfer tubes 45.

The upwind fifth space A5 is disposed at an intermediate layer (a layer that is lower than the upwind fourth space A4 and that is higher than the upwind sixth space A6) of the upwind second-header space Sa2. The upwind fifth space A5 communicates with the upwind second space A2 via the heat transfer tubes 45. The upwind fifth space A5 communicates with the upwind fourth space A4 via the turn-around pipe 58.

The upwind sixth space A6 is disposed at a lowermost layer of the upwind second-header space Sa2. The upwind sixth space A6 communicates with the upwind third space A3 via the heat transfer tubes 45.

A first connection hole H1 for connecting one end of the turn-around pipe 58 is formed in the upwind second header 57. The first connection hole H1 communicates with the upwind fourth space A4.

A second connection hole H2 for connecting the other end of the turn-around pipe 58 is formed in the upwind second header 57. The second connection hole H2 communicates with the upwind fifth space A5.

A third connection hole H3 for connecting one end of the connection pipe 70 is formed in the upwind second header 57. The third connection hole H3 communicates with the upwind sixth space A6. The one end of the connection pipe 70 is connected to the third connection hole H3 so that the upwind sixth space A6 and a downwind second-header space Sb2 (described later) communicate with each other. The upwind sixth space A6 that communicates with the connection pipe 70 corresponds to "upwind upstream-side space" in the claims.

(4-1-1-4) Turn-Around Pipe 58

The turn-around pipe 58 (corresponding to "communication path formation portion" in the claims) is a pipe for forming a turn-around flow path JP (corresponding to "communication path" in the claims) that allows a refrigerant that has passed through the heat transfer tubes 45 and flown into any one of the spaces (here, the upwind fourth space A4 or the upwind fifth space A5) of the upwind second-header space Sa2 of the upwind second header 57 to turn around and flow into the other of the spaces (here, the upwind fifth space A5 or the upwind fourth space A4) of the upwind second-header space Sa2. In one or more embodiments, the one end of the turn-around pipe 58 is connected to the upwind second header 57 so as to communicate with the upwind fourth space A4, and the other end of the turn-around pipe 58 is connected to the upwind second header 57 so as to communicate with the upwind fifth space A5. That is, the turn-around flow path JP allows the upwind fourth space A4 and the upwind fifth space A5 to communicate with each other.

(4-1-2) Downwind Heat-Exchanging Unit 60

Figure 11:
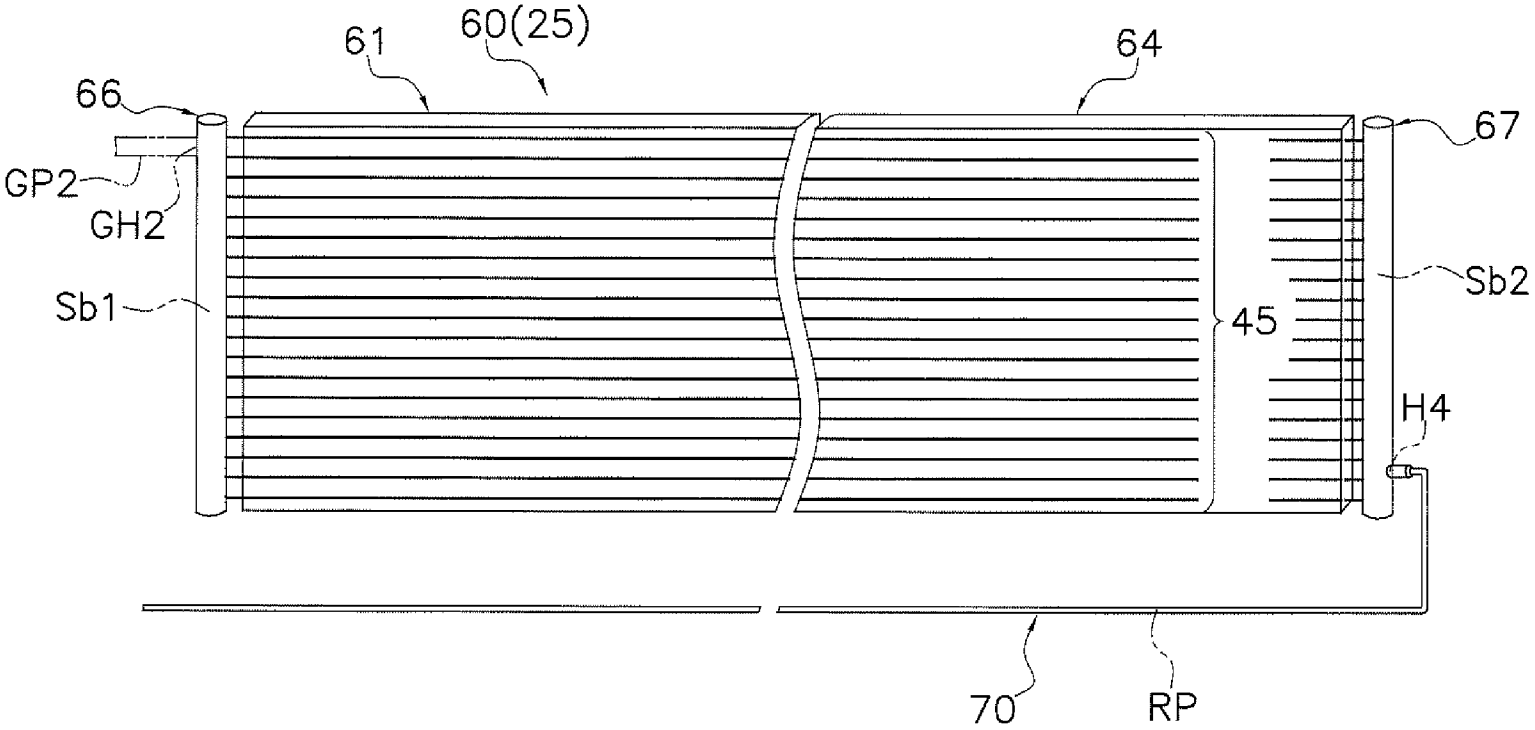
FIG. 11 is a schematic view schematically showing a mode of construction of a downwind heat-exchanging unit.

FIG. 11 is a schematic view schematically showing a mode of construction of the downwind heat-exchanging unit 60. The downwind heat-exchanging unit 60 primarily includes, as the heat-exchange surface 40, a downwind first heat-exchange surface 61, a downwind second heat-exchange surface 62, a downwind third heat-exchange surface 63, and a downwind fourth heat-exchange surface 64 (these are collectively referred to as "downwind heat-exchange surface 65"); a downwind first header 66; and a downwind second header 67. With regard to a wind speed distribution of the indoor air flow AF that passes the downwind heat-exchanging unit 60 in an installed state, the wind speed on a lower layer side is less than the wind speed on an upper layer side. Specifically, the wind speed of the indoor air flow AF that passes a portion of the downwind heat-exchanging unit 60 that is below an alternate long and short dashed line L1 (see FIG. 12) is less than the wind speed of the indoor air flow AF that passes a portion above the alternate long and short dashed line L1.

(4-1-2-1) Downwind Heat-Exchange Surface 65

In the downwind heat-exchange surface 65, the downwind first heat-exchange surface 61 (corresponding to "third portion" in the claims) is positioned on a most downstream side of a flow of a refrigerant when a cooling operation is performed, and is positioned on a most upstream side of a flow of a refrigerant when a heating operation is performed. When viewed in the heat-transfer-tube lamination direction dr2 (here, in plan view), the downwind first heat-exchange surface 61 has its terminating end connected to the downwind first header 66, and primarily extends from the rear towards the front. The downwind first heat-exchange surface 61 has substantially the same area as the upwind fourth heat-exchange surface 54 when viewed in the air flow direction dr3, and is adjacent to the downwind side of the upwind fourth heat-exchange surface 54 in the air flow direction dr3. The downwind first heat-exchange surface 61 is positioned closer than the downwind second heat-exchange surface 62 and the downwind third heat-exchange surface 63 to the connection pipe insertion port 30*a*. More specifically, the terminating end of the downwind first heat-exchange surface 61 is positioned closer than a leading end of the downwind first heat-exchange surface 61 to the connection pipe insertion port 30*a*.

In the downwind heat-exchange surface 65, the downwind second heat-exchange surface 62 is positioned on an upstream side of a flow of a refrigerant at the downwind first heat-exchange surface 61 when a cooling operation is performed, and is positioned on a downstream side of a flow of a refrigerant at the downwind first heat-exchange surface 61 when a heating operation is performed. When viewed in the heat-transfer-tube lamination direction dr2, the downwind second heat-exchange surface 62 is connected to the leading end of the downwind first heat-exchange surface 61 while a terminating end of the downwind second heat-exchange surface 62 is curved, and primarily extends from the left towards the right. The downwind second heat-exchange surface 62 has substantially the same area as the upwind third heat-exchange surface 53 when viewed in the air flow direction dr3, and is adjacent to the downwind side of the upwind third heat-exchange surface 53 in the air flow direction dr3.

In the downwind heat-exchange surface 65, the downwind third heat-exchange surface 63 (corresponding to "second portion" in the claims) is positioned on an upstream side of a flow of a refrigerant at the downwind second heat-exchange surface 62 when a cooling operation is performed, and is positioned on a downstream side of a flow of a refrigerant at the downwind second heat-exchange surface 62 when a heating operation is performed. When viewed in the heat-transfer-tube lamination direction dr2, the downwind third heat-exchange surface 63 is connected to a leading end of the downwind second heat-exchange surface 62 while a terminating end of the downwind third heat-exchange surface 63 is curved, and primarily extends from the front towards the rear. The downwind third heat-exchange surface 63 has substantially the same area as the upwind second heat-exchange surface 52 when viewed in the air flow direction dr3, and is adjacent to the downwind side of the upwind second heat-exchange surface 52 in the air flow direction dr3.

In the downwind heat-exchange surface 65, the downwind fourth heat-exchange surface 64 (corresponding to "first portion" and "fourth portion" in the claims) is positioned on an upstream side of a flow of a refrigerant at the downwind third heat-exchange surface 63 when a cooling operation is performed, and is positioned on a downstream side of a flow of a refrigerant at the downwind third heat-exchange surface 63 when a heating operation is performed. When viewed in the heat-transfer-tube lamination direction dr2, the downwind fourth heat-exchange surface 64 is connected to a leading end of the downwind third heat-exchange surface 63 while a terminating end of the downwind fourth heat-exchange surface 64 is curved, and primarily extends from the right towards the left. A leading end of the downwind fourth heat-exchange surface 64 is connected to the downwind second header 67. The downwind fourth heat-exchange surface 64 has substantially the same area as the upwind first heat-exchange surface 51 when viewed in the air flow direction dr3, and is adjacent to the downwind side of the upwind first heat-exchange surface 51 in the air flow direction dr3. The downwind fourth heat-exchange surface 64 is positioned closer than the downwind second heat-exchange surface 62 and the downwind third heat-exchange surface 63 to the connection pipe insertion port 30*a*. More specifically, the leading end of the downwind fourth heat-exchange surface 64 is positioned closer than the terminating end of the downwind fourth heat-exchange surface 64 to the connection pipe insertion port 30*a*.

By including such a downwind first heat-exchange surface 61, downwind second heat-exchange surface 62, downwind third heat-exchange surface 63, and downwind fourth heat-exchange surface 64, when viewed in the heat-transfer-tube lamination direction dr2, the downwind heat-exchange surface 65 of the downwind heat-exchanging unit 60 is bent or curved at three or more locations and form a substantially square shape. That is, the downwind heat-exchanging unit 60 includes the downwind heat-exchange surface 65 having four faces.

(4-1-2-2) Downwind First Header 66

The downwind first header 66 (corresponding to "first header" in the claims) is a header collecting pipe that functions as, for example, a dividing header that divides a refrigerant to pass through each heat transfer tube 45, a merging header that merges the refrigerants that flow out from the respective heat transfer tubes 45, or a turn-around header for allowing the refrigerants that flow out from the respective heat transfer tubes 45 to turn around to other heat transfer tubes 45. In an installed state, a longitudinal direction of the downwind first header 66 is a vertical direction (up-down direction).

The downwind first header 66 is formed in a cylindrical shape, and a space is formed in the downwind first header 66 (hereunder called "downwind first-header space Sb1" corresponding to "first-header space" in the claims). The downwind first-header space Sb1 is positioned on a most downstream side of a flow of a refrigerant in the downwind heat-exchanging unit 60 when a cooling operation is performed, and is positioned on a most upstream side of a flow of a refrigerant in the downwind heat-exchanging unit 60 when a heating operation is performed. The downwind first header 66 is connected to the terminating end of the downwind first heat-exchange surface 61. The downwind first header 66 is connected to one end of each heat transfer tube 45 that is included at the downwind first heat-exchange surface 61, and allows the heat transfer tubes 45 and the downwind first-header space Sb1 to communicate with each other. The downwind first header 66 is adjacent to the downwind side of the upwind second header 57 in the air flow direction dr3.

The second gas-side inlet/outlet GH2 is formed in the downwind first header 66. The second gas-side inlet/outlet GH2 communicates with the downwind first-header space Sb1. The second gas-side connection pipe GP2 is connected to the second gas-side inlet/outlet GH2.

(4-1-2-3) Downwind Second Header 67

The downwind second header 67 (corresponding to "second header" in the claims) is a header collecting pipe that functions as, for example, a dividing header that divides a refrigerant to pass through each heat transfer tube 45, a merging header that merges the refrigerants that flow out from the respective heat transfer tubes 45, or a turn-around header for allowing the refrigerants that flow out from the respective heat transfer tubes 45 to turn around to other heat transfer tubes 45. In an installed state, a longitudinal direction of the downwind second header 67 is a vertical direction (up-down direction).

The downwind second header 67 is formed in a cylindrical shape, and a space is formed in the downwind second header 67 (hereunder called "downwind second-header space Sb2" corresponding to "second-header space" in the claims). The downwind second-header space Sb2 is positioned on a most upstream side of a flow of a refrigerant at the downwind heat-exchanging unit 60 when a cooling operation is performed, and is positioned on a most downstream side of a flow of a refrigerant in the downwind heat-exchanging unit 60 when a heating operation is performed.

The downwind second header 67 is connected to the leading end of the downwind fourth heat-exchange surface 64. The downwind second header 67 is connected to one end of each heat transfer tube 45 that is included at the downwind fourth heat-exchange surface 64, and allows the heat transfer tubes 45 and the downwind second-header space Sb2 to communicate with each other. The downwind second header 67 is adjacent to the downwind side of the upwind first header 56 in the air flow direction dr3.

A fourth connection hole H4 for connecting the other end of the connection pipe 70 is formed in the downwind second header 67. The fourth connection hole H4 communicates with the downwind second-header space Sb2. The other end of the connection pipe 70 is connected to the fourth connection hole H4 so that the downwind second-header space Sb2 and the upwind sixth space A6 communicate with each other. The downwind second-header space Sb2 that communicates with the connection pipe 70 corresponds to "downwind downstream-side space" in the claims.

(4-1-3) Connection Pipe 70

The connection pipe 70 is a refrigerant pipe that forms a connection flow path RP between the upwind heat-exchanging unit 50 and the downwind heat-exchanging unit 60. The connection flow path RP is a refrigerant flow path that allows the downwind second-header space Sb2 and the upwind sixth space A6 to communicate with each other.

By forming the connection flow path RP by the connection pipe 70, a refrigerant flows from the upwind sixth space A6 towards the downwind second-header space Sb2 when a cooling operation is performed, and a refrigerant flows from the downwind second-header space Sb2 towards the upwind sixth space A6 when a heating operation is performed.

(4-2) Refrigerant Paths in Indoor Heat Exchanger 25

Figure 12:
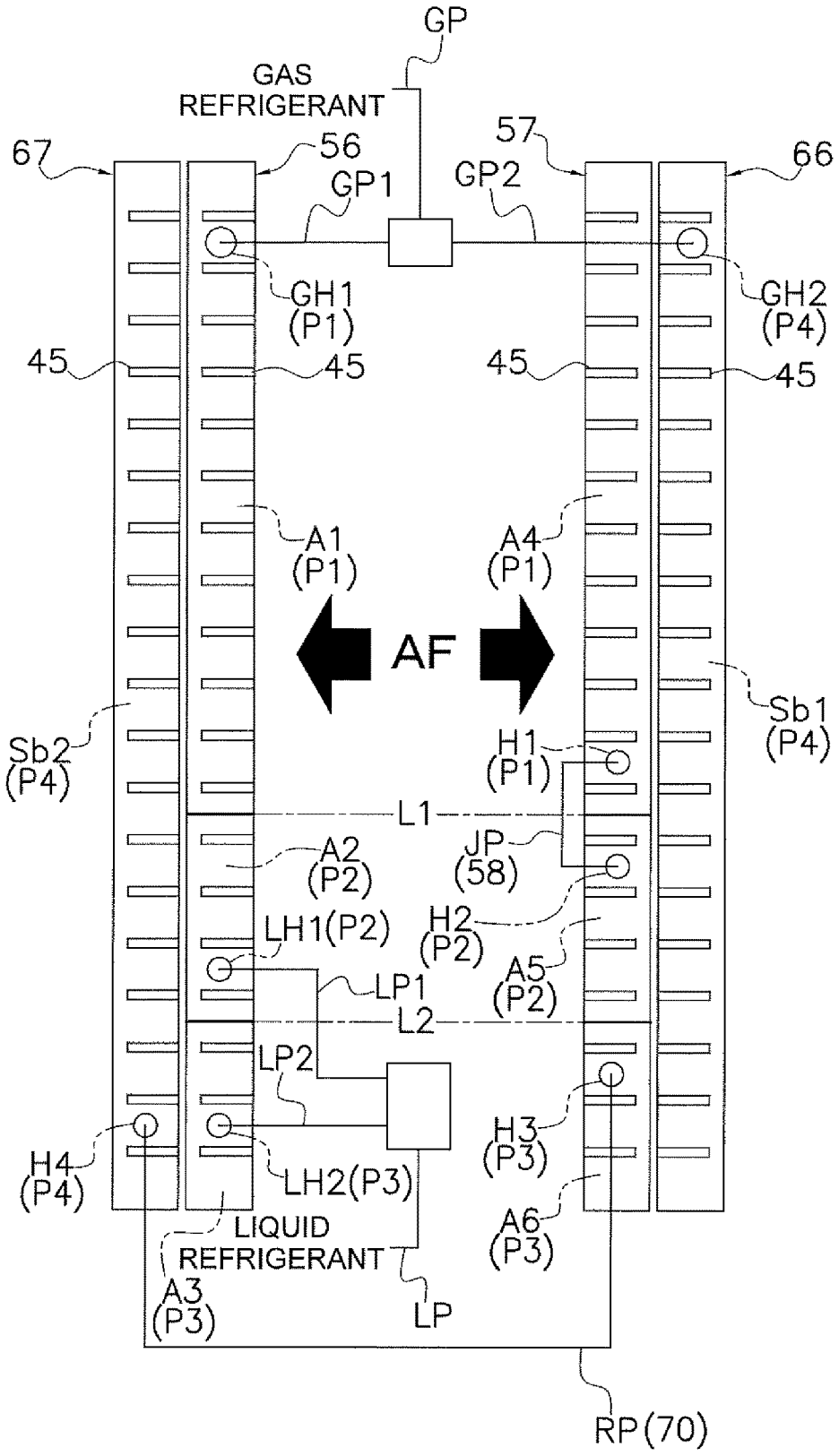
FIG. 12 is a schematic view schematically showing refrigerant paths that are formed in the indoor heat exchanger.

FIG. 12 is a schematic view schematically showing refrigerant paths that are formed in the indoor heat exchanger 25. Here, the term "path" refers to a refrigerant flow path that is formed by communication of elements included in the indoor heat exchanger 25.

In one or more embodiments, a plurality of paths are formed in the indoor heat exchanger 25. Specifically, in the indoor heat exchanger 25, a first path P1, a second path P2, a third path P3, and a fourth path P4 are formed. That is, in the indoor heat exchanger 25, there are four refrigerant flow paths that are separated from each other.

(4-2-1) First Path P1

The first path P1 is formed in the upwind heat-exchanging unit 50. In one or more embodiments, the first path P1 is formed above the alternate long and short dashed line L1 (see, for example, FIGS. 9, 10, and 12) of the upwind heat-exchanging unit 50. The first path P1 is a refrigerant flow path that is formed by allowing the first gas-side inlet/outlet GH1 to communicate with the upwind first space A1, the upwind first space A1 to communicate with the upwind fourth space A4 via the heat-transfer-tube flow paths 451 (heat transfer tubes 45), and the upwind fourth space A4 to communicate with the first connection hole H1. That is, the first path P1 is a refrigerant flow path that includes the first gas-side inlet/outlet GH1, the upwind first space A1 in the upwind first header 56, the heat-transfer-tube flow paths 451 in the heat transfer tubes 45, the upwind fourth space A4 in the upwind second header 57, and the first connection hole H1.

As shown in FIGS. 10 and 12, the alternate long and short dashed line L1 is positioned between the twelfth heat transfer tube 45 from the top and the thirteenth heat transfer tube 45 from the top. That is, in one or more embodiments, the first path P1 includes the transfer-heat-tube flow paths 451 of twelve heat transfer tubes 45 from the top.

(4-2-2) Second Path P2

The second path P2 is formed in the upwind heat-exchanging unit 50. In one or more embodiments, the second path P2 is formed below the alternate long and short dashed line L1 of the upwind heat-exchanging unit 50 and above an alternate long and short dashed line L2 (see, for example, FIGS. 9, 10, and 12) of the upwind heat-exchanging unit 50. The second path P2 is a refrigerant flow path that is formed by allowing the second connection hole H2 to communicate with the upwind fifth space A5, the upwind fifth space A5 to communicate with the upwind second space A2 via the heat-transfer-tube flow paths 451 (heat transfer tubes 45), and the upwind second space A2 to communicate with the first liquid-side inlet/outlet LH1. That is, the second path P2 is a refrigerant flow path that includes the second connection hole H2, the upwind fifth space A5 in the upwind second header 57, the heat-transfer-tube flow paths 451 in the heat transfer tubes 45, the upwind second space A2 in the upwind first header 56, and the first liquid-side inlet/outlet LH1.

The second path P2 communicates with the first path P1 via the turn-around flow path JP (turn-around pipe 58). Therefore, the second path P2 along with the first path P1 can be interpreted as being one path.

As shown in FIGS. 10 and 12, the alternate long and short dashed line L2 is positioned between the sixteenth heat transfer tube 45 from the top and the seventeenth heat transfer tube 45 from the top. That is, in one or more embodiments, the second path P2 includes the transfer-heat-tube flow paths 451 of the thirteenth to the sixteenth heat transfer tubes 45 from the top (in other words, four heat transfer tubes 45).

(4-2-3) Third Path P3

The third path P3 is formed in the upwind heat-exchanging unit 50. In one or more embodiments, the third path P3 is formed below the alternate long and short dashed line L2 of the upwind heat-exchanging unit 50. The third path P3 is a refrigerant flow path that is formed by allowing the third connection hole H3 to communicate with the upwind sixth space A6, the upwind sixth space A6 to communicate with the upwind third space A3 via the heat-transfer-tube flow paths 451 (heat transfer tubes 45), and the upwind third space A3 to communicate with the second liquid-side inlet/outlet LH2. That is, the third path P3 is a refrigerant flow path that includes the third connection hole H3, the upwind sixth space A6 in the upwind second header 57, the heat-transfer-tube flow paths 451 in the heat transfer tubes 45, the upwind third space A3 in the upwind first header 56, and the second liquid-side inlet/outlet LH2. The third path P3 communicates with the fourth path P4 via the connection flow path RP (connection pipe 70).

In one or more embodiments, the third path P3 includes the heat-transfer-tube flow paths 451 of the seventeenth to the nineteenth heat transfer tube 45 from the top (that is, the three heat transfer tubes 45 from the bottom).

(4-2-4) Fourth Path P4

The fourth path P4 is formed in the downwind heat-exchanging unit 60. The fourth path P4 is a refrigerant flow path that is formed by allowing the second gas-side inlet/outlet GH2 to communicate with the downwind first-header space Sb1, the downwind first-header space Sb1 to communicate with the downwind second-header space Sb2 via the heat-transfer-tube flow paths 451 (heat transfer tubes 45), and the downwind second-header space Sb2 to communicate with the fourth connection hole H4. That is, the fourth path P4 is a refrigerant flow path that includes the second gas-side inlet/outlet GH2, the downwind first-header space Sb1 in the downwind first header 66, the heat-transfer-tube flow paths 451 in the heat transfer tubes 45, the downwind second-header space Sb2 in the downwind second header 67, and the fourth connection hole H4. The fourth path P4 communicates with the third path P3 via the connection flow path RP (connection pipe 70).

(4-3) Flow of Refrigerant in Indoor Heat Exchanger 25

(4-3-1) when Cooling Operation is Performed

Figure 13:
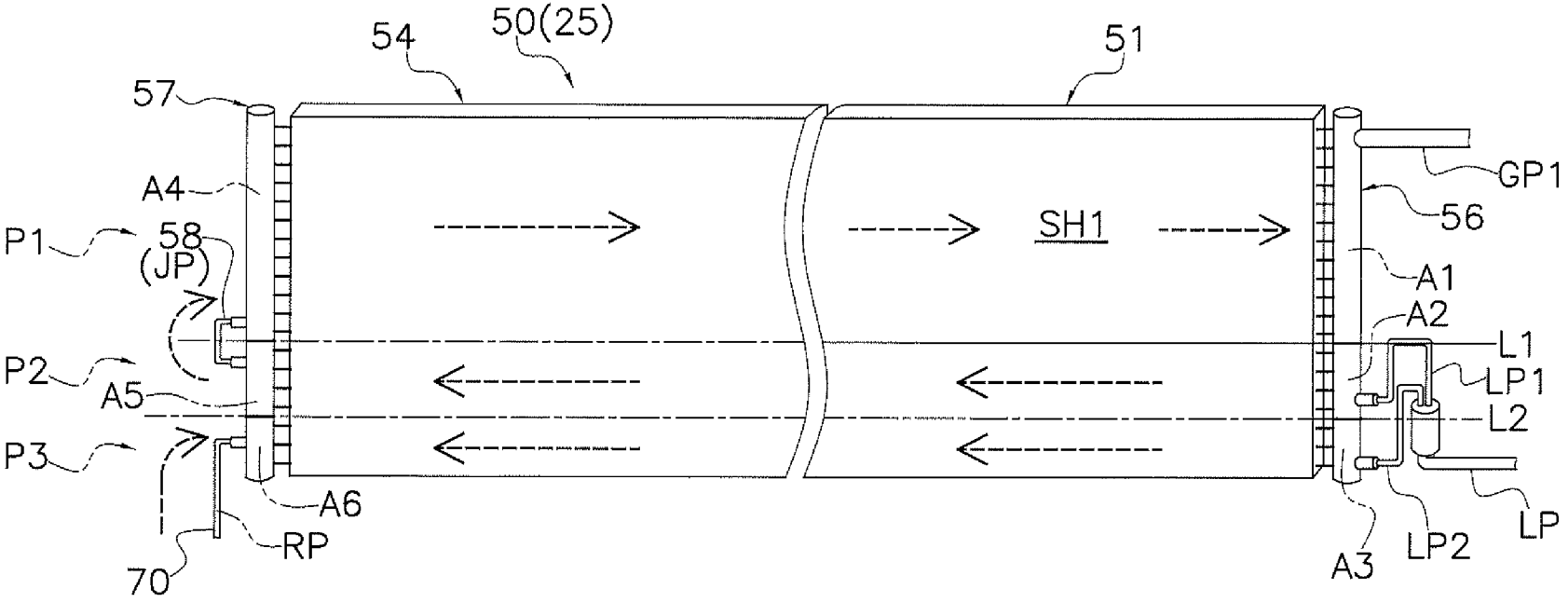
FIG. 13 is a schematic view schematically showing a flow of a refrigerant in the upwind heat-exchanging unit when a cooling operation is performed.
Figure 14:
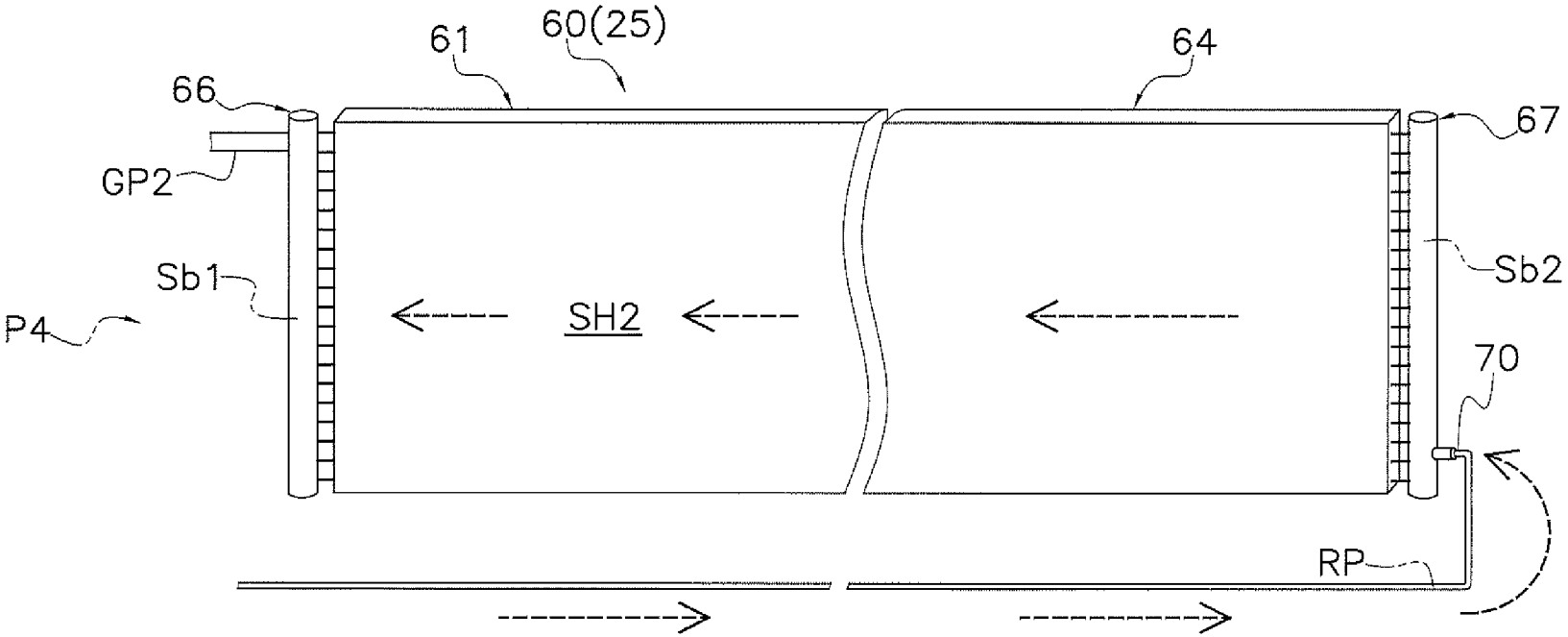
FIG. 14 is a schematic view schematically showing a flow of a refrigerant in the downwind heat-exchanging unit when a cooling operation is performed.

FIG. 13 is a schematic view schematically showing a flow of a refrigerant in the upwind heat-exchanging unit 50 when a cooling operation is performed. FIG. 14 is a schematic view schematically showing a flow of a refrigerant in the downwind heat-exchanging unit 60 when a cooling operation is performed. In FIGS. 13 and 14, the broken arrows indicate refrigerant flow directions.

When a cooling operation is performed, a refrigerant that has flown through the first liquid-side connection pipe LP1 flows into the second path P2 of the upwind heat-exchanging unit 50 via the first liquid-side inlet/outlet LH1. The refrigerant that has flown into the second path P2 passes through the second path P2 while exchanging heat with the indoor air flow AF and being heated, and flows into the first path P1 via the turn-around flow path JP (turn-around pipe 58). The refrigerant that has flown into the first path P1 passes through the first path P1 while exchanging heat with the indoor air flow AF and being heated, and flows out to the first gas-side connection pipe GP1 via the first gas-side inlet/outlet GH1.

When the cooling operation is performed, a refrigerant that has flown into the second liquid-side connection pipe LP2 flows into the third path P3 of the upwind heat-exchanging unit 50 via the second liquid-side inlet/outlet LH2. The refrigerant that has flown into the third path P3 passes through the third path P3 while exchanging heat with the indoor air flow AF and being heated, and flows into the fourth path P4 of the downwind heat-exchanging unit 60 via the connection flow path RP (connection pipe 70). The refrigerant that has flown into the fourth path P4 passes through the fourth path P4 while exchanging heat with the indoor air flow AF and being heated, and flows out to the second gas-side connection pipe GP2 via the second gas-side inlet/outlet GH2.

In this way, when the cooling operation is performed, in the indoor heat exchanger 25, a refrigerant flow in which the refrigerant flows into the second path P2 and flows out via the first path P1 (that is, a refrigerant flow that is produced by the first path P1 and the second path P2) and a refrigerant flow in which the refrigerant flows into the third path P3 and flows out via the fourth path P4 (that is, a refrigerant flow that is produced by the third path P3 and the fourth path P4) are produced.

In the refrigerant flow that is produced by the first path P1 and the second path P2, the refrigerant flows through the first liquid-side inlet/outlet LH1, the upwind second space A2, the heat-transfer-tube flow paths 451 (heat transfer tubes 45) in the second path P2, the upwind fifth space A5, the turn-around flow path JP (turn-around pipe 58), the upwind fourth space A4, the heat-transfer-tube flow paths 451 (heat transfer tubes 45) in the first path P1, the upwind first space A1, and the first gas-side inlet/outlet GH1 in this order.

In the refrigerant flow that is produced by the third path P3 and the fourth path P4, the refrigerant flows through the second liquid-side inlet/outlet LH2, the upwind third space A3, the heat-transfer-tube flow paths 451 (heat transfer tubes 45) in the third path P3, the upwind sixth space A6, the connection flow path RP (connection pipe 70), the downwind second-header space Sb2, the heat-transfer-tube flow paths 451 (heat transfer tubes 45) in the fourth path P4, the downwind first header Sb1, and the second gas-side inlet/outlet GH2 in this order.

When the cooling operation is performed, in the indoor heat exchanger 25, an area in which a refrigerant that is in a superheated state flows (superheating area SH1) is formed at the heat-transfer-tube flow paths 451 in the first path P1 (in particular, the heat-transfer-tube flow paths 451 that are included at the first path P1 of the upwind first heat-exchange surface 51). In addition, an area in which a refrigerant that is in a superheated state flows (superheating area SH2) is formed at the heat-transfer-tube flow paths 451 in the fourth path P4 (in particular, the heat-transfer-tube flow paths 451 that are included at the fourth path P4 of the downwind first heat-exchange surface 61).

(4-3-2) When a Heating Operation is Performed

Figure 15:
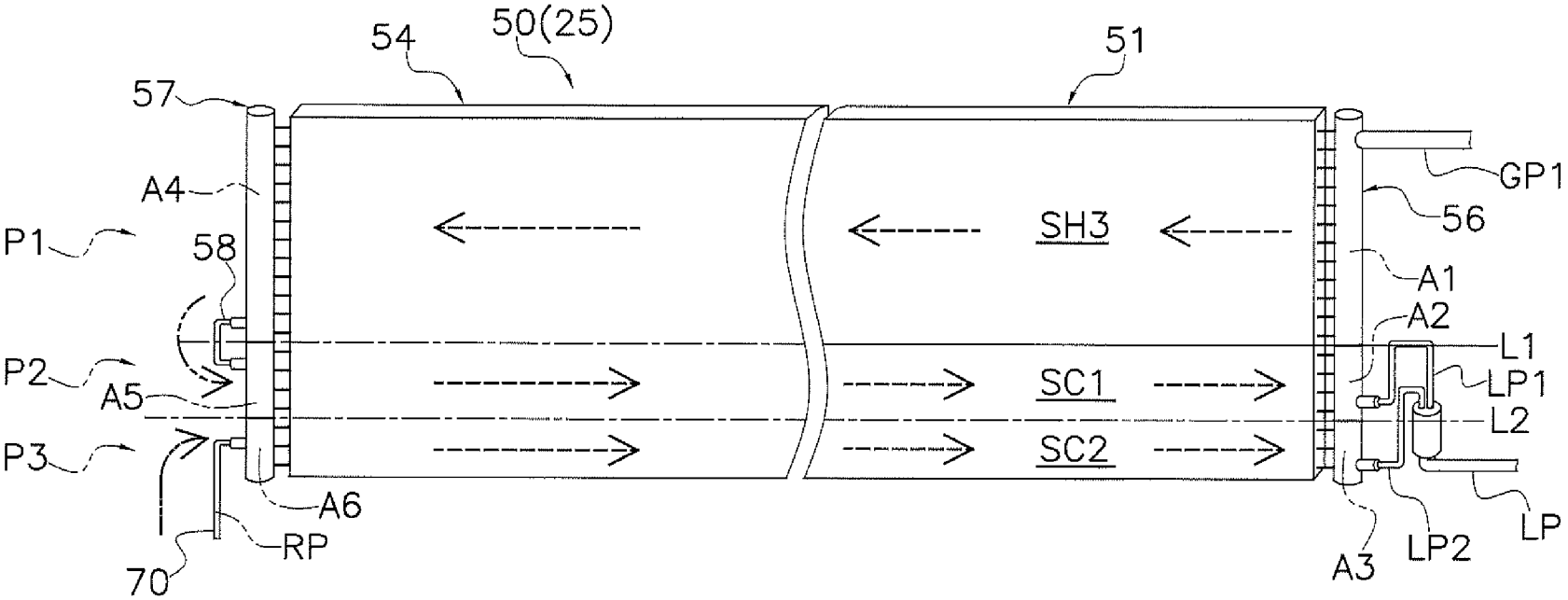
FIG. 15 is a schematic view schematically showing a flow of a refrigerant in the upwind heat-exchanging unit when a heating operation is performed.
Figure 16:
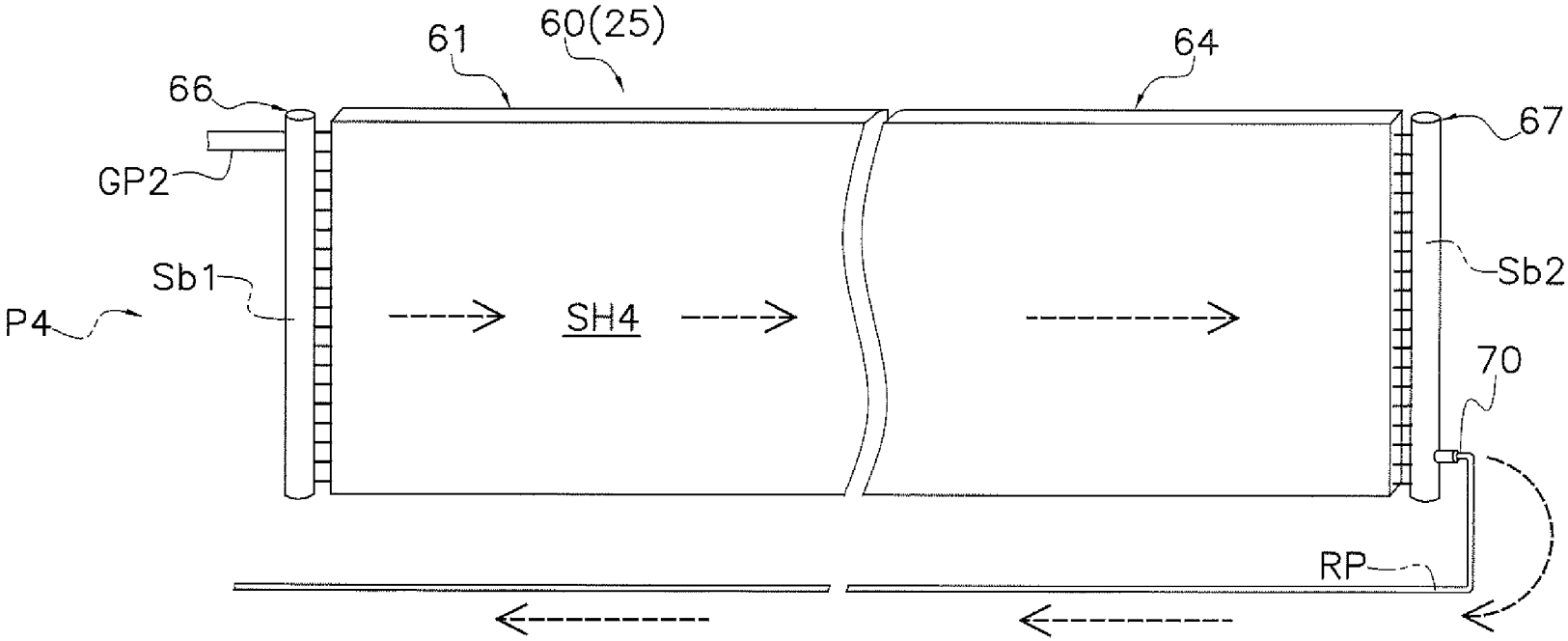
FIG. 16 is a schematic view schematically showing a flow of a refrigerant in the downwind heat-exchanging unit when a heating operation is performed.

FIG. 15 is a schematic view schematically showing a flow of a refrigerant in the upwind heat-exchanging unit 50 when a heating operation is performed. FIG. 16 is a schematic view schematically showing a flow of a refrigerant in the downwind heat-exchanging unit 60 when a heating operation is performed. In FIGS. 15 and 16, the broken arrows indicate refrigerant flow directions.

When a heating operation is performed, a gas refrigerant in a superheated state that has flown through the first gas-side connection pipe GP1 flows into the first path P1 of the upwind heat-exchanging unit 50 via the first gas-side inlet/outlet GH1. The refrigerant that has flown into the first path P1 passes through the first path P1 while exchanging heat with the indoor air flow AF and being cooled, and flows into the second path P2 via the turn-around flow path JP (turn-around pipe 58). The refrigerant that has flown into the second path P2 passes through the second path P2 while exchanging heat with the indoor air flow AF and being in a subcooled state, and flows out to the first liquid-side connection pipe LP1 via the first liquid-side inlet/outlet LH1.

When the heating operation is performed, a gas refrigerant in a superheated state that has flown through the second gas-side connection pipe GP2 flows into the fourth path P4 of the downwind heat-exchanging unit 60 via the second gas-side inlet/outlet GH2. The refrigerant that has flown into the fourth path P4 passes through the fourth path P4 while exchanging heat with the indoor air flow AF and being cooled, and flows into the third path P3 of the upwind heat-exchanging unit 50 via the connection flow path RP (connection pipe 70). The refrigerant that has flown into the third path P3 passes through the third path P3 while exchanging heat with the indoor air flow AF and being in a subcooled state, and flows out to the second liquid-side connection pipe LP2 via the second liquid-side inlet/outlet LH2.

In this way, when the heating operation is performed, in the indoor heat exchanger 25, a refrigerant flow in which the refrigerant flows into the first path P1 and flows out via the second path P2 (that is, a refrigerant flow that is produced by the first path P1 and the second path P2) and a refrigerant flow in which the refrigerant flows into the fourth path P4 and flows out via the third path P3 (that is, a refrigerant flow that is produced by the third path P3 and the fourth path P4) are produced.

In the refrigerant flow that is produced by the first path P1 and the second path P2, the refrigerant flows through the first gas-side inlet/outlet GH1, the upwind first space A1, the heat-transfer-tube flow paths 451 (heat transfer tubes 45) in the first path P1, the upwind fourth space A4, the turn-around flow path JP (turn-around pipe 58), the upwind fifth space A5, the heat-transfer-tube flow paths 451 (heat transfer tubes 45) inside the second path P2, the upwind second space A2, and the first liquid-side inlet/outlet LH1 in this order.

In the refrigerant flow that is produced by the third path P3 and the fourth path P4, the refrigerant flows through the second gas-side inlet/outlet GH2, the downwind first-header space Sb1, the heat-transfer-tube flow paths 451 (heat transfer tubes 45) in the fourth path P4, the downwind second-header space Sb2, the connection flow path RP (connection pipe 70), the upwind sixth space A6, the heat-transfer-tube flow paths 451 (heat transfer tubes 45) in the third path P3, the upwind third space A3, and the second liquid-side inlet/outlet LH2 in this order.

When the heating operation is performed, in the indoor heat exchanger 25, an area in which a refrigerant that is in a superheated state flows (superheating area SH3) is formed at the heat-transfer-tube flow paths 451 in the first path P1 (in particular, the heat-transfer-tube flow paths 451 that are included at the first path P1 of the upwind first heat-exchange surface 51). In addition, an area in which a refrigerant that is in a superheated state flows (superheating area SH4) is formed at the heat-transfer-tube flow paths 451 in the fourth path P4 (in particular, the heat-transfer-tube flow paths 451 that are included at the fourth path P4 of the downwind first heat-exchange surface 61). As shown in FIGS. 15 and 16, the direction of flow of the refrigerant that flows through the superheating area SH3 of the upwind heat-exchanging unit 50 and the direction of flow of the refrigerant that flows through the superheating area SH4 of the downwind heat-exchanging unit 60 are opposite to each other (that is, the flows are counterflows).

When the heating operation is performed, in the indoor heat exchanger 25, an area in which a refrigerant in a subcooled state flows (subcooling area SC1) is formed at the heat-transfer-tube flow paths 451 in the second path P2 (in particular, the heat-transfer-tube flow paths 451 that are included at the second path P2 of the upwind first heat-exchange surface 51). In addition, an area in which a refrigerant in a subcooled state flows (subcooling area SC2) is formed at the heat-transfer-tube flow paths 451 in the third path P3 (in particular, the heat-transfer-tube flow paths 451 that are included at the third path P3 of the upwind first heat-exchange surface 51). As shown in FIGS. 15 and 16, the whole or a large part of each of the subcooling areas SC1 and SC2 of the upwind heat-exchanging unit 50 does not overlap the superheating area SH4 of the downwind heat-exchanging unit 60 in the air flow direction dr3.

In the upwind heat-exchange surface 55 and the downwind heat-exchange surface 65, when a heating operation is performed, an area that does not correspond to the subcooling areas is a main heat-exchange area. The heat exchange amount between the refrigerant and the indoor air flow AF is larger at the main heat-exchange area than at the subcooling areas. In the upwind heat-exchange surface 55 and the downwind heat-exchange surface 65, the heat transfer area of the main heat-exchange area is larger than the heat transfer area of the subcooling areas.

(4-4) Functions of Indoor Heat Exchanger 25

In the indoor heat exchanger 25, the area of the upwind heat-exchange surface 55 and the area of the downwind heat-exchange surface 65 are substantially the same when viewed in the air flow direction dr3. Flow-rate regulating valves for regulating the flow rates of refrigerants that flow through the upwind heat-exchanging unit 50 and the downwind heat-exchanging unit 60 are not individually provided. Moreover, when a heating operation is performed, with regard to the refrigerant that passes through the downwind heat-exchanging unit 60, the subcooling area SC2 is formed at the upwind heat-exchanging unit 50. As a result, the main heat-exchange area of the upwind heat-exchanging unit 50 is small. Therefore, the refrigerant flow rate of the upwind heat-exchanging unit 50 and the refrigerant flow rate of the downwind heat-exchanging unit 60 can be brought closer to each other in value.

That is, the larger the main heat-exchange area of the upwind heat-exchanging unit 50, the larger the heat exchange amount between the refrigerant and the indoor air flow AF in the upwind heat-exchanging unit 50. In relation to this, in the downwind heat-exchanging unit 60, temperature differences between the refrigerant and the indoor air flow AF is reduced, as a result of which the heat exchange amount is small. As a result, the difference between the refrigerant flow rate of the upwind heat-exchanging unit 50 and the refrigerant flow rate of the downwind heat-exchanging unit 60 becomes large.

In contrast, in the indoor heat exchanger 25 according to the above-described embodiments, regarding the refrigerant that flows through the downwind heat-exchanging unit 60, since the subcooling area (SC2) is formed at the upwind heat-exchanging unit 50, the main heat-exchange area is small. Therefore, in the upwind heat-exchanging unit 50, the heat exchange amount between the refrigerant and the indoor air flow AF becomes small. In relation to this, in the downwind heat-exchanging unit 60, a reduction in the temperature differences between the refrigerant and the indoor air flow AF is suppressed, so that the heat exchange amount can be increased. As a result, an increase in the difference between the refrigerant flow rate of the upwind heat-exchanging unit 50 and the refrigerant flow rate of the downwind heat-exchanging unit 60 is suppressed, so that the refrigerant flow rates can be brought closer to each other in value. In this way, the indoor heat exchanger 25 functions to bring the flow rate of the upwind heat-exchanging unit 50 and the flow rate of the downwind heat-exchanging unit 60 when a heating operation is performed closer to each other in value.

When a heating operation is performed, regarding a refrigerant that has passed through the downwind heat-exchanging unit 60, by forming the subcooling area SC2 at the upwind heat-exchanging unit 50, all faces of the downwind heat-exchange surface 65 can be made to function as the main heat-exchange area. Therefore, it is possible to increase the heat exchange amount between the refrigerant and the indoor air flow AF in the downwind heat-exchange surface 65 and to contribute to improving the performance of the indoor heat exchanger 25. In this way, in relation to making it possible to form a large main heat-exchange area of the downwind heat-exchanging unit 60 when a heating operation is performed, the indoor heat exchanger 25 has the function of increasing the heat exchange amount between the refrigerant and the indoor air flow AF in the downwind heat-exchange surface 65.

(5) Features (5-1)

At the indoor heat exchanger 25 according to the above-described embodiments, when a heating operation is performed (that is, when the refrigerant that has flown in from the first gas-side inlet/outlet GH1 and the second gas-side inlet/outlet GH2 exchanges heat with the indoor air flow AF and, as a liquid refrigerant in a subcooled state, flows out from the first liquid-side inlet/outlet LH1 and the second liquid-side inlet/outlet LH2), in the upwind heat-exchanging unit 50, the subcooling areas (SC1 and SC2), which are areas where the liquid refrigerant in the subcooled state flows, are formed, the "upwind outlet-side space" (here, the upwind sixth space A6) and the "upwind upstream-side space" (here, the upwind third space A3) are formed, and the connection flow path RP that is formed between the upwind heat-exchanging unit 50 and the downwind heat-exchanging unit 60 allows "downwind downstream-side space" (here, the downwind second-header space Sb2) and the "upwind upstream-side space" (upwind third space A3) to communicate with each other.

Therefore, when the heat exchanger is used as a condenser of a refrigerant, after the refrigerant that has passed through the downwind heat-exchanging unit 60 has been sent to the upwind heat-exchanging unit 50, the refrigerant is discharged from the second liquid-side inlet/outlet LH2. As a result, the subcooling areas (SC1 and SC2) can be arranged mainly at the upwind heat-exchanging unit 50 on the upwind side. Consequently, the superheating area on the upwind side and the subcooling areas on the downwind side can be prevented from overlapping or from being close to each other in the air flow direction dr3.

Specifically, in the above-described embodiments, when a heating operation is performed, regarding the refrigerant that flows through the downwind heat-exchanging unit 60, the subcooling area that has hitherto been formed at the downwind heat-exchanging unit 60 is formed as the subcooling area SC2 at the upwind heat-exchanging unit 50, and the superheating area SH3 on the upwind side and the subcooling area on the downwind side are formed so as not to overlap or to be close to each other in the air flow direction dr3. Therefore, the indoor air flow AF that has passed the superheating areas (SH3 and SH4) on the upwind side is prevented from passing through the subcooling areas (SC1 and SC2). Consequently, the subcooling areas (SC1 and SC2) are formed so that temperature differences between the refrigerant and the indoor air flow AF are easily properly ensured, and this helps a degree of subcooling to be properly ensured with regard to the refrigerant that passes through the downwind heat-exchanging unit 60. That is, a reduction in performance of the heat exchanger is suppressed, and an improvement in the performance is facilitated.

(5-2)

In the indoor heat exchanger 25 according to the above-described embodiments, when a heating operation is performed, regarding a refrigerant that flows through the downwind heat-exchanging unit 60, the subcooling area that has hitherto been formed at the downwind heat-exchanging unit 60 is formed as the subcooling area SC2 at the upwind heat-exchanging unit 50. As a result, in the downwind heat-exchanging unit 60, the superheating area and the subcooling area are not adjacent to each other one above another, and heat exchange between the refrigerant that passes through the superheating areas (SH3 and SH4) and the refrigerant that passes through the subcooling area (SC2) is reduced. In relation to this, this helps the degree of subcooling of the refrigerant in the subcooling area (SC2) to be properly ensured. That is, a reduction in performance of the heat exchanger is suppressed and improvement in the performance is facilitated.

(5-3)

In the indoor heat exchanger 25 according to the above-described embodiments, a plurality of paths (P1 to P3) are formed in the upwind heat-exchanging unit 50. That is, in the upwind heat-exchanging unit 50, the path that is formed by the upwind first space A1, the heat-transfer-tube flow paths 451 of the first path P1, the upwind fourth space A4, the turn-around flow path JP, the upwind fifth space A5, the heat-transfer-tube flow paths 451 of the second path P2, and the upwind second space A2 (that is, the path that is formed by the first path P1 and the second path P2) and the path that is formed by the upwind third space A3, the heat transfer tubes 45, and the upwind sixth space A6 (the third path P3) are formed. The path that is formed by the upwind third space A3, the heat transfer tubes 45, and the upwind sixth space A6 (the third path P3) communicates with the downwind downstream-side space (downwind second-header space Sb2) via the connection flow path RP that is formed by the connection pipe 70.

Therefore, when the heat exchanger is used as a condenser of a refrigerant, in the path of the upwind heat-exchanging unit 50 that is formed by the upwind third space A3, the heat transfer tubes 45, and the upwind sixth space A6 (the third path P3), formation of the subcooling area SC2 regarding the refrigerant that has flown through the downwind heat-exchanging unit 60 is facilitated. Consequently, regarding the refrigerant that flows through the downwind heat-exchanging unit 60, this helps the degree of subcooling to be properly ensured.

(5-4)

In the indoor heat exchanger 25 according to the above-described embodiments, in the path that is formed by the upwind first space A1, the heat transfer tubes 45, the upwind fourth space A4, the turn-around flow path JP, the upwind fifth space A5, the heat transfer tubes 45, and the upwind second space A2 (that is, the path that is formed by the first path P1 and the second path P2), the upwind fourth space A4 and the upwind fifth space A5 in the upwind second header 57 communicate with each other by the turn-around flow path JP. Therefore, the refrigerant that flows through such a path turns around at a location between the upwind fourth space A4 and the upwind fifth space A5. As a result, when the heat exchanger is used as a condenser of a refrigerant, the heat exchanger is formed so that the superheating area SH3 of the refrigerant that flows through the upwind heat-exchanging unit 50 and the subcooling area SC2 of the refrigerant that flows through the downwind heat-exchanging unit 60 are not adjacent to each other one above another. Therefore, heat exchange between the refrigerant that passes through the superheating area SH3 and the refrigerant that passes through the subcooling area SC2 is reduced. In relation to this, this helps the degree of subcooling of the refrigerant in the subcooling area SC2 to be properly ensured.

(5-5)

In the indoor heat exchanger 25 according to the above-described embodiments, when a heating operation is performed (that is, when a gas refrigerant in a superheated state that has flown in from the first gas-side inlet/outlet GH1 or the second gas-side inlet/outlet GH2 exchanges heat with the indoor air flow AF and flows out as a liquid refrigerant in a subcooled state from the liquid-side inlet/outlet LH), the direction of flow of the refrigerant that flows through the superheating area SH3 of the upwind heat-exchanging unit 50 is opposite to the direction of flow of the refrigerant that flows through the superheating area SH4 of the downwind heat-exchanging unit 60.

Therefore, the refrigerant that flows through the superheating area SH3 of the upwind heat-exchanging unit 50 and the refrigerant that flows through the superheating area SH4 of the downwind heat-exchanging unit 60 flow opposite to each other. As a result, in the indoor air flow AF that has passed the upwind heat-exchanging unit 50 and in the air flow that has passed the downwind heat-exchanging unit 60, the ratio of air that has sufficiently exchanged heat with the refrigerant to air that has not sufficiently exchanged heat with the refrigerant is maintained not to become significantly unbalanced regardless of portions where the air passes through. Therefore, temperature unevenness of air that has passed the heat exchanger 25 is suppressed.

(5-6)

In the indoor heat exchanger 25 according to the above-described embodiments, the subcooling areas (SC1 and SC2) are positioned in a portion of the upwind heat-exchanging unit 50 where the wind speed of the indoor air flow AF that passes therethrough is lower than the wind speeds of the indoor air flow AF in other portions (lower layer portion). That is, when the air flow (indoor air flow AF) that passes through the heat exchanger 25 has wind speed distribution, in the indoor heat exchanger 25 in which the flow path through which the liquid refrigerant flows is formed where the wind speed is low, a reduction in performance is suppressed.

(5-7)

In the indoor heat exchanger 25 according to the above-described embodiments, in an installed state, the upwind heat-exchanging unit 50 includes the upwind first heat-exchange surface 51 (first portion) in which the heat transfer tubes 45 extend in a left-right direction (first direction) and the upwind second heat-exchange surface 52 (second portion) in which the heat transfer tubes 45 extend in a front-rear direction (second direction); and the second downwind heat-exchanging unit 60 includes the downwind fourth heat-exchange surface 64 (first portion) in which the heat transfer tubes 45 extend in the left-right direction (first direction) and the downwind third heat-exchange surface 63 (second portion) in which the heat transfer tubes 45 extend in the front-rear direction (second direction). The downwind fourth heat-exchange surface 64 of the downwind heat-exchanging unit 60 is disposed beside the downwind side of the upwind first heat-exchange surface 51 of the upwind heat-exchanging unit 50, and the downwind third heat-exchange surface 63 of the downwind heat-exchanging unit 60 is disposed beside the downwind side of the upwind second heat-exchange surface 52 of the upwind heat-exchanging unit 50.

Therefore, in the indoor heat exchanger 25 in which the plurality of heat-exchanging units each including the heat-exchange surfaces 40 ("first portion" and "second portion") extending in different directions are arranged side by side on the upwind side and on the downwind side, the indoor air flow AF that has passed the superheating area (SH3) of the upwind-side heat-exchanging unit (upwind heat-exchanging unit 50) is prevented from passing the subcooling area, and a reduction in performance is suppressed.

(5-8)

In the air conditioner 100 according to the above-described embodiments, the indoor heat exchanger 25 is accommodated in the casing 30, and the connection pipe insertion port 30*a* is formed in the casing 30. In the indoor heat exchanger 25, the upwind heat-exchanging unit 50 includes the upwind first heat-exchange surface 51 ("third portion") in which the heat transfer tubes 45 extend rightwards and the upwind fourth heat-exchange surface 54 ("fourth portion") in which the heat transfer tubes 45 extend rearwards. The downwind heat-exchanging unit 60 includes the downwind first heat-exchange surface 61 ("third portion") in which the heat transfer tubes 45 extend forward and the downwind fourth heat-exchange surface 64 ("fourth portion") in which the heat transfer tubes 45 extend leftwards. In the upwind heat-exchanging unit 50, the upwind first header 56 is positioned at the terminating end of the upwind first heat-exchange surface 51, and the upwind second header 57 is positioned at the leading end of the upwind fourth heat-exchange surface 54 that is disposed apart from the terminating end of the upwind first heat-exchange surface 51. In the downwind heat-exchanging unit 60, the downwind first header 66 is positioned at the terminating end of the downwind first heat-exchange surface 61, and the downwind second header 67 is positioned at the leading end of the downwind fourth heat-exchange surface 64 that is disposed apart from the terminating end of the downwind first heat-exchange surface 61. In the upwind heat-exchanging unit 50 and the downwind heat-exchanging unit 60, the upwind first heat-exchange surface 51 and the downwind first heat-exchange surface 61 are arranged closer to the connection pipe insertion port 30*a* at their terminating ends than at their leading ends. In addition, in the upwind heat-exchanging unit 50 and the downwind heat-exchanging unit 60, the upwind fourth heat-exchange surface 54 and the downwind fourth heat-exchange surface 64 are arranged closer to the connection pipe insertion port 30*a* at their leading ends than at their terminating ends.

Therefore, in the air conditioner 100 including the indoor heat exchanger 25 in which the heat-exchanging units each including the plurality of heat-exchange surfaces 40 extending in different directions are arranged side by side on the upwind side and on the downwind side, each pipe inside the casing 30 (for example, the gas-side connection pipe GP or the liquid-side connection pipe LP that is connected to the indoor heat exchanger 25, and the connection pipe 70 that extends between the upwind heat-exchanging unit 50 and the downwind heat-exchanging unit 60) can be made short in length. As a result, the pipes inside the casing 30 are easily routed. In relation to this, this helps the refrigeration apparatus to have improved workability, to be assembled more easily, and to be more compact.

(6) Modifications

The above-described embodiments can be modified as appropriate as indicated by the following modifications. Each modification may be applied by combining with other modifications in a noncontradictory manner.

(6-1) Modification 1

In the above-described embodiments, the first path P1 is formed by allowing the first gas-side inlet/outlet GH1 to communicate with the upwind first space A1 and by allowing the first connection hole H1 to communicate with the upwind fourth space A4. However, the first path P1 may be formed in other ways. For example, the first path P1 may be formed by allowing the first gas-side inlet/outlet GH1 to communicate with the upwind fourth space A4 and by allowing the first connection hole H1 to communicate with the upwind first space A1. Even in such a case, the same operational effects as those provided by the above-described embodiments are realized.

(6-2) Modification 2

In the above-described embodiments, the second path P2 is formed by allowing the second connection hole H2 to communicate with the upwind fifth space A5 and by allowing the first liquid-side inlet/outlet LH1 to communicate with the upwind second space A2. However, the second path P2 may be formed in other ways. For example, the second path P2 may be formed by allowing the second connection hole H2 to communicate with the upwind second space A2 and by allowing the first liquid-side inlet/outlet LH1 to communicate with the upwind fifth space A5.

Figure 17:
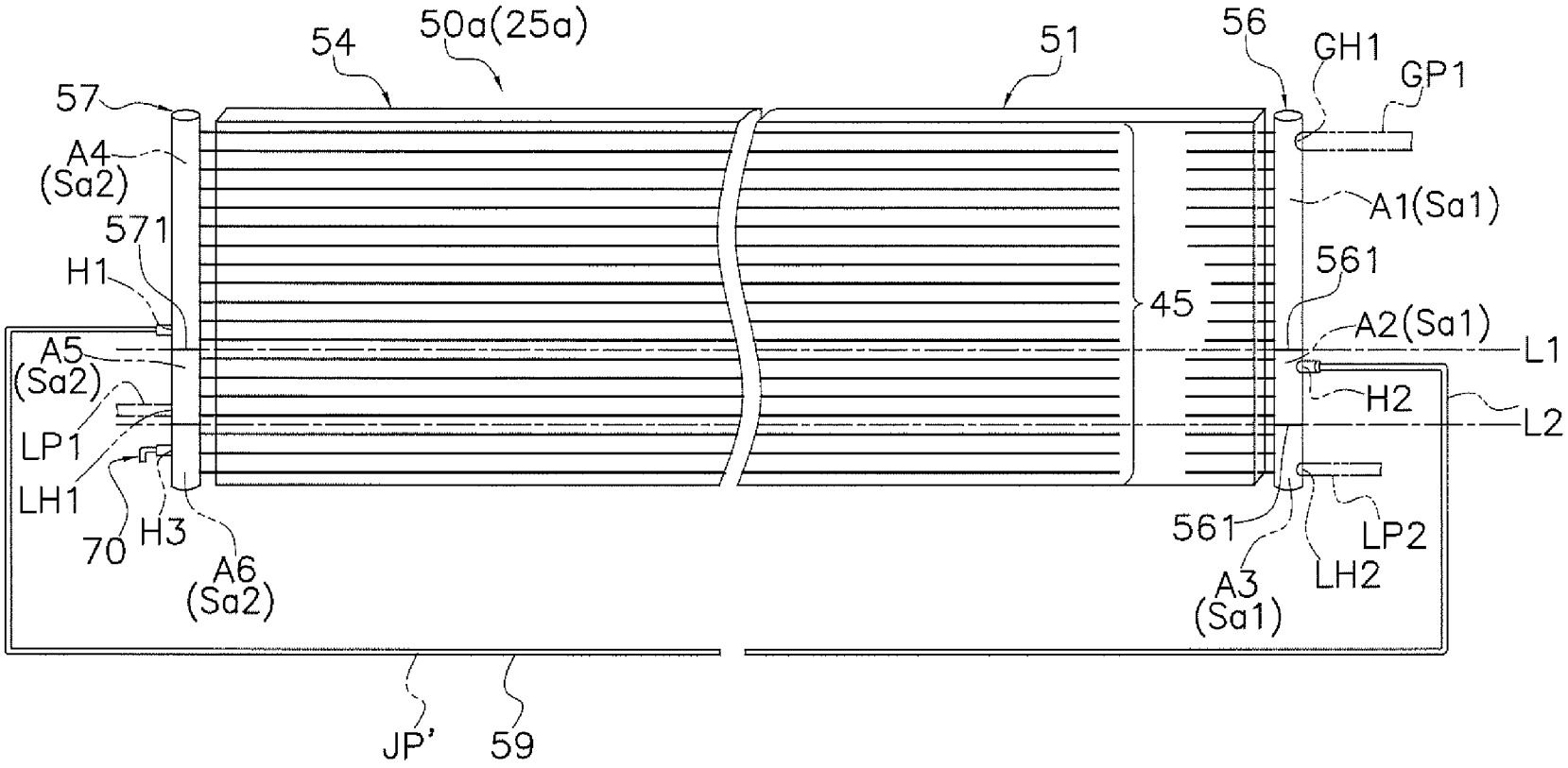
FIG. 17 is a schematic view schematically showing a mode of construction of an upwind heat-exchanging unit according to Modification 2.
Figure 18:
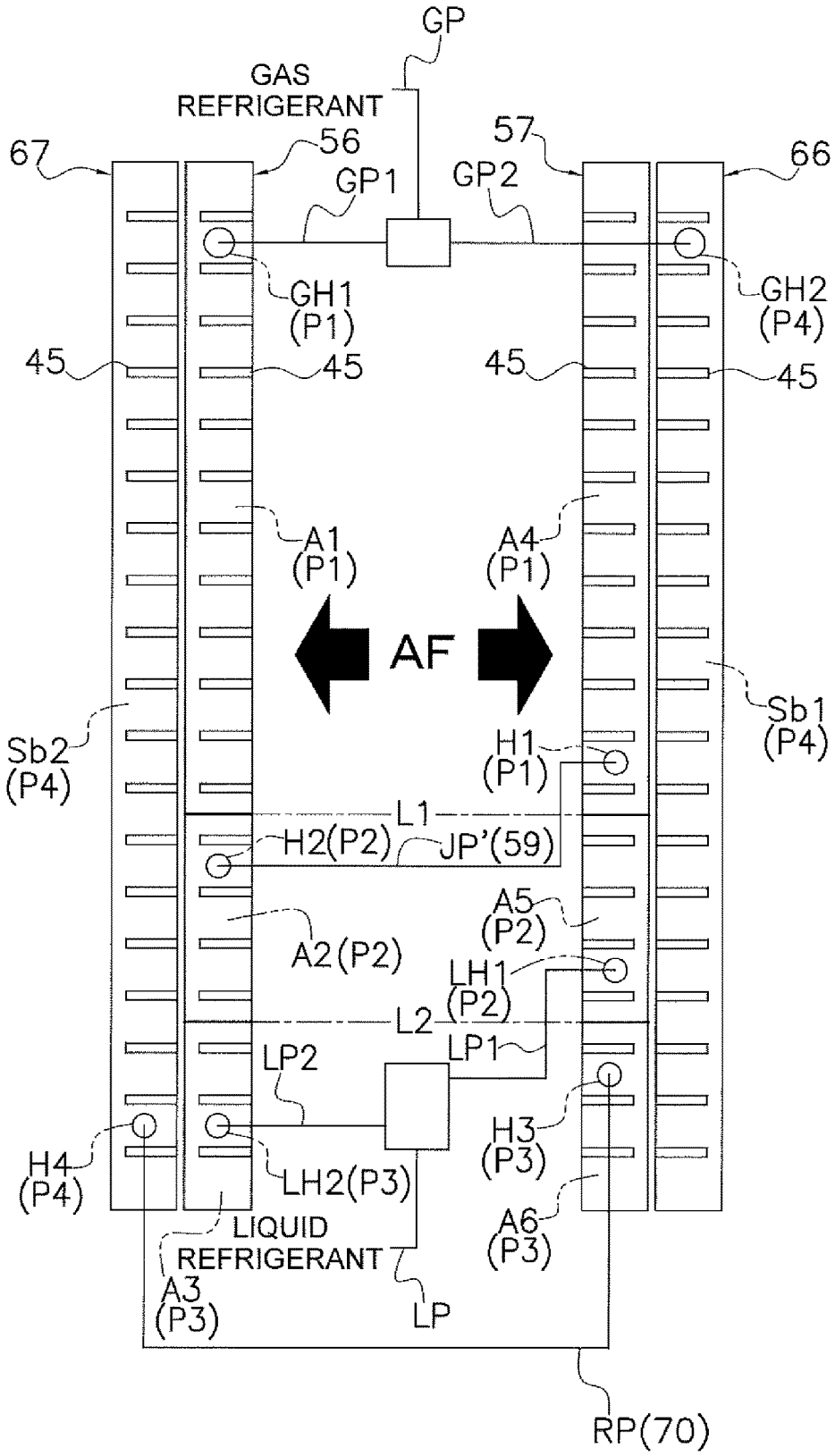
FIG. 18 is a schematic view schematically showing refrigerant paths that are formed in an indoor heat exchanger including the upwind heat-exchanging unit according to Modification 2.

In such a case, the upwind heat-exchanging unit 50 may be formed like an upwind heat-exchanging unit 50*a* shown in FIG. 17. FIG. 17 is a schematic view schematically showing a mode of construction of the upwind heat-exchanging unit 50*a*. FIG. 18 is a schematic view schematically showing refrigerant paths that are formed in an indoor heat exchanger 25*a* including the upwind heat-exchanging unit 50*a*.

The upwind heat-exchanging unit 50*a* includes a turn-around pipe 59 instead of the turn-around pipe 58. The turn-around pipe 59 (corresponding to "second communication path formation portion" in the claims) forms a turn-around flow path JP' (corresponding to "second communication path" in the claims) that allows the upwind fourth space A4 and the upwind second space A2 to communicate with each other. That is, in the upwind heat-exchanging unit 50*a*, the upwind fourth space A4 communicates with the upwind second space A2 instead of with the upwind fifth space A5 via the turn-around flow path JP' (turn-around pipe 59). In addition, in the upwind heat-exchanging unit 50*a*, the first liquid-side inlet/outlet LH1 communicates with the upwind fifth space A5 instead of with the upwind second space A2. The other configurations of the upwind heat-exchanging unit 50*a* are substantially the same as those of the upwind heat-exchanging unit 50.

Figure 19:
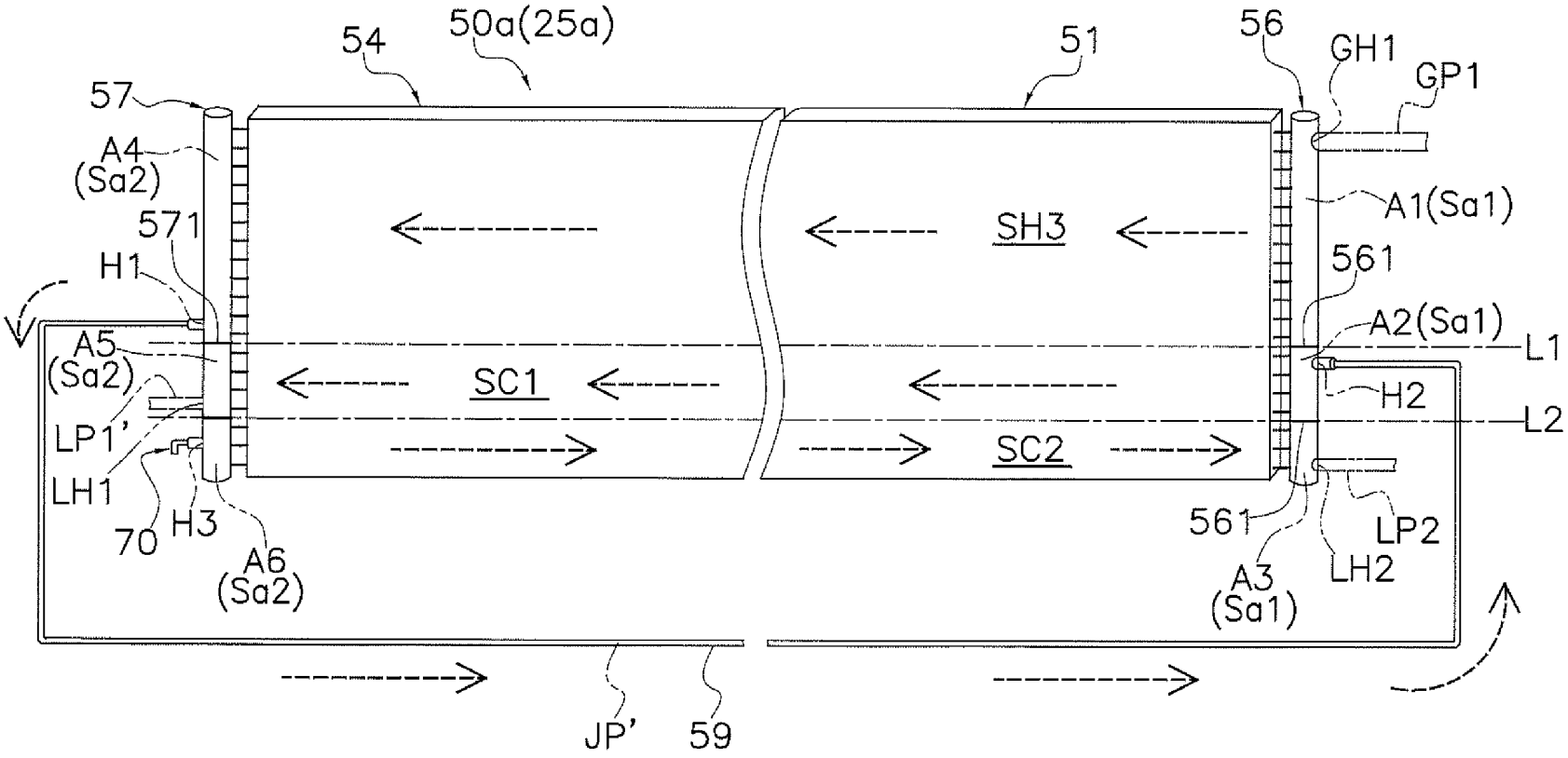
FIG. 19 is a schematic view schematically showing a flow of a refrigerant when a heating operation is performed in the upwind heat-exchanging unit according to Modification 2.

FIG. 19 is a schematic view schematically showing a flow of a refrigerant in the upwind heat-exchanging unit 50*a* when a heating operation is performed. In the indoor heat exchanger 25*a* that includes the upwind heat-exchanging unit 50*a*, when a heating operation is performed, in a refrigerant flow that is produced by the first path P1 and the second path P2, the refrigerant flows through the first gas-side inlet/outlet GH1, the upwind first space A1, the heat-transfer-tube flow paths 451 (heat transfer tubes 45) in the first path P1, the upwind fourth space A4, the turn-around flow path JP' (turn-around pipe 59), the upwind second space A2, the heat-transfer-tube flow paths 451 (heat transfer tubes 45) in the second path P2, the upwind fifth space A5, and the first liquid-side inlet/outlet LH1 in this order.

Therefore, at the upwind heat-exchanging unit 50*a*, when a heating operation is performed, an area in which a refrigerant that is in a subcooled state flows (subcooling area SC1) is formed at the heat-transfer-tube flow paths 451 in the second path P2 (in particular, the heat-transfer-tube flow paths 451 that are included at the second path P2 of the upwind fourth heat-exchange surface 54); and an area in which a refrigerant that is in a subcooled state flows (subcooling area SC2) is formed at the heat-transfer-tube flow paths 451 in the third path P3 (in particular, the heat-transfer-tube flow paths 451 that are included at the third path P3 of the upwind first heat-exchange surface 51).

At the indoor heat exchanger 25*a* that includes such an upwind heat-exchanging unit 50*a*, in the path that is formed by the upwind first space A1, the heat transfer tubes 45, the upwind fourth space A4, the turn-around flow path JP', the upwind second space A2, the heat transfer tubes 45, and the upwind fifth space A5 (that is, the path that is formed by the first path P1 and the second path P2), the upwind fourth space A4 in the upwind second header 57 and the upwind second space A2 in the upwind first header 56 are allowed to communicate with each other at the turn-around flow path JP'. Therefore, a refrigerant that flows through such a path is turned around at a location between the upwind fourth space A4 and the upwind second space A2. As a result, when the heat exchanger is used as a condenser of the refrigerant, construction of the downwind heat-exchanging unit 60 so that the superheating area SH3 of the refrigerant that flows through the upwind heat-exchanging unit 50*a* and a subcooling area SC2 of the refrigerant that flows through the downwind heat-exchanging unit 60 are not adjacent to each other one above another is facilitated. Therefore, heat exchange between the refrigerant that passes through the superheating area SH3 and the refrigerant that passes the subcooling area SC2 is reduced. In relation to this, this helps the degree of subcooling of the refrigerant in the subcooling area SC2 to be properly ensured.

Further, in the indoor heat exchanger 25*a* that includes the upwind heat-exchanging unit 50*a*, construction of the downwind heat-exchanging unit 60 so that the superheating area SH3 of the refrigerant that flows through the upwind heat-exchanging unit 50*a* and the subcooling area SC1 of the refrigerant that flows through the upwind heat-exchanging unit 50*a* are not adjacent to each other one above another is facilitated. Therefore, heat exchange between the refrigerant that passes through the superheating area SH3 and the refrigerant that passes through the subcooling area SC1 is reduced. In relation to this, this helps the degree of subcooling of the refrigerant in the subcooling area SC1 to be properly ensured. Therefore, in the indoor heat exchanger 25*a* that includes the upwind heat-exchanging unit 50*a*, further contribution is made to improving performance.

(6-3) Modification 3

In the above-described embodiments, the third path P3 is formed by allowing the third connection hole H3 to communicate with the upwind sixth space A6 and by allowing the second liquid-side inlet/outlet LH2 to communicate with the upwind third space A3. However, the third path P3 may be formed in other ways. For example, the third path P3 may be formed by allowing the third connection hole H3 to communicate with the upwind third space A3 and by allowing the second liquid-side inlet/outlet LH2 to communicate with the upwind sixth space A6.

Figure 20:
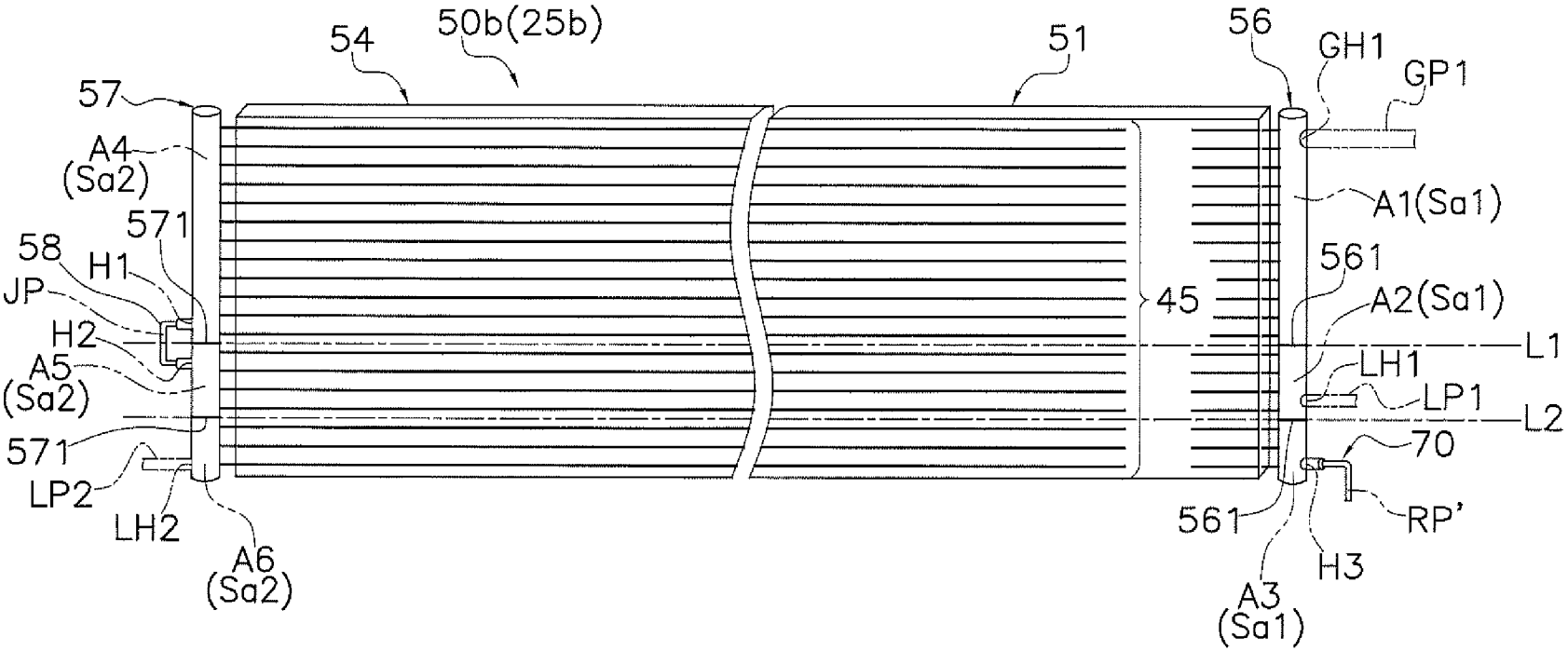
FIG. 20 is a schematic view schematically showing a mode of construction of an upwind heat-exchanging unit according to Modification 3.
Figure 21:
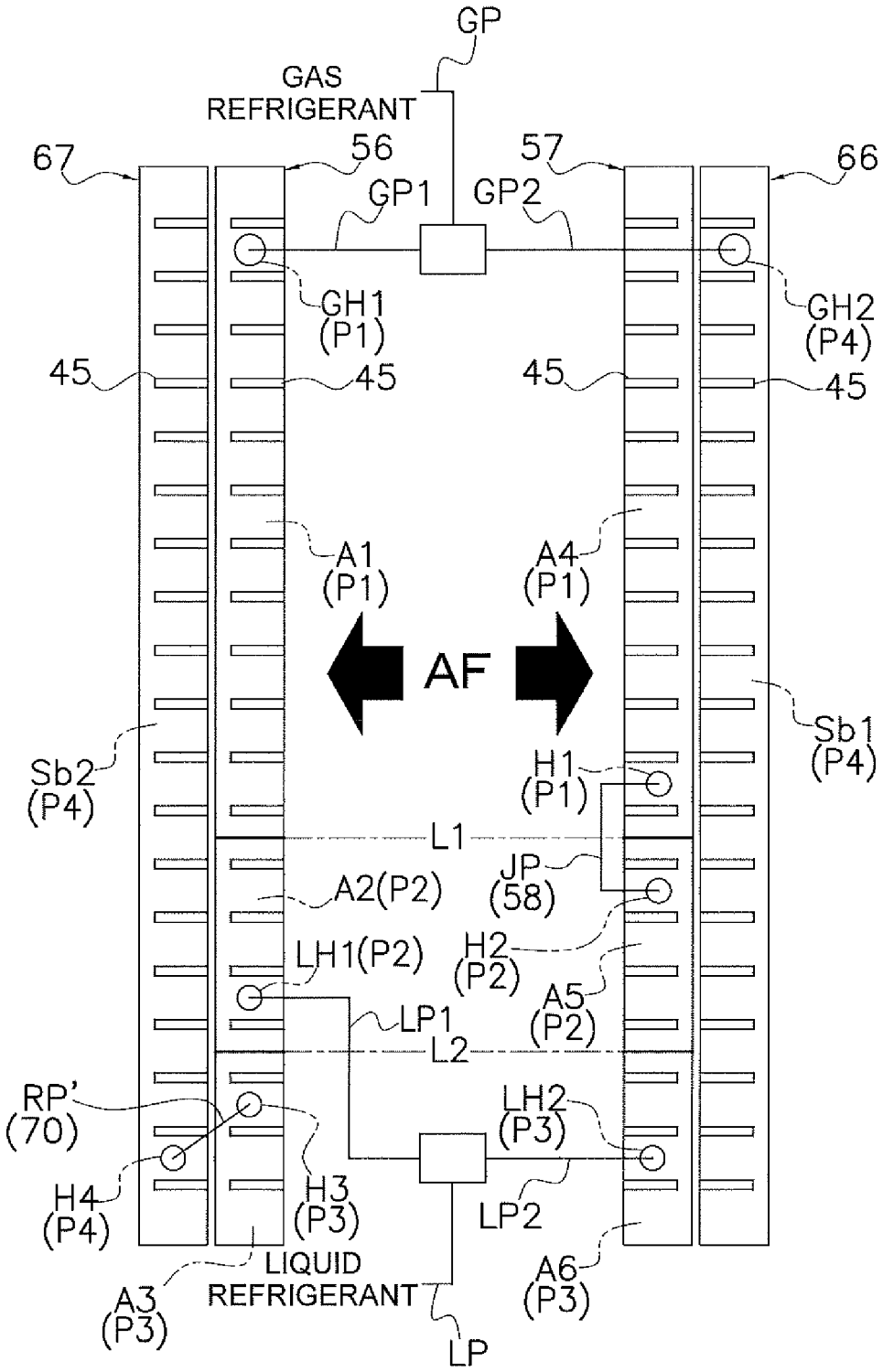
FIG. 21 is a schematic view schematically showing refrigerant paths that are formed in an indoor heat exchanger including the upwind heat-exchanging unit according to Modification 3.

In such a case, the upwind heat-exchanging unit 50 may be formed like an upwind heat-exchanging unit 50*b* shown in FIG. 20. FIG. 20 is a schematic view schematically showing a mode of construction of the upwind heat-exchanging unit 50*b*. FIG. 21 is a schematic view schematically showing refrigerant paths that are formed in an indoor heat exchanger 25*b* including the upwind heat-exchanging unit 50*b*.

In the upwind heat-exchanging unit 50*b*, the second liquid-side inlet/outlet LH2 is formed in the upwind third space A3 instead of in the upwind sixth space A6. In addition, in the upwind heat-exchanging unit 50*b*, the third connection hole H3 is formed in the upwind sixth space A6 instead of in the upwind third space A3. The other configurations of the upwind heat-exchanging unit 50*b* are substantially the same as those of the upwind heat-exchanging unit 50.

In the indoor heat exchanger 25*b* that includes the upwind heat-exchanging unit 50*b*, the connection pipe 70 forms a connection flow path RP' that allows the downwind second-header space Sb2 and the upwind third space A3 to communicate with each other.

Figure 22:
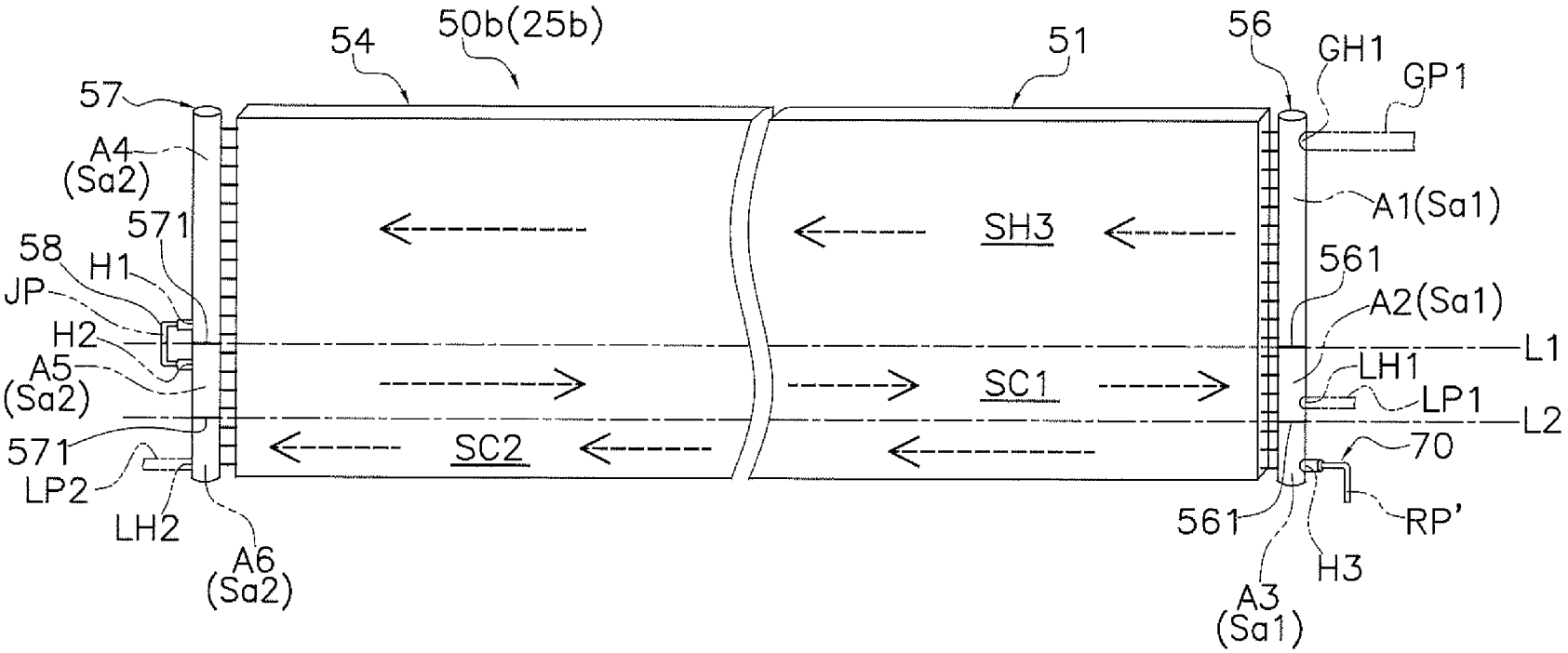
FIG. 22 is a schematic view schematically showing a flow of a refrigerant when a heating operation is performed in the upwind heat-exchanging unit according to Modification 3.

FIG. 22 is a schematic view schematically showing a flow of a refrigerant in the upwind heat-exchanging unit 50*b* when a heating operation is performed. At the indoor heat exchanger 25*b* that includes the upwind heat-exchanging unit 50*b*, when a heating operation is performed, in a refrigerant flow that is produced by the third path P3 and the fourth path P4, the refrigerant flows through the second gas-side inlet/outlet GH2, the downwind first-header space Sb1, the heat-transfer-tube flow paths 451 (heat transfer tubes 45) in the fourth path P4, the downwind second-header space Sb2, the connection flow path RP' (connection pipe 70), the upwind third space A3, the heat-transfer-tube flow paths 451 (heat transfer tubes 45) in the third path P3, the upwind sixth space A6, and the second liquid-side inlet/outlet LH2 in this order.

Even the indoor heat exchanger 25*b* that includes such an upwind heat-exchanging unit 50*b* can realize the same operational effects as those provided by the above-described embodiments. When a heating operation is performed, in the indoor heat exchanger 25*b* that includes the upwind heat-exchanging unit 50*b*, an area in which a refrigerant that is in a subcooled state flows (subcooling area SC2) is formed at the heat-transfer-tube flow paths 451 in the second path P2 (in particular, the heat-transfer-tube flow paths 451 that are included at the second path P2 of the upwind first heat-exchange surface 51); and an area in which a refrigerant that is in a subcooled state flows (subcooling area SC2) is formed at the heat-transfer-tube flow paths 451 in the third path P3 (in particular, the heat-transfer-tube flow paths 451 that are included at the third path P3 of the downwind fourth heat-exchange surface 64). In the indoor heat exchanger 25*b* that includes the upwind heat-exchanging unit 50*b*, as shown in FIG. 22, the direction of flow of the refrigerant that flows through the subcooling area SC1 and the direction of flow of the refrigerant that flows through the subcooling area SC2 are opposite to each other (that is, the flows are counterflows). In relation to this, temperature unevenness of the indoor air flow AF that passes the indoor heat exchanger 25*b* when a heating operation is performed is suppressed.

(6-4) Modification 4

In the above-described embodiments, the upwind first-header space Sa1 in the upwind first header 56 is formed so that the upwind first space A1, the upwind second space A2, and the upwind third space A3 are arranged side by side in this order from top to bottom. In addition, in the upwind second header 57, the upwind second header space Sa2 in the upwind second header 57 is formed so that the upwind fourth space A4, the upwind fifth space A5, and the upwind sixth space A6 are arranged side by side in this order from top to bottom. That is, the paths that are formed in the upwind heat-exchanging unit 50 are formed so that the first path P1 is positioned at the uppermost layer, the second path P2 is positioned at the intermediate layer, and the third path P3 is positioned at the lowermost layer.

However, the mode of formation of the upwind first-header space Sa1 and the upwind second-header space Sa2 and the mode of formation of the paths in the upwind heat-exchanging unit 50 are not necessarily limited thereto, and can be changed as appropriate in accordance with design specifications and installation environments as long as operational effects that are the same as those provided by the above-described embodiments can be realized.

For example, the upwind first-header space Sa1 may be formed so that the upwind first space A1, the upwind second space A2, and the upwind third space A3 are arranged side by side in this order from bottom to top. In such a case, also in the upwind second header 57, the upwind second-header space Sa2 is formed so that the upwind fourth space A4, the upwind fifth space A5, and the upwind sixth space A6 are arranged side by side in this order from bottom to top. As a result, the paths that are formed in the upwind heat-exchanging unit 50 are formed so that the first path P1 is positioned at the lowermost layer, the second path P2 is positioned at the intermediate layer, and the third path P3 is positioned at the uppermost layer.

For example, the upwind first-header space Sa1 may be formed so that the upwind second space A2, the upwind first space A1, and the upwind third space A3 are arranged side by side in this order from top to bottom. In such a case, also in the upwind second header 57, the upwind second-header space Sa2 is formed so that the upwind fifth space A5, the upwind fourth space A4, and the upwind sixth space A6 are arranged side by side in this order from top to bottom. As a result, the paths that are formed in the upwind heat-exchanging unit 50 are formed so that the second path P2 is positioned at the uppermost layer, the first path P1 is positioned at the intermediate layer, and the third path P3 is positioned at the lowermost layer.

When the positions of the paths are changed, the positions where the openings (GH1, GH2, LH1, LH2, and H1 to H4) that communicate with the paths are formed are also correspondingly changed as appropriate.

(6-5) Modification 5

Figure 23:
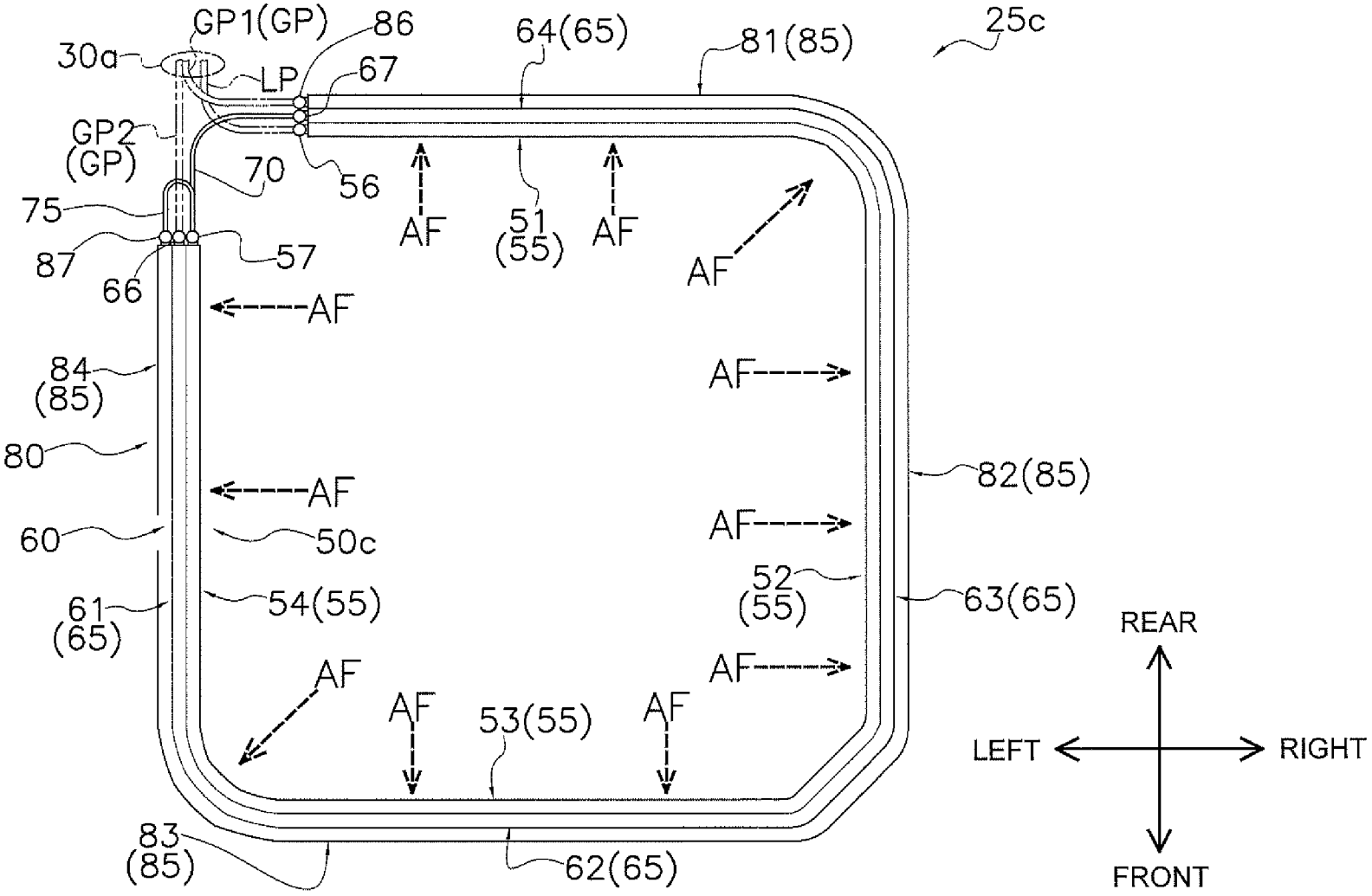
FIG. 23 is a schematic view schematically showing an indoor heat exchanger according to Modification 5 when viewed in a heat-transfer-tube lamination direction.
Figure 24:
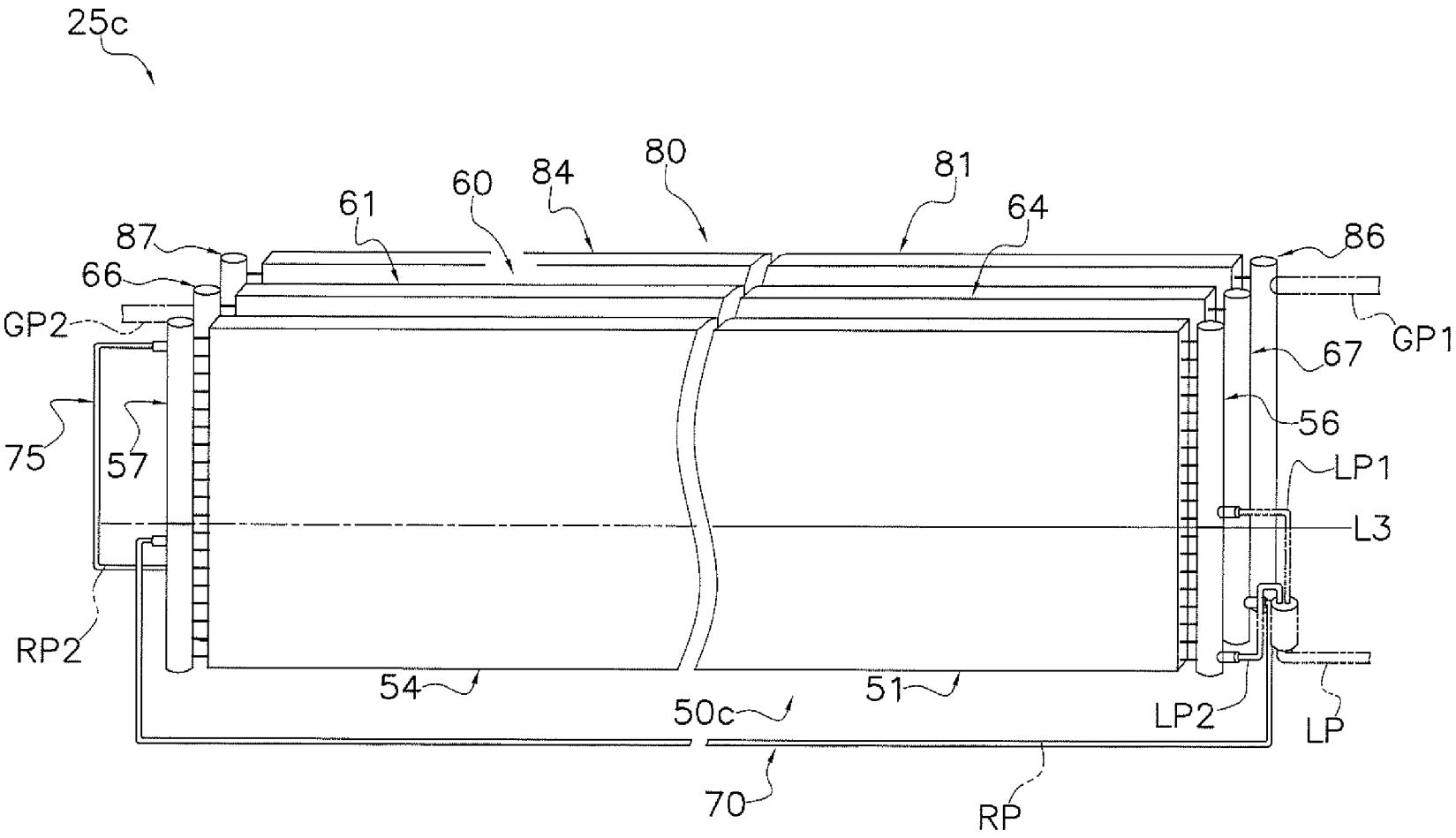
FIG. 24 is a schematic view schematically showing a mode of construction of the indoor heat exchanger according to Modification 5.

The indoor heat exchanger 25 according to the above-described embodiments may be formed like an indoor heat exchanger 25*c* shown in FIGS. 23 and 24. The indoor heat exchanger 25*c* is described below. In the description below, unless otherwise noted, explanations that are left out below can be interpreted as being substantially the same as those of the indoor heat exchanger 25.

Figure 25:
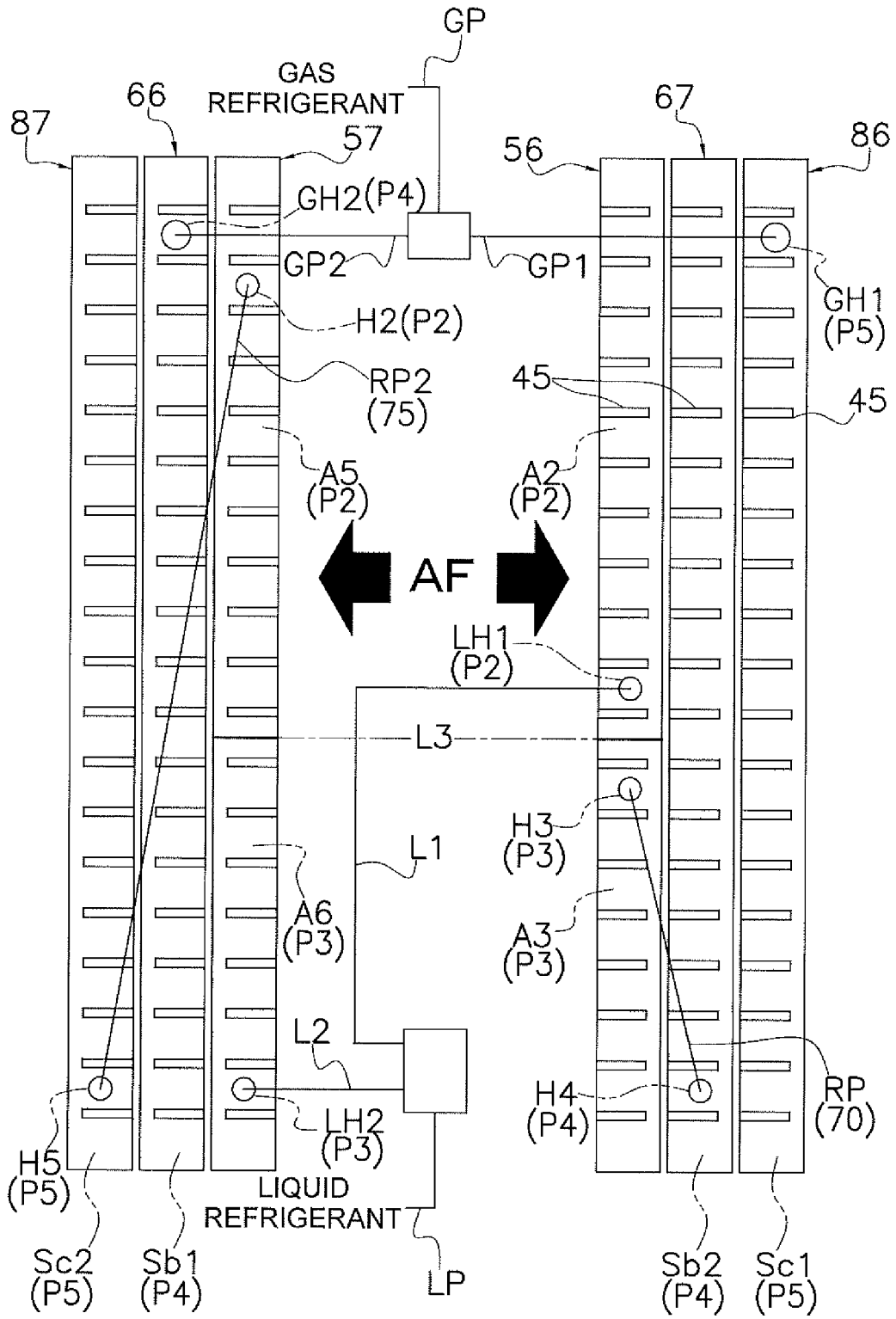
FIG. 25 is a schematic view schematically showing refrigerant paths that are formed in the indoor heat exchanger according to Modification 5.

FIG. 23 is a schematic view schematically showing the indoor heat exchanger 25*c* when viewed from the heat-transfer-tube lamination direction dr2. FIG. 24 is a schematic view schematically showing a mode of construction of the indoor heat exchanger 25*c*. FIG. 25 is a schematic view schematically showing refrigerant paths that are formed in the indoor heat exchanger 25*c*.

The indoor heat exchanger 25*c* includes an upwind heat-exchanging unit 50*c* instead of the upwind heat-exchanging unit 50. The indoor heat exchanger 25*c* includes a second downwind heat-exchanging unit 80 in addition to the downwind heat-exchanging unit 60. The indoor heat exchanger 25*c* includes a second connection pipe 75 in addition to the connection pipe 70.

Figure 26:
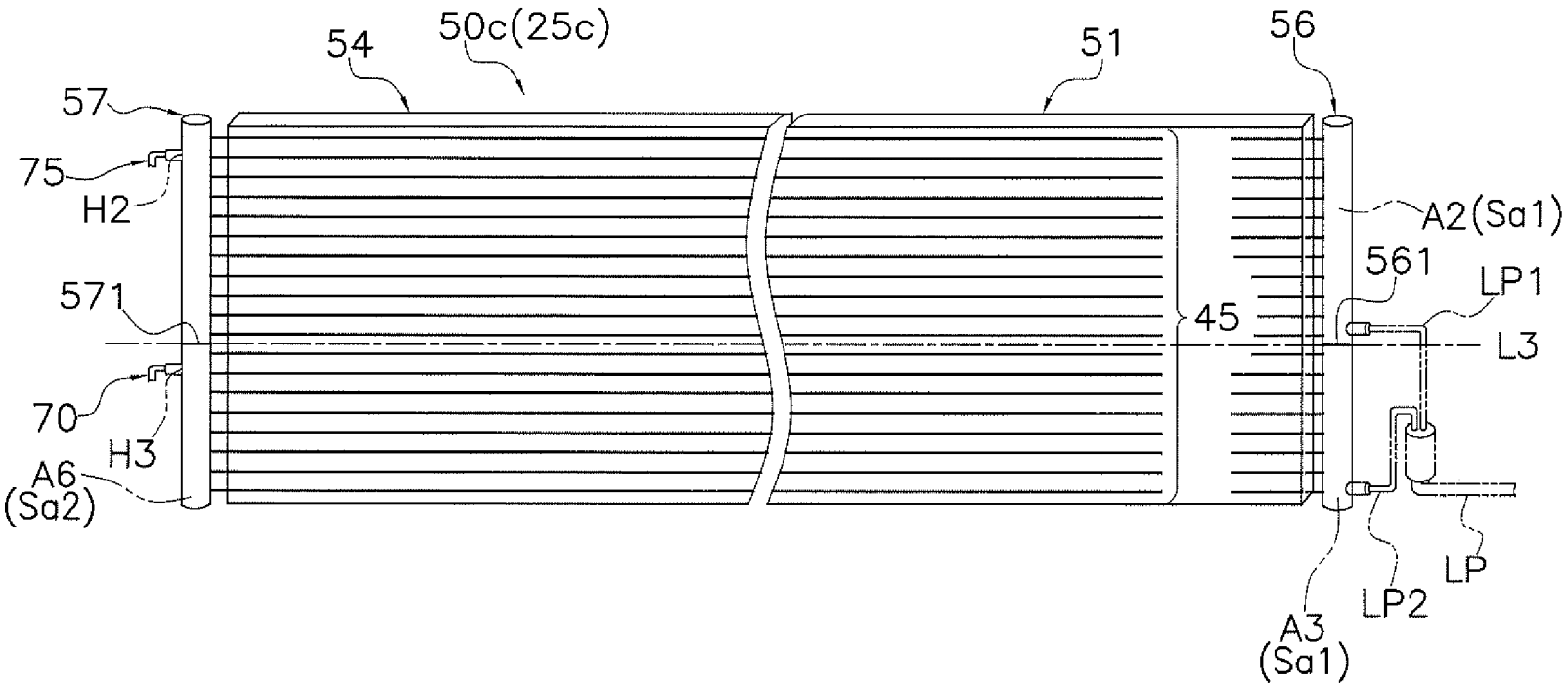
FIG. 26 is a schematic view schematically showing a mode of construction of an upwind heat-exchanging unit according to Modification 5.

FIG. 26 is a schematic view schematically showing a mode of construction of the upwind heat-exchanging unit 50*c*. At the upwind heat-exchanging unit 50*c*, in the upwind first header 56, only one horizontal partition plate 561 is disposed and the upwind first space A1 is omitted. At the upwind heat-exchanging unit 50*c*, also in the upwind second header 57, only one horizontal partition plate 571 is disposed and the upwind fourth space A4 is omitted. In relation to this, in the upwind heat-exchanging unit 50*c*, the first path P1 is omitted. Specifically, in the upwind heat-exchanging unit 50*c*, the second path P2 is formed above an alternate long and short dashed line L3 (FIGS. 23 and 24), and the third path P3 is formed below the alternate long and short dashed line L3.

The alternate long and short dashed line L3 in the present embodiments is positioned between the eleventh heat transfer tube 45 from the top and the twelfth heat transfer tube 45 from the top. That is, in the upwind heat-exchanging unit 50*c*, the second path P2 is formed so as to include the heat-transfer-tube flow paths 451 of the first to the eleventh heat transfer tubes 45 from the top, and the third path P3 is formed so as to include the heat-transfer-tube flow paths 451 of the twelfth to the last heat transfer tubes 45 from the top. However, the position of the alternate long and short dashed line L3 can be changed as appropriate (that is, the number of heat transfer tubes 45 that are included at the second path P2 and the third path P3 can be changed as appropriate).

In the upwind heat-exchanging unit 50*c*, the first connection hole H1 and the turn-around pipe 58 are omitted. In addition, in the upwind heat-exchanging unit 50*c*, the first gas-side inlet/outlet GH1 is omitted (the first gas-side inlet/outlet GH1 is formed in the second downwind heat-exchanging unit 80). In the upwind heat-exchanging unit 50*c*, the second connection hole H2 is formed so as to communicate with the vicinity of an upper end of the upwind fifth space A5, and one end of the second connection pipe 75 is connected to the second connection hole H2.

Figure 27:
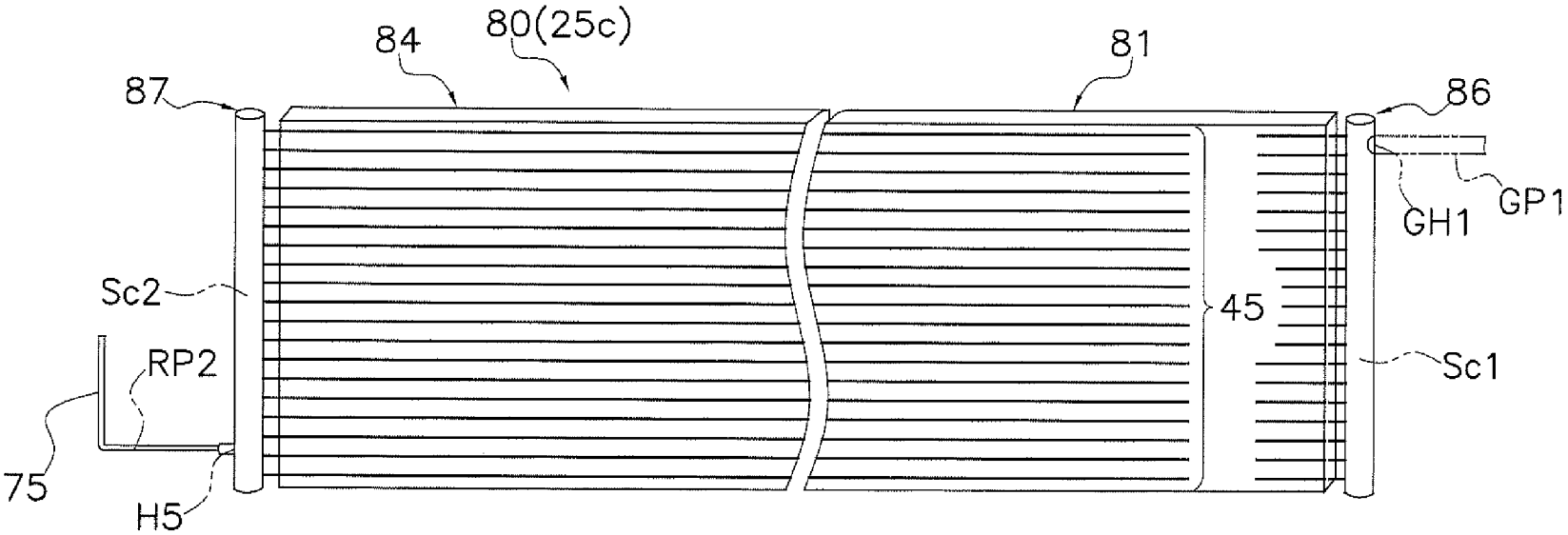
FIG. 27 is a schematic view schematically showing a mode of construction of a second downwind heat-exchanging unit according to Modification 5.

FIG. 27 is a schematic view schematically showing a mode of construction of the second downwind heat-exchanging unit 80. The second downwind heat-exchanging unit 80 is a heat-exchanging unit that is disposed on a downwind side of the downwind heat-exchanging unit 60 (that is, on a most downstream side in the air flow direction dr3). The second downwind heat-exchanging unit 80 primarily includes, as the heat-exchange surface 40, a most-downstream first heat-exchange surface 81, a most-downstream second heat-exchange surface 82, a most-downstream third heat-exchange surface 83, and a most-downstream fourth heat-exchange surface 84 (these are collectively referred to as "most-downstream heat-exchange surface 85"); a most-downstream first header 86; and a most-downstream second header 87.

In the most-downstream heat-exchange surface 85, the most-downstream first heat-exchange surface 81 (corresponding to "first portion" or "third portion" in the claims) is positioned on a most downstream side of a flow of a refrigerant when a cooling operation is performed, and is positioned on a most upstream side of a flow of a refrigerant when a heating operation is performed. When viewed in the heat-transfer-tube lamination direction dr2 (here, in plan view), the most-downstream first heat-exchange surface 81 has its terminating end connected to the most-downstream first header 86, and primarily extends from the left towards the right. The most-downstream first heat-exchange surface 81 is adjacent to a downwind side of the downwind fourth heat-exchange surface 64 in the air flow direction dr3. The most-downstream first heat-exchange surface 81 is positioned closer than the most-downstream second heat-exchange surface 82 and the most-downstream third heat-exchange surface 83 to the connection pipe insertion port 30*a*. More specifically, the most-downstream first heat-exchange surface 81 is positioned closer to the connection pipe insertion port 30*a* at its terminating end than at its leading end.

In the most-downstream heat-exchange surface 85, the most-downstream second heat-exchange surface 82 (corresponding to "second portion" in the claims) is positioned on an upstream side of a flow of a refrigerant at the most-downstream first heat-exchange surface 81 when a cooling operation is performed, and is positioned on a downstream side of a flow of a refrigerant at the most-downstream first heat-exchange surface 81 when a heating operation is performed. When viewed in the heat-transfer-tube lamination direction dr2, the most-downstream second heat-exchange surface 82 is connected to the leading end of the most-downstream first heat-exchange surface 81 while a terminating end of the most-downstream second heat-exchange surface 82 is curved, and primarily extends from the rear towards the front. The most-downstream second heat-exchange surface 82 is adjacent to a downwind side of the downwind third heat-exchange surface 63 in the air flow direction dr3.

In the most-downstream heat-exchange surface 85, the most-downstream third heat-exchange surface 83 is positioned on an upstream side of a flow of a refrigerant at the most-downstream second heat-exchange surface 82 when a cooling operation is performed, and is positioned on a downstream side of a flow of a refrigerant at the most-downstream second heat-exchange surface 82 when a heating operation is performed. When viewed in the heat-transfer-tube lamination direction dr2, the most-downstream third heat-exchange surface 83 is connected to a leading end of the most-downstream second heat-exchange surface 82 while a terminating end of the most-downstream third heat-exchange surface 83 is curved, and primarily extends from the right towards the left. The most-downstream third heat-exchange surface 83 is adjacent to a downwind side of the downwind second heat-exchange surface 62 in the air flow direction dr3.

In the most-downstream heat-exchange surface 85, the most-downstream fourth heat-exchange surface 84 (corresponding to "fourth portion" in the claims) is positioned on an upstream side of a flow of a refrigerant at the most-downstream third heat-exchange surface 83 when a cooling operation is performed, and is positioned on a downstream side of a flow of a refrigerant at the most-downstream third heat-exchange surface 83 when a heating operation is performed. When viewed in the heat-transfer-tube lamination direction dr2, the most-downstream fourth heat-exchange surface 84 is connected to a leading end of the most-downstream third heat-exchange surface 83 while a terminating end of the most-downstream fourth heat-exchange surface 84 is curved, and primarily extends from the front towards the rear. A leading end of the most-downstream fourth heat-exchange surface 84 is connected to the most-downstream second header 87. The most-downstream fourth heat-exchange surface 84 is adjacent to a downwind side of the downwind first heat-exchange surface 61 in the air flow direction dr3. The most-downstream fourth heat-exchange surface 84 is positioned closer than the most-downstream second heat-exchange surface 82 and the most-downstream third heat-exchange surface 83 to the connection pipe insertion port 30*a*. More specifically, the most-downstream fourth heat-exchange surface 84 is positioned closer to the connection pipe insertion port 30*a* at its leading end than at its terminating end.

By including such a most-downstream first heat-exchange surface 81, most-downstream second heat-exchange surface 82, most-downstream third heat-exchange surface 83, and most-downstream fourth heat-exchange surface 84, when viewed in the heat-transfer-tube lamination direction dr2, the most-downstream heat-exchange surface 85 of the second downwind heat-exchanging unit 80 is bent or curved at three or more locations to form a substantially square shape. That is, the second downwind heat-exchanging unit 80 includes the most-downstream heat-exchange surface 85 having four faces.

The most-downstream first header 86 (corresponding to "first header" in the claims) is a header collecting pipe that functions as, for example, a dividing header that divides a refrigerant to pass through each heat transfer tube 45, a merging header that merges the refrigerants that flow out from the respective heat transfer tubes 45, or a turn-around header for allowing the refrigerants that flow out from the respective heat transfer tubes 45 to turn around to other heat transfer tubes 45. In an installed state, a longitudinal direction of the most-downstream first header 86 is a vertical direction (up-down direction). The most-downstream first header 86 is formed in a cylindrical shape, and a space is formed in the most-downstream first header 86 (hereunder called "most-downstream first-header space Sc1" corresponding to "first-header space" in the claims). The most-downstream first header 86 is positioned on a most downstream side of a flow of a refrigerant in the second downwind heat-exchanging unit 80 when a cooling operation is performed, and is positioned on a most upstream side of a flow of a refrigerant in the second downwind heat-exchanging unit 80 when a heating operation is performed. The most downstream first header 86 is connected to a terminating end of the most-downstream first heat-exchange surface 81. The most-downstream first header 86 is connected to one end of each heat transfer tube 45 that is included at the most-downstream first heat-exchange surface 81, and allows the heat transfer tubes 45 and the most-downstream first-header space Sc1 to communicate with each other. The most-downstream first header 86 is adjacent to a downwind side of the downwind second header 67 in the air flow direction dr3. The first gas-side inlet/outlet GH1 is formed in the most-downstream first header 86. The first gas-side inlet/outlet GH1 communicates with the most-downstream first-header space Sc1. The first gas-side connection pipe GP1 is connected to the first gas-side inlet/outlet GH1.

The most-downstream second header 87 (corresponding to "second header" in the claims) is a header collecting pipe that functions as, for example, a dividing header that divides a refrigerant to pass through each heat transfer tube 45, a merging header that merges the refrigerants that flow out from the respective heat transfer tubes 45, or a turn-around header for allowing the refrigerants that flow out from the respective heat transfer tubes 45 to turn around to other heat transfer tubes 45. In an installed state, a longitudinal direction of the most-downstream second header 87 is a vertical direction (up-down direction). The most-downstream second header 87 is formed in a cylindrical shape, and a space is formed in the most-downstream second header 87 (hereunder called "most-downstream second-header space Sc2" corresponding to "second-header space" in the claims). The most-downstream second-header space Sc2 is positioned on a most upstream side of a flow of a refrigerant in the second downwind heat-exchanging unit 80 when a cooling operation is performed, and is positioned on a most downstream side of a flow of a refrigerant in the second downwind heat-exchanging unit 80 when a heating operation is performed. The most-downstream second header 87 is connected to the leading end of the most-downstream fourth heat-exchange surface 84. The most-downstream second header 87 is connected to one end of each heat transfer tube 45 that is included at the most-downstream fourth heat-exchange surface 84, and allows the heat transfer tubes 45 and the most-downstream second-header space Sc2 to communicate with each other. The most-downstream second header 87 is adjacent to a downwind side of the downwind first header 66 in the air flow direction dr3. A fifth connection hole H5 for connecting the other end of the second connection pipe 75 thereto is formed in the most-downstream second header 87. The fifth connection hole H5 communicates with the most-downstream second header space Sc2. The other end of the second connection pipe 75 is connected to the fifth connection hole H5 so that the most-downstream second-header space Sc2 and the upwind fifth space A5 communicate with each other. The most-downstream second-header space Sc2 that communicates with the second connection pipe 75 corresponds to "downwind downstream-side space" in the claims.

The second connection pipe 75 is a refrigerant pipe that forms a second connection flow path RP2 between the upwind heat-exchanging unit 50*c* and the second downwind heat-exchanging unit 80. The second connection flow path RP2 (corresponding to "second refrigerant flow path" in the claims) is a refrigerant flow path that allows the most-downstream second-header space Sc2 and the upwind fifth space A5 to communicate with each other. One end of the second connection pipe 75 is connected to the second connection hole H2, and the other end of the second connection pipe 75 is connected to the fifth connection hole H5. By forming the second connection flow path RP2 by the second connection pipe 75, a refrigerant flows from the upwind fifth space A5 towards the most-downstream second-header space Sc2 when a cooling operation is performed, and a refrigerant flows from the most-downstream second-header space Sc2 towards the upwind fifth space A5 when a heating operation is performed.

In the indoor heat exchanger 25*c*, a fifth path P5 is formed in addition to the second path P2, the third path P3, and the fourth path P4. The fifth path P5 is formed in the second downwind heat-exchanging unit 80. The fifth path P5 is a refrigerant flow path that is formed by allowing the first gas-side inlet/outlet GH1 to communicate with the most-downstream first-header space Sc1, the most-downstream first-header space Sc1 to communicate with the most-downstream second-header space Sc2 via the heat-transfer-tube flow paths 451 (heat transfer tubes 45), and the most-downstream second-header space Sc2 to communicate with the fifth connection hole H5. That is, the fifth path P5 is a refrigerant flow path that includes the first gas-side inlet/outlet GH1, the most-downstream first-header space Sc1 in the most-downstream first header 86, the heat-transfer-tube flow paths 451 in the heat transfer tubes 45, the most-downstream second-header space Sc2 in the most-downstream second header 87, and the fifth connection hole H5. The fifth path P5 communicates with the second path P2 via the second connection flow path RP2 (second connection pipe 75).

Figure 28:
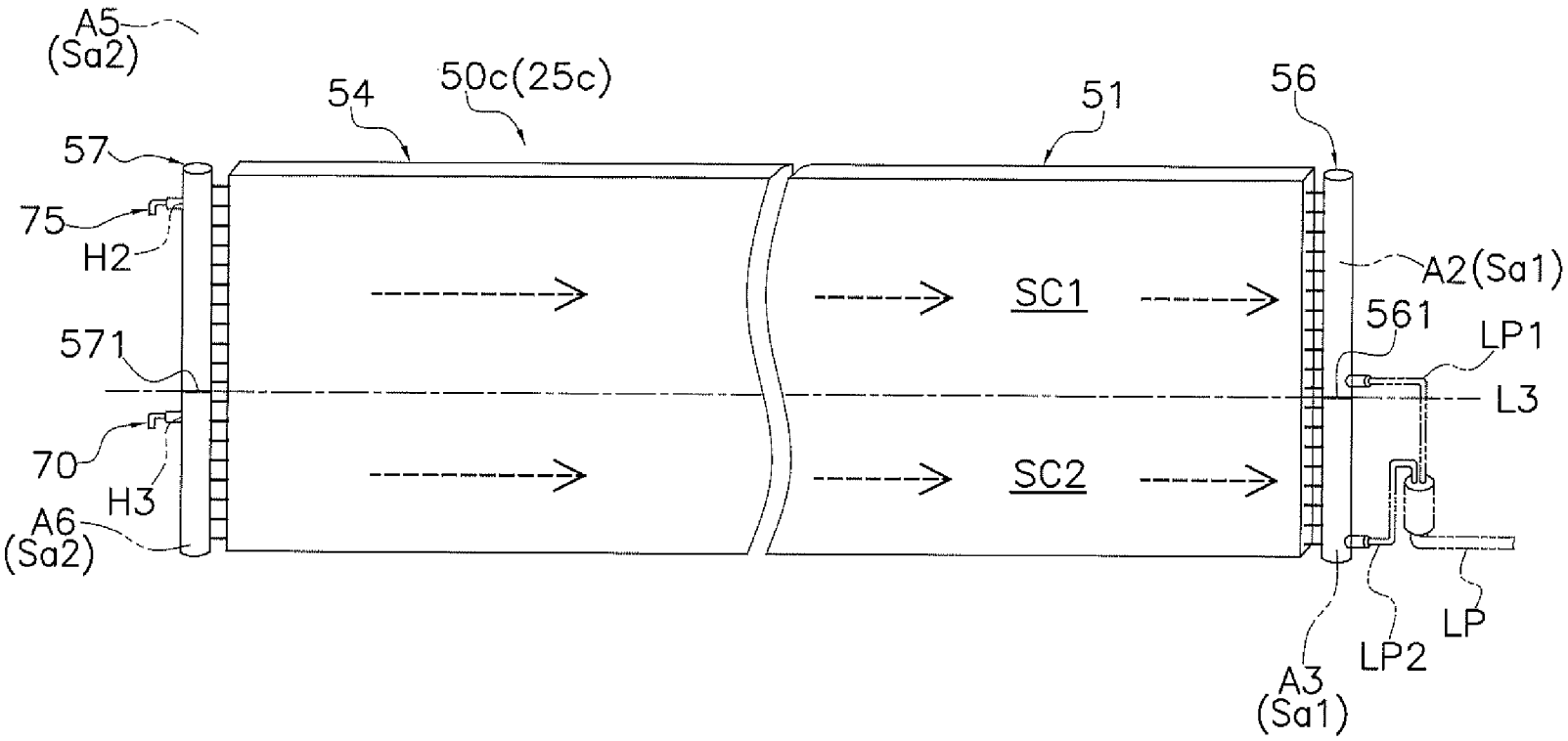
FIG. 28 is a schematic view schematically showing a flow of a refrigerant when a heating operation is performed in the upwind heat-exchanging unit according to Modification 5.
Figure 29:
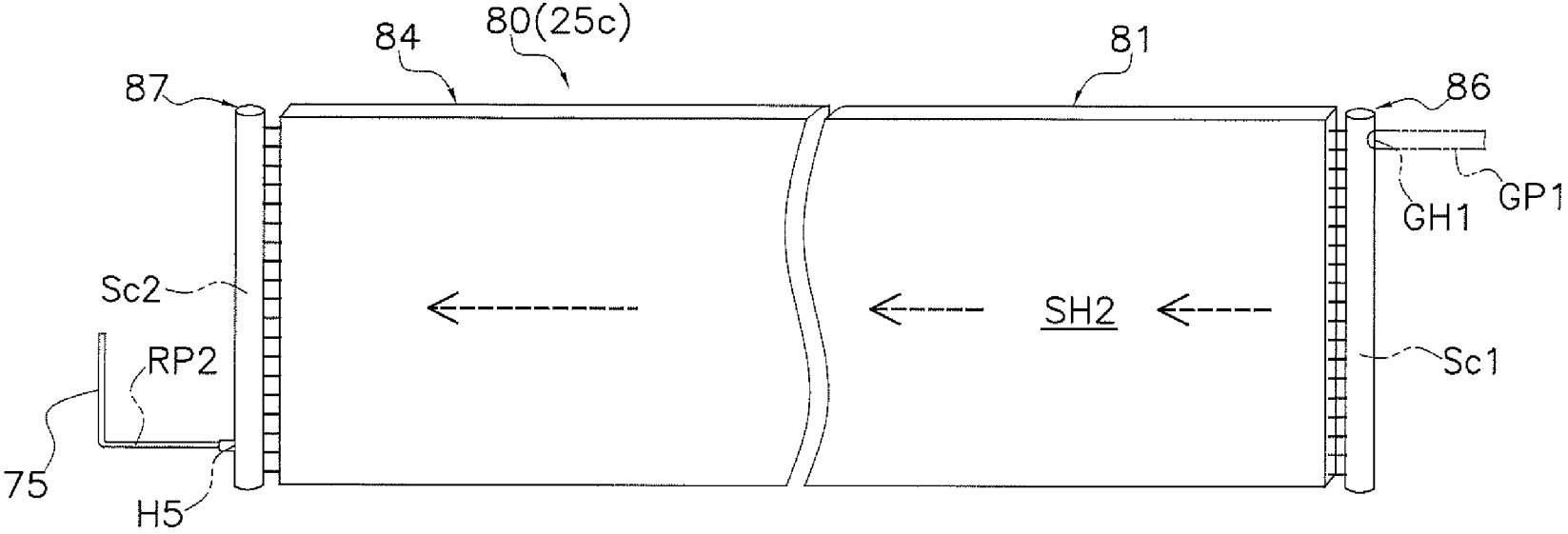
FIG. 29 is a schematic view schematically showing a flow of a refrigerant when a heating operation is performed in the second downwind heat-exchanging unit according to Modification 5.

FIG. 28 is a schematic view schematically showing a flow of a refrigerant in the upwind heat-exchanging unit 50*c* when a heating operation is performed. FIG. 29 is a schematic view schematically showing a flow of a refrigerant in the second downwind heat-exchanging unit 80 when a heating operation is performed. In the indoor heat exchanger 25*c*, when a heating operation is performed, in a refrigerant flow that is produced by the second path P2 and the fifth path P5, the refrigerant flows through the first gas-side inlet/outlet GH1, the most-downstream first-header space Sc1, heat-transfer-tube flow paths 451 (heat transfer tubes 45) in the fifth path P5, the most-downstream second-header space Sc2, the second connection flow path RP2 (second connection pipe 75), the upwind fifth space A5, the heat-transfer-tube flow paths 451 (heat transfer tubes 45) in the second path P2, the upwind second space A2, and the first liquid-side inlet/outlet LH1 in this order.

When a heating operation is performed, in the indoor heat exchanger 25*c*, an area in which a refrigerant in a subcooled state flows (subcooling area SC1) is formed at the heat-transfer-tube flow paths 451 in the second path P2 (in particular, the heat-transfer-tube flow paths 451 that are included at the second path P2 of the upwind first heat-exchange surface 51); and an area in which a refrigerant in a subcooled state flows (subcooling area SC2) is formed at the heat-transfer-tube flow paths 451 in the third path P3 (in particular, the heat-transfer-tube flow paths 451 that are included at the third path P3 of the upwind first heat-exchange surface 51).

In the indoor heat exchanger 25*c*, when a flat-tube heat exchanger having three or more rows and including a plurality of downwind heat-exchanging units (60 and 80) is used as a condenser of a refrigerant, subcooling areas of a refrigerant that flows through each downwind heat-exchanging unit (60 and 80) are arranged mainly in the upwind heat-exchanging unit 50*c*. Therefore, in the flat-tube heat exchanger having three or more rows and including the plurality of downwind heat-exchanging units (60 and 80), regarding the refrigerant that flows through the downwind heat-exchanging units (60 and 80), this helps the degree of subcooling to be properly ensured.

By individually forming the refrigerant inlets (the first gas-side inlet/outlet GH1 and the second gas-side inlet/outlet GH2) in each of the downwind heat-exchanging units (60 and 80), when the heat exchanger is used as a condenser of a refrigerant, the indoor heat exchanger 25*c* can be formed so that the superheating area and the subcooling area are not adjacent to each other one above another. As a result, heat exchange between the refrigerant that passes through the superheating area and the refrigerant that passes through the subcooling area is reduced. In relation to this, this further helps the degree of subcooling of the refrigerant in the subcooling area to be properly ensured. Therefore, a reduction in performance is further suppressed.

At the indoor heat exchanger 25*c*, when a heating operation is performed, in the upwind heat-exchanging unit 50*c*, since a superheating area is not formed, a superheating area and subcooling areas are not adjacent to each other one above another, and thus heat exchange between the refrigerant that passes through the superheating area and the refrigerant that passes through the subcooling areas is particularly reduced. In relation to this, this particularly helps the degree of subcooling of the refrigerant in the subcooling areas (SC1 and SC2) to be properly ensured.

In the indoor heat exchanger 25*c*, the connection flow path RP corresponds to "first refrigerant flow path" in the claims.

In the indoor heat exchanger 25*c*, by changing the position of the fifth connection hole H5 and the position of the first liquid-side inlet/outlet LH1 in the upwind heat-exchanging unit 50*c*, or by changing the position of the third connection hole H3 and the second liquid-side inlet/outlet LH2 in the upwind heat-exchanging unit 50*c*, the direction of flow of the refrigerant that flows through the subcooling area SC1 and the direction of flow of the refrigerant that flows through the subcooling area SC2 can be made opposite to each other.

Figure 30:
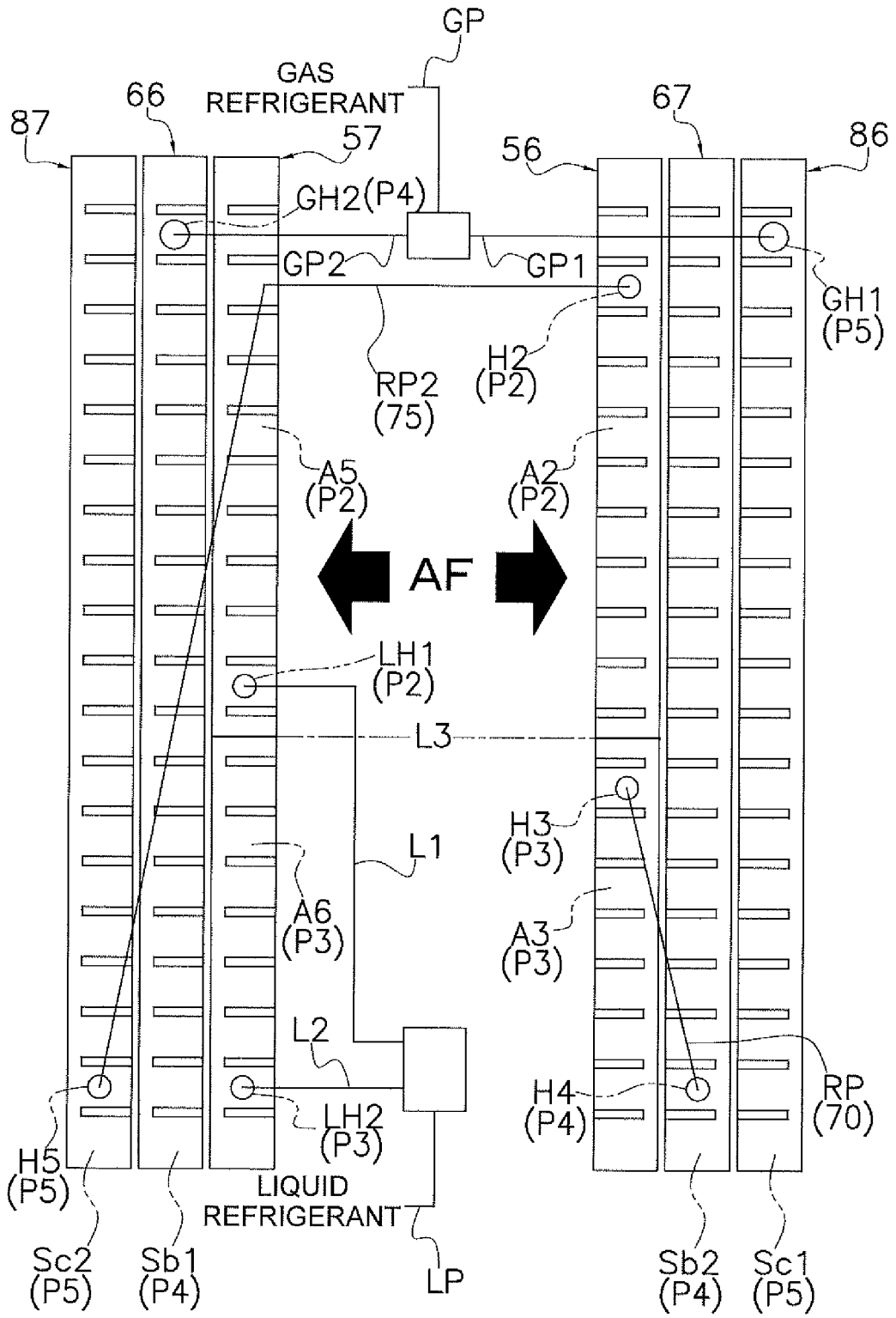
FIG. 30 is a schematic view schematically showing other refrigerant paths that may be formed in the indoor heat exchanger according to Modification 5.

For example, as shown in FIG. 30, in the upwind heat-exchanging unit 50*c*, by forming the second connection hole H2 in the upwind second space A2 and by forming the second liquid-side inlet/outlet LH2 in the upwind fifth space A5, it is possible for the direction of flow of the refrigerant that flows through the subcooling area SC1 and the direction of flow of the refrigerant that flows through the subcooling area SC2 to be opposite to each other. As a result, in the air flow AF that has passed the indoor heat exchanger 25*c*, the ratio of air that has sufficiently exchanged heat with the refrigerant to air that has not sufficiently exchanged heat with the refrigerant is maintained not to become significantly unbalanced regardless of portions where the air passes through. Therefore, temperature unevenness of air that has passed the indoor heat exchanger 25*c* is suppressed.

In this way, at the indoor heat exchanger 25*c*, in the second path P2, the space with which the fifth connection hole H5 communicates and the space with which the first liquid-side inlet/outlet LH1 communicates may be exchanged as appropriate. At the indoor heat exchanger 25*c*, in the third path P3, the space with which the third connection hole H3 communicates and the space with which the second liquid-side input/output LH2 communicates may be exchanged as appropriate.

At the indoor heat exchanger 25*c*, in the fourth path P4, the space with which the fourth connection hole H4 communicates and the space with which the second gas-side inlet/outlet GH2 communicates may be exchanged as appropriate. At the indoor heat exchanger 25*c*, in the fifth path P5, the space with which the fifth connection hole H5 communicates and the space with which the first gas-side inlet/outlet GH1 communicates may be exchanged as appropriate.

By disposing the second downwind heat-exchanging unit 80, the indoor heat exchanger 25*c* is formed as a flat-tube heat exchanger having three rows. However, the indoor heat exchanger 25*c* may be formed as a flat-tube heat exchanger having four or more rows and including a new downwind heat-exchanging unit in addition to the downwind heat-exchanging unit 60 and the second downwind heat-exchanging unit 80. In such a case, in accordance with an increase in the number of downwind heat-exchanging units, the number of paths in the upwind heat-exchanging unit 50*c* is increased, and a new second connection pipe 75 is further installed to further form a new second connection flow path RP2 thereby allowing communication between paths in the new downwind heat-exchanging unit and paths in the upwind heat-exchanging unit 50*c* so that, regarding a refrigerant that passes through the new downwind heat-exchanging unit, a subcooling area can be formed at the upwind heat-exchanging unit 50*c*. That is, even when the heat exchanger is formed as a flat-tube heat exchanger having four or more rows, the same operational effects as those provided by the above-described embodiments can be realized.

(6-6) Modification 6

In the above-described embodiments, the connection flow path RP is formed by the connection pipe 70. However, the mode of formation of the connection flow path RP is not necessarily limited thereto, and can be changed as appropriate in accordance with design specifications and installation environments.

For example, when the header collecting pipe (in the above-described embodiments, the upwind second header 57) in which the space that communicates with the connection flow path RP (in the above-described embodiments, the upwind sixth space A6) is formed in the upwind heat-exchanging unit 50 and the header collecting pipe (in the above-described embodiments, the downwind second header 67) in which the space that communicates with the connection flow path RP (in the above-described embodiments, the downwind second-header space Sb2) is formed in the downwind heat-exchanging unit 60 are integrally formed, and when the internal space of this integrated header collecting pipe is partitioned by a partition plate extending in the longitudinal direction of the header, both of the resulting spaces may communicate with each other via an opening that is formed in the partition plate. In such a case, the opening that is formed in the partition plate corresponds to "refrigerant flow path" in the claims, and the partition plate in which the opening is formed corresponds to "refrigerant flow path formation portion". The second connection flow path RP2 according to the above-described Modification 5 can also be similarly changed. In addition, the turn-around flow path JP' according to the above-described Modification 2 can also be similarly changed.

(6-7) Modification 7

In the above-described embodiments, the turn-around flow path JP is formed by the turn-around pipe 58. However, the mode of formation of the turn-around flow path JP is not necessarily limited thereto, and can be changed as appropriate in accordance with design specifications and installation environments.

For example, in the upwind heat-exchanging unit 50, an opening may be formed in the partition plate (in the above-described embodiments, the horizontal partition plate 571) that partitions both spaces (in the above-described embodiments, the upwind fourth space A4 and the upwind fifth space A5) that communicate with each other at the turn-around flow path JP to allow both spaces to communicate with each other via the opening. In such a case, the opening that is formed in the partition plate corresponds to "communication path" in the claims, and the partition plate in which the opening is formed corresponds to "communication path formation portion" in the claims.

(6-8) Modification 8

In the above-described embodiments, the case in which the upwind heat-exchanging unit 50 and the downwind heat-exchanging unit 60 each include the heat-exchange surface 40 (upwind heat-exchange surface 55 or downwind heat-exchange surface 65) having four faces is described. However, the number of faces of the heat-exchange surface 40 of the upwind heat-exchanging unit 50 and the number of faces of the heat-exchange surface 40 of the downwind heat-exchanging unit 60 are not limited, can be changed as appropriate in accordance with design specifications and installation environments, and may be three or less or five or more.

For example, the upwind heat-exchanging unit 50 and the downwind heat-exchanging unit 60 may each include heat-exchange surface 40 having two faces. Even in such a case, advantageous effects that are the same as those provided by the above-described embodiments can be realized. In particular, by forming the upwind heat-exchanging unit 50 and the downwind heat-exchanging unit 60 so as to have a substantially V shape in plan view or side view, the operational effects described in (5-8) above can also be realized (in such a case, in each of the upwind heat-exchanging unit 50 and the downwind heat-exchanging unit 60, one face of the heat-exchange surface 40 corresponds to "first portion", and the other face of the heat-exchange surface 40 corresponds to "second portion").

The upwind heat-exchanging unit 50 and the downwind heat-exchanging unit 60 may each include the heat-exchange surface 40 having three faces. Even in such a case, advantageous effects that are the same as those provided by the above-described embodiments can be realized. In particular, by forming the upwind heat-exchanging unit 50 and the downwind heat-exchanging unit 60 so as to have a substantially U shape in plan view or side view, the operational effects described in (5-8) above can also be realized (in such a case, in each of the upwind heat-exchanging unit 50 and the downwind heat-exchanging unit 60, one face of the heat-exchange surface 40 to which one of the header collecting pipes is connected corresponds to "first portion", and the other face of the heat-exchange surface 40 to which the other header collecting pipe is connected corresponds to "second portion").

The upwind heat-exchanging unit 50 and the downwind heat-exchanging unit 60 may each include the heat-exchange surface 40 having only one face. Even in such a case, advantageous effects that are the same as those provided by the above-described embodiments can be realized (except the operational effects described in (5-7) above).

(6-9) Modification 9

In the above-described embodiments, the gas-side connection pipes GP (GP1 and GP2) are each individually connected to a corresponding one of the first gas-side inlet/outlet GH1 of the upwind heat-exchanging unit 50 and second gas-side inlet/outlet GH2 of the downwind heat-exchanging unit 60. In addition, the liquid-side connection pipes LP (LP1 and LP2) are each individually connected to a corresponding one of the first liquid-side inlet/outlet LH1 of the upwind heat-exchanging unit 50 and second liquid-side inlet/outlet LH2 of the downwind heat-exchanging unit 60. However, the modes of connection of the gas-side connection pipes GP and the liquid-side connection pipes LP in the indoor heat exchanger 25 are not necessarily limited thereto, and can be changed as appropriate. For example, a shunt may be disposed between the indoor heat exchanger 25 and each gas-side connection pipe GP or each liquid-side connection pipe LP, and both may be made to communicate with each other via the shunt.

As long as inconsistencies in the flow of the refrigerant do not occur, the upwind heat-exchanging unit 50 and the downwind heat-exchanging unit 60 may each further include a header collecting pipe differing from the header collecting pipes (56 and 57 or 66 and 67) described in the above-described embodiments.

(6-10) Modification 10

In the above-described embodiments, the first path P1 includes twelve heat transfer tubes 45 (heat-transfer-tube flow paths 451). However, the mode of formation of the first path P1 is not necessarily limited thereto, and can be changed as appropriate. That is, the first path P1 may include 11 or fewer or 13 or more heat transfer tubes 45 (heat-transfer-tube flow paths 451).

In the above-described embodiments, the second path P2 includes four heat transfer tubes 45 (heat-transfer-tube flow paths 451). However, the mode of formation of the second path P2 is not necessarily limited thereto, and can be changed as appropriate. That is, the second path P2 may include 3 or fewer or 5 or more heat transfer tubes 45 (heat-transfer-tube flow paths 451).

In the above-described embodiments, the third path P3 includes three heat transfer tubes 45 (heat-transfer-tube flow paths 451). However, the mode of formation of the third path P3 is not necessarily limited thereto, and can be changed as appropriate. That is, the third path P3 may include 2 or fewer or 4 or more heat transfer tubes 45 (heat-transfer-tube flow paths 451).

(6-11) Modification 11

In the above-described embodiments, the indoor heat exchanger 25 includes 19 heat transfer tubes 45. However, the number of heat transfer tubes 45 that are included in the indoor heat exchanger 25 can be changed as appropriate in accordance with design specifications and installation environments. For example, the indoor heat exchanger 25 may include 18 or fewer or 20 or more heat transfer tubes 45.

(6-12) Modification 12

In the above-described embodiments, each heat transfer tube 45 is a flat perforated tube in which a plurality of heat-transfer-tube flow paths 451 are formed in its interior. However, the mode of construction of the heat transfer tubes 45 can be changed as appropriate. For example, flat tubes each having one refrigerant flow path formed in their interior may be used as the heat transfer tubes 45. In addition, heat transfer tubes having a shape other than a plate shape (heat transfer tubes other than flat tubes) may be used as the heat transfer tubes 45.

The heat transfer tubes 45 need not be made of aluminum or an aluminum alloy, and materials of the heat transfer tubes 45 can be changed as appropriate. For example, the heat transfer tubes 45 may be made of copper. Similarly, the heat transfer fins 48 need not be made of aluminum or an aluminum alloy, and materials of the heat transfer fins 48 can be changed as appropriate.

(6-13) Modification 13

In the above-described embodiments, the indoor heat exchanger 25 is disposed so as to surround the indoor fan 28. However, the indoor heat exchanger 25 need not be disposed so as to surround the indoor fan 28, and the mode of arrangement can be changed as appropriate as long as it is a mode that allows heat exchange between the indoor air flow AF and the refrigerant.

(6-14) Modification 14

In the above-described embodiments, the case in which the indoor heat exchanger 25 in an installed state is such that the heat-transfer-tube extension direction dr1 is a horizontal direction and the heat-transfer-tube lamination direction dr2 is a vertical direction (up-down direction) is described. However, it is not necessarily limited thereto, and the indoor heat exchanger 25 may be formed and arranged so that, in the installed state, the heat-transfer-tube extension direction dr1 is a vertical direction and the heat-transfer-tube lamination direction dr2 is a horizontal direction.

In the above-described embodiments, the case in which the air flow direction dr3 is a horizontal direction is described. However, it is not necessarily limited thereto. The air flow direction dr3 can be changed as appropriate in accordance with the mode of construction and installation mode of the indoor heat exchanger 25. For example, the air flow direction dr3 may be a vertical direction that intersects the heat-transfer-tube extension direction dr1.

In the above-described embodiments, the subcooling areas (SC1 and SC2) are positioned at a portion (lower layer portion) of the upwind heat-exchanging unit 50 where the wind speed of the indoor air flow AF that passes therethrough is lower than the wind speeds at other portions. However, it is not necessarily limited thereto. The subcooling areas may be formed at a portion of the upwind heat-exchanging unit 50 where the wind speed of the indoor air flow AF that passes therethrough is the same as or higher than the wind speeds at other portions.

(6-15) Modification 15

In the above-described embodiments, the upwind first header 56 and the downwind second header 67 that are arranged adjacent to each other in the air flow direction dr3 are formed as separate headers, and, similarly, the upwind second header 57 and the downwind first header 66 are formed as separate headers. However, it is not necessarily limited thereto. In the indoor heat exchanger 25, the plurality of header collecting pipes (here, the upwind first header 56 and the downwind second header 67, or the upwind second header 57 and the downwind first header 66) that are arranged adjacent to each other in the air flow direction dr3 may be integrally formed. That is, by forming the plurality of header collecting pipes that are arranged adjacent to each other in the air flow direction dr3 as one header collecting pipe and dividing the internal space of such a header collecting pipe into two spaces by a longitudinal partition plate that partitions the internal space in a longitudinal direction, the upwind first-header space Sa1 and the downwind second-header space Sb2 or the upwind second-header space Sa2 and the downwind first-header space Sb1 may be formed. In such a case, by forming an opening in a flow-path formation portion, such as the longitudinal partition plate, that is disposed inside the header collecting pipe, a refrigerant flow path that allows each space to communicate with each other can be formed.

(6-16) Modification 16

In the above-described embodiments, the area of the downwind first heat-exchange surface 61 is substantially the same as the area of the upwind fourth heat-exchange surface 54 when viewed in the air flow direction dr3. However, the downwind first heat-exchange surface 61 need not be formed in this mode, and may be formed so that its area differs from the area of the upwind fourth heat-exchange surface 54 when viewed in the air flow direction dr3.

In the above-described embodiments, the area of the downwind second heat-exchange surface 62 is substantially the same as the area of the upwind third heat-exchange surface 53 when viewed in the air flow direction dr3. However, the downwind second heat-exchange surface 62 need not be formed in this mode, and may be formed so that its area differs from the area of the upwind third heat-exchange surface 53 when viewed in the air flow direction dr3.

In the above-described embodiments, the area of the downwind third heat-exchange surface 63 is substantially the same as the area of the upwind second heat-exchange surface 52 when viewed in the air flow direction dr3. However, the downwind third heat-exchange surface 63 need not be formed in this mode, and may be formed so that its area differs from the area of the upwind second heat-exchange surface 52 when viewed in the air flow direction dr3.

In the above-described embodiments, the area of the downwind fourth heat-exchange surface 64 is substantially the same as the area of the upwind first heat-exchange surface 51 when viewed in the air flow direction dr3. However, the downwind fourth heat-exchange surface 64 need not be formed in this mode, and may be formed so that its area differs from the area of the upwind first heat-exchange surface 51 when viewed in the air flow direction dr3.

(6-17) Modification 17

In the above-described embodiments, the indoor heat exchanger 25 is applied to a ceiling-embedded-type indoor unit 20 that is installed in the ceiling rear space CS of the target space. However, the type of indoor unit 20 to which the indoor exchanger 25 is applied is not limited. For example, the indoor heat exchanger 25 may be applied to, for example, a ceiling-suspension-type indoor unit that is fixed to the ceiling surface CL of the target space, a wall-mounted-type indoor unit that is installed on a side wall, a floor-placement-type indoor unit that is installed on a floor surface, and a floor-embedded-type indoor unit that is installed at the back surface of a floor.

(6-18) Modification 18

The mode of construction of the refrigerant circuit RC in the above-described embodiments can be changed as appropriate in accordance with installation environments and design specifications. Specifically, some of the circuit elements in the refrigerant circuit RC may be replaced by other devices, or may be omitted as appropriate when the circuit elements are not necessarily needed. For example, the four-way switching valve 12 may be omitted as appropriate and the air conditioner may be formed as an air conditioner for a heating operation. The refrigerant circuit RC may include devices that are not shown in FIG. 1 (for example, a subcooling heat exchanger or a receiver) and refrigerant flow paths (such as a circuit that causes refrigerant bypassing). For example, in the above-described embodiments, a plurality of compressors 11 may be arranged in series or in parallel.

(6-19) Modification 19

In the above-described embodiments, the case in which a HFC refrigerant, such as R32 and R410A, is used as a refrigerant that circulates in the refrigerant circuit RC is described. However, the refrigerant that is used in the refrigerant circuit RC is not limited. For example, in the refrigerant circuit RC, for example, HFO1234yf, HFO1234ze (E), and mixed refrigerants thereof may be used. In addition, in the refrigerant circuit RC, HFC-based refrigerants, such as R407C, may be used.

(6-20) Modification 20

In the above-described embodiments, one outdoor unit 10 and one indoor unit 20 are connected to each other by the connection pipes (LP and GP) to form the refrigerant circuit RC. However, the number of outdoor units 10 and the number of indoor units 20 can be changed as appropriate. For example, the air conditioner 100 may include a plurality of outdoor units 10 that are connected in series or in parallel. The air conditioner 100 may include, for example, a plurality of indoor units 20 that are connected in series or in parallel.

(6-21) Modification 21

Although, in the above-described embodiments, the present invention is applied to the indoor heat exchanger 25, it is not limited thereto, and may be applied to other heat exchangers. For example, the present invention may be applied to the outdoor heat exchanger 13. In such a case, outdoor air flow that is produced by the outdoor fan 15 corresponds to the indoor air flow AF in the above-described embodiments.

The present invention may be applied to a heat exchanger that functions only as either a condenser or an evaporator.

For example, the present invention may be applied to a heat exchanger that is installed in a refrigeration apparatus that performs only a reverse cycle operation (for example, a heating operation) and that functions only as a condenser of a refrigerant.

For example, the present invention may be applied to a heat exchanger that is installed in a refrigeration apparatus that performs only a normal cycle operation (for example, a cooling operation) and that functions only as an evaporator of a refrigerant. In such a case, the subcooling areas correspond to areas where, of a gas-liquid two-phase refrigerant, a refrigerant having a low dryness flows. The superheating areas correspond to areas where a superheated refrigerant flows, or an area where, of a gas-liquid two-phase refrigerant, a refrigerant having a high dryness flows.

(6-22) Modification 22

In the above-described embodiments, the present invention is applied to the air conditioner 100 serving as a refrigeration apparatus. However, the present invention may be applied to a refrigeration apparatus other than the air conditioner 100. For example, the present invention may also be applied to a low-temperature refrigeration apparatus used in a refrigeration cold container or a store room/showcase, or other types of refrigeration apparatuses including a refrigerant circuit and a heat exchanger, such as a hot water supply apparatus or heat pump chiller.

For example, the present invention may be applied to a refrigeration apparatus that performs only a reverse cycle operation (for example, a heating operation) or a refrigeration apparatus that performs only a normal cycle operation (for example, a cooling operation).

INDUSTRIAL APPLICABILITY

One or more embodiments of the present invention are usable in a heat exchanger or a refrigeration apparatus.

REFERENCE SIGNS LIST

10 outdoor unit
13 outdoor heat exchanger
20 indoor unit
25, 25*a*, 25*b*, 25*c* indoor heat exchanger (heat exchanger)
28 indoor fan
30 casing
30*a* connection pipe insertion port
40 heat-exchange surface
45 heat transfer tube (flat tube)
48 heat transfer fin
50, 50*a*, 50*b*, 50*c* upwind heat-exchanging unit
51 upwind first heat-exchange surface (first portion, third portion)
52 upwind second heat-exchange surface (second portion)
53 upwind third heat-exchange surface
54 upwind fourth heat-exchange surface (fourth portion)
55 upwind heat-exchange surface
56 upwind first header (first header)
57 upwind second header (second header)
58, 59 turn-around pipe (communication path formation portion)
60 downwind heat-exchanging unit
61 downwind first heat-exchange surface (third portion)
62 downwind second heat-exchange surface
63 downwind third heat-exchange surface (second portion)
64 downwind fourth heat-exchange surface (first portion, fourth portion)
65 downwind heat-exchange surface
66 downwind first header (first header)
67 downwind second header (second header)
70 connection pipe (flow path formation portion)
75 second connection pipe (flow path formation portion)
80 second downwind heat-exchanging unit
81 most-downstream first heat-exchange surface (first portion, third portion)
82 most-downstream second heat-exchange surface (second portion)
83 most-downstream third heat-exchange surface
84 most-downstream fourth heat-exchange surface (fourth portion)
85 most-downstream heat-exchange surface
86 most-downstream first header (first header)
87 most-downstream second header (second header)
100 air conditioner (refrigeration apparatus)
451 heat-transfer-tube flow path
561, 571 horizontal partition plate
A1 upwind first space
A2 upwind second space (upwind seventh space)
A3 upwind third space (upwind outlet-side space/upwind upstream-side space, upwind eighth space)
A4 upwind fourth space
A5 upwind fifth space (upwind ninth space)
A6 upwind sixth space (upwind upstream-side space/upwind outlet-side space, upstream tenth space)
AF indoor air flow (air flow)
GH gas-side inlet/outlet
GH1 first gas-side inlet/outlet (first inlet)
GH2 second gas-side inlet/outlet (second inlet)
GP gas-side connection pipe (connection pipe)
GP1 first gas-side connection pipe (connection pipe)
GP2 second gas-side connection pipe (connection pipe)
H1 to H5 first connection hole to fifth connection hole
JP, JP' turn-around flow path (communication path)
LH liquid-side inlet/outlet (outlet)
LH1 first liquid-side inlet/outlet (first outlet)
LH2 second liquid-side inlet/outlet (second outlet)
LP liquid-side connection pipe (connection pipe)
LP1 first liquid-side connection pipe (connection pipe)
LP2 second liquid-side connection pipe (connection pipe)
P1 to P5 first path to fifth path
RC refrigerant circuit RP, RP' connection flow path (refrigerant flow path, first refrigerant flow path)

RP2 second connection flow path (second refrigerant flow path)

SC1, SC2 subcooling area

SH1 to SH4 superheating area

Sa1 upwind first-header space (first-header space)

Sa2 upwind second-header space (second-header space)

Sb1 downwind first-header space (first-header space, downwind first upstream-side space)

Sb2 downwind second-header space (second-header space)

Sc1 most downstream first-header space (first-header space, downwind second upstream-side space)

Sc2 most downstream second header space (second-header space)

dr1 heat-transfer-tube extension direction dr2 heat-transfer-tube lamination direction dr3 air flow direction Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat exchanger comprising:

an upwind heat-exchanging unit that comprises a first inlet;

a downwind heat-exchanging unit that comprises a second inlet and is disposed beside the upwind heat-exchanging unit on a downwind side of the upwind heat-exchanging unit; and a flow path formation portion that comprises a refrigerant flow path between the upwind heat-exchanging unit and the downwind heat-exchanging unit, wherein a refrigerant flows into the heat exchanger via the first inlet and the second inlet simultaneously from an outside of the heat exchanger, exchanges heat with air flow, and flows out from an outlet to the outside of the heat exchanger as a liquid refrigerant in a subcooled state, the upwind heat-exchanging unit and the downwind heat-exchanging unit each comprise:

a first header comprising a first header space in the first header;

a second header comprising a second header space in the second header; and flat tubes that are connected to the first header and the second header and disposed side by side in a longitudinal direction of the first header and the second header, wherein the first header space and the second header space communicate with each other via the flat tubes, the upwind heat-exchanging unit comprises:

a subcooling area in which the liquid refrigerant flows;

an upwind outlet-side space that communicates with the outlet; and an upwind upstream-side space that is disposed on an upstream side of the upwind outlet-side space with respect to a flow of the refrigerant, and the refrigerant flow path causes the upwind upstream-side space to communicate with a downwind downstream-side space that is disposed on a most downstream side of a flow of the refrigerant in the downwind heat-exchanging unit.

2. The heat exchanger according to claim 1, wherein in each of the upwind heat-exchanging unit and the downwind heat-exchanging unit, the flat tubes comprise first flat tubes, second flat tubes, and third flat tubes;

in the upwind heat-exchanging unit:

the first header space is partitioned into an upwind first space, an upwind second space, and an upwind third space; and the second header space is partitioned into an upwind fourth space that communicates with the upwind first space via the first flat tubes, an upwind fifth space that communicates with the upwind second space via the second flat tubes, and an upwind sixth space that communicates with the upwind third space via the third flat tubes;

the upwind heat-exchanging unit further comprises a communication path formation portion that forms a communication path, wherein the upwind fourth space and the upwind fifth space communicate with each other via the communication path;

the first inlet communicates with the upwind first space;

the second inlet communicates with the first header space that is disposed on a most upstream side of a flow of the refrigerant in the downwind heat-exchanging unit;

the outlet comprises:

a first outlet that communicates with the upwind second space; and a second outlet that communicates with the upwind outlet-side space;

one of the upwind third space or the upwind sixth space corresponds to the upwind outlet-side space; and the upwind third space or the upwind sixth space that does not correspond to the upwind outlet-side space corresponds to the upwind upstream-side space.

3. The heat exchanger according to claim 1, wherein in each of the upwind heat-exchanging unit and the downwind heat-exchanging unit, the flat tubes comprise first flat tubes, second flat tubes, and third flat tubes;

in the upwind heat-exchanging unit:

the first header space is partitioned into an upwind first space, an upwind second space, and an upwind third space; and the second header space is partitioned into an upwind fourth space that communicates with the upwind first space via the first flat tubes, an upwind fifth space that communicates with the upwind second space via the second flat tubes, and an upwind sixth space that communicates with the upwind third space via the third flat tubes, the upwind heat-exchanging unit further comprises a communication path formation portion that forms a communication path, wherein the upwind second space and the upwind fourth space communicate with each other via the communication path, the first inlet communicates with the upwind first space, the second inlet communicates with the first header space that is disposed on a most upstream side of a flow of the refrigerant in the downwind heat-exchanging unit, the outlet comprises:

a first outlet that communicates with the upwind fifth space; and a second outlet that communicates with the upwind outlet-side space, one of the upwind third space or the upwind sixth space corresponds to the upwind outlet-side space, and the upwind third space or the upwind sixth space that does not correspond to the upwind outlet-side space corresponds to the upwind upstream-side space.

4. The heat exchanger according to claim 2, wherein the heat exchanger further comprises a plurality of downwind heat-exchanging units;

in the upwind heat-exchanging unit:

the first header space is partitioned into an upwind seventh space and an upwind eighth space; and the second header space is partitioned into an upwind ninth space that communicates with the upwind seventh space via the flat tubes and an upwind tenth space that communicates with the upwind eighth space via the flat tubes, the second inlet communicates with a downwind first upstream-side space that is one of the first header space or the second header space disposed on a most upstream side of a downwind heat-exchanging unit, among the downwind heat-exchanging units, that is disposed on an upwind side, the first inlet communicates with a downwind second upstream-side space that is one of the first header space or the second header space disposed on a most upstream side of a downwind heat-exchanging unit, among the downwind heat-exchanging units, that is disposed on a downwind side, the outlet comprises:

a first outlet that communicates with any one of the upwind seventh space, the upwind eighth space, the upwind ninth space, and the upwind tenth space; and a second outlet that communicates with any other of the upwind seventh space, the upwind eighth space, the upwind ninth space, and the upwind tenth space, one of the upwind seventh space, the upwind eighth space, the upwind ninth space, and the upwind tenth space that communicates with the first outlet or the second outlet corresponds to the upwind outlet-side space, all other spaces correspond to the upwind upstream-side space, and the refrigerant flow path comprises:

a first refrigerant flow path via which the downwind downstream-side space of the downwind heat-exchanging unit that is disposed on the upwind side and any one of the upwind upstream-side spaces communicate with each other; and a second refrigerant flow path via which the downwind downstream-side space of the downwind heat-exchanging unit that is disposed on the downwind side and another of the upwind upstream-side spaces communicate with each other.

5. The heat exchanger according to claim 1, wherein when a gas refrigerant in a superheated state that flows in from the first inlet or the second inlet exchanges heat with the air flow and flows out from the outlet as the liquid refrigerant, the gas refrigerant in the superheated state flows in a superheating area in each of the upwind heat-exchanging unit and the downwind heat-exchanging unit, and a direction of flow of the gas refrigerant that flows through the superheating area of the upwind heat-exchanging unit is opposite to a direction of flow of the gas refrigerant that flows through the superheating area of the downwind heat-exchanging unit.

6. The heat exchanger according to claim 1, wherein the subcooling area is disposed in a portion of the upwind heat-exchanging unit where a wind speed of the air flow that passes through the portion is less than a wind speed of the air flow in another portion of the upwind heat-exchanging unit.

7. The heat exchanger according to claim 1, wherein in an installed state:

the upwind heat-exchanging unit and the downwind heat-exchanging unit each comprise:

a first portion in which the flat tubes extend in a first direction; and a second portion in which the flat tubes extend in a second direction that intersects the first direction, the first portion of the downwind heat-exchanging unit is disposed beside a downwind side of the first portion of the upwind heat-exchanging unit, and the second portion of the downwind heat-exchanging unit is disposed beside a downwind side of the second portion of the upwind heat-exchanging unit.

8. A refrigeration apparatus comprising:

the heat exchanger according to claim 1; and a casing that accommodates the heat exchanger, wherein the casing comprises a connection pipe insertion port to which a refrigerant connection pipe is inserted, in the heat exchanger, the upwind heat-exchanging unit, and the downwind heat-exchanging unit each comprise:

a first portion in which the flat tubes extend in a first direction; and a second portion in which the flat tubes extend in a second direction different from the first direction, in the upwind heat-exchanging unit, one of the first header or the second header is disposed at a terminating end of the first portion, and another of the first header or the second header is disposed at a leading end of the second portion that is disposed apart from the terminating end of the first portion, in the downwind heat-exchanging unit:

one of the first header or the second header is disposed at a terminating end of the first portion, and another of the first header or the second header is disposed at a leading end of the second portion that is disposed apart from the terminating end of the first portion, and in each of the upwind heat-exchanging unit and the downwind heat-exchanging unit:

the terminating end of the first portion is disposed closer to the connection pipe insertion port than a leading end of the first portion, and the leading end of the second portion is disposed closer to the connection pipe insertion port than a terminating end of the second portion.

* * * * *